US009130267B2

(12) United States Patent
Anguera et al.

(10) Patent No.: US 9,130,267 B2
(45) Date of Patent: Sep. 8, 2015

(54) WIRELESS DEVICE INCLUDING A MULTIBAND ANTENNA SYSTEM

(75) Inventors: Jaume Anguera, Castellon (ES); Ivan Sanz, Barcelona (ES); Carles Puente, Sant Cugat del Valles (ES); Josep Mumbru, Barcelona (ES)

(73) Assignee: Fractus, S.A., Barcelona (ES)

( * ) Notice: Subject to any disclaimer, the term of this patent is extended or adjusted under 35 U.S.C. 154(b) by 969 days.

(21) Appl. No.: 12/593,290

(22) PCT Filed: Mar. 26, 2008

(86) PCT No.: PCT/EP2008/053526

§ 371 (c)(1),
(2), (4) Date: Sep. 26, 2009

(87) PCT Pub. No.: WO2008/119699

PCT Pub. Date: Oct. 9, 2008

(65) Prior Publication Data

US 2010/0109955 A1 May 6, 2010

Related U.S. Application Data

(60) Provisional application No. 60/910,113, filed on Apr. 4, 2007.

(30) Foreign Application Priority Data

Mar. 30, 2007 (EP) ..... 07105364

(51) Int. Cl.
*H01Q 5/00* (2006.01)
*H01Q 1/36* (2006.01)

(Continued)

(52) U.S. Cl.
CPC ..... *H01Q 1/243* (2013.01); *H01Q 1/36* (2013.01); *H01Q 5/00* (2013.01); *H01Q 5/50* (2013.01); *H01Q 21/30* (2013.01)

(58) Field of Classification Search
CPC ..... H01Q 1/243; H01Q 5/0093; H01Q 5/50; H01Q 21/30; H01Q 1/36
USPC ..... 343/860, 745
See application file for complete search history.

(56) References Cited

U.S. PATENT DOCUMENTS 4,827,266 A 5/1989 Sato
5,489,912 A 2/1996 Holloway (Continued)

FOREIGN PATENT DOCUMENTS

CN 1674354 A 9/2005
EP 1202386 A2 5/2002

(Continued)

OTHER PUBLICATIONS

Yiqun Li; Cantin, T.; Derat, B.; Pasquet, D.; Bolomey, J.-C., "Application of Resonant Matching Circuits for Simultaneously Enhancing the Bandwidths of Multi-band Mobile Phones," Antenna Technology: Small and Smart Antennas Metamaterials and Applications, 2007. IWAT '07. International Workshop on, vol., No., pp. 479,482, Mar. 21-23, 2007.*

(Continued)

*Primary Examiner* — Robert Karacsony
*Assistant Examiner* — Amal Patel
(74) *Attorney, Agent, or Firm* — Edell, Shapiro & Finnan, LLC

(57) ABSTRACT

A wireless handheld or portable device includes an antenna system operative in a first frequency region and a higher, second frequency region that includes an antenna structure, a matching and tuning system, and an external input/output port. The antenna structure includes at least one radiating element including a connection point, a ground plane layer including at least one connection point, and at least one internal input/output port. At least one radiating element of the antenna structure protrudes beyond the ground plane layer. The antenna structure features at any of its at least one internal input/output ports when disconnected from the matching and tuning system an input return loss curve having a minimum at a frequency outside the first frequency region of operation of the antenna system. The matching and tuning system provides impedance matching to the antenna system in the first and second regions of operation of the antenna system.

34 Claims, 30 Drawing Sheets

Figure 1A:
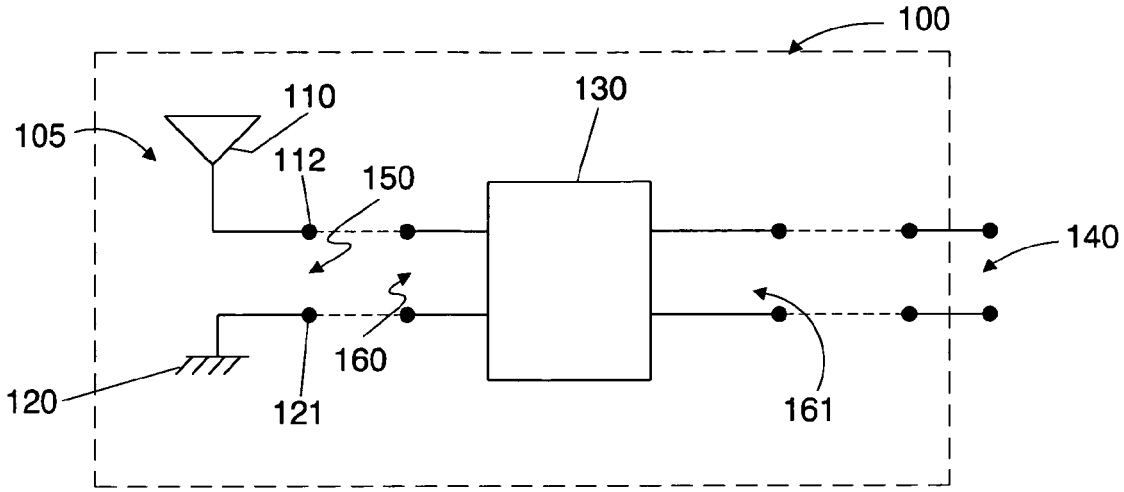

(51) Int. Cl.

| | |
|---|---|
| ***H01Q 1/24*** | (2006.01) |
| ***H01Q 21/30*** | (2006.01) |
| ***H01Q 5/50*** | (2015.01) |

(56) References Cited

U.S. PATENT DOCUMENTS

| | | | | |
|---|---|---|---|---|
| 6,002,367 | A | 12/1999 | Engblom | |
| 6,040,803 | A | 3/2000 | Spall | |
| 6,198,943 | B1 | 3/2001 | Sadler | |
| 6,211,826 | B1 | 4/2001 | Aoki | |
| 6,304,222 | B1 | 10/2001 | Smith | |
| 6,326,927 | B1 | 12/2001 | Johnson | |
| 6,498,586 | B2 | 12/2002 | Pankinaho | |
| 6,515,629 | B1 | 2/2003 | Kuo | |
| 6,535,170 | B2 * | 3/2003 | Sawamura et al. | 343/702 |
| 6,614,399 | B2 | 9/2003 | Trumbull et al. | |
| 6,624,786 | B2 | 9/2003 | Boyle | |
| 6,674,411 | B2 * | 1/2004 | Boyle | 343/860 |
| 6,693,594 | B2 | 2/2004 | Pankinaho | |
| 6,759,991 | B2 | 7/2004 | Boyle | |
| 6,765,536 | B2 | 7/2004 | Phillips et al. | |
| 6,788,257 | B2 | 9/2004 | Fang | |
| 6,819,287 | B2 | 11/2004 | Sullivan | |
| 6,831,607 | B2 | 12/2004 | Hebron | |
| 6,873,299 | B2 * | 3/2005 | Dakeya et al. | 343/745 |
| 6,914,570 | B2 | 7/2005 | Asrani | |
| 6,937,196 | B2 | 8/2005 | Korva | |
| 7,015,868 | B2 | 3/2006 | Puente | |
| 7,026,999 | B2 | 4/2006 | Umehara | |
| 7,053,843 | B2 | 5/2006 | Nysen | |
| 7,057,560 | B2 | 6/2006 | Erkocevic | |
| 7,119,749 | B2 | 10/2006 | Miyata | |
| 7,148,850 | B2 | 12/2006 | Puente | |
| 7,274,340 | B2 | 9/2007 | Ozden | |
| 7,466,277 | B2 | 12/2008 | Ishizuka | |
| 7,760,146 | B2 * | 7/2010 | Ollikainen | 343/702 |
| 2003/0146873 | A1 | 8/2003 | Blancho | |
| 2003/0174092 | A1 | 9/2003 | Sullivan et al. | |
| 2003/0186667 | A1 | 10/2003 | Wallace | |
| 2003/0193438 | A1 | 10/2003 | Yoon | |
| 2004/0046702 | A1 | 3/2004 | Pan | |
| 2004/0056804 | A1 | 3/2004 | Kadambi | |
| 2004/0145527 | A1 | 7/2004 | Mikkola | |
| 2004/0171404 | A1 | 9/2004 | Annamaa | |
| 2005/0007279 | A1 | 1/2005 | Chang | |
| 2005/0225484 | A1 | 10/2005 | Kuramoto | |
| 2005/0280580 | A1 | 12/2005 | Lin | |
| 2006/0141958 | A1 | 6/2006 | Brosnan | |
| 2006/0284773 | A1 | 12/2006 | Park | |
| 2008/0018543 | A1 | 1/2008 | Baliarda et al. | |
| 2009/0243943 | A1 | 10/2009 | Mumbru | |

FOREIGN PATENT DOCUMENTS

| | | | |
|---|---|---|---|
| EP | 1241733 | A1 | 9/2002 |
| EP | 1248317 | A1 | 10/2002 |
| EP | 1396906 | A1 | 3/2004 |
| EP | 1469549 | A1 | 4/2004 |
| EP | 1458108 | A1 | 9/2004 |
| EP | 1458108 | A1 | 9/2004 |
| EP | 1703586 | A1 | 12/2004 |
| EP | 1544943 | A1 | 6/2005 |
| EP | 1569300 | A1 | 8/2005 |
| EP | 1569300 | A1 | 8/2005 |
| EP | 1672733 | A1 | 6/2006 |
| EP | 1703586 | A1 | 9/2006 |
| GB | 2389463 | A | 12/2003 |
| GB | 2403069 | A | 12/2004 |
| JP | 05-014042 | | 1/1993 |
| JP | 2002-344231 | | 11/2002 |
| JP | U3094677 | | 4/2003 |
| JP | 2005-167827 | | 6/2005 |
| JP | 2005-197776 | | 7/2005 |
| JP | 2005-341313 | | 12/2005 |
| JP | 2006-165834 | | 6/2006 |
| JP | 2006-180338 | | 7/2006 |
| WO | 97/06578 | A1 | 2/1997 |
| WO | 97/47054 | A1 | 12/1997 |
| WO | 01/08255 | | 2/2001 |
| WO | 02/37606 | A1 | 5/2002 |
| WO | 03/026064 | A1 | 3/2003 |
| WO | 03/047025 | A1 | 6/2003 |
| WO | 03/094290 | A1 | 11/2003 |
| WO | 2004/025778 | A1 | 3/2004 |
| WO | WO-2004/025778 | A1 | 3/2004 |
| WO | 2004/109850 | A1 | 12/2004 |
| WO | 2005/076409 | A1 | 8/2005 |
| wo | 2005/081358 | A1 | 9/2005 |
| WO | 2005/091433 | A1 | 9/2005 |
| WO | WO 2006070017 | A1 * | 7/2006 |
| WO | 2007/128340 | A1 | 11/2007 |
| WO | WO-2007/128340 | A1 | 11/2007 |

OTHER PUBLICATIONS

Wong , Kin-Lu ; Su , Wei-Cheng ; Chang , Fa-Shian. Wideband internal folded planar monopole antenna for UMTS/WiMax folder-type mobile phone. Microwave and Optical Technology Letters, vol. 48 No. 2, Feb. 2006.

Cabedo , M. Systematic design of antennas using the theory of characteristic modes. Universitat Politécnica de Valencia, Feb. 2007.

Kildal , P. S. ; Luxey , C. ; Skrivervik , A. K. et al. Report on the state of the art in small terminal antennas: Technologies, requirements and standards. ACE. Dec. 2004.

Haapala , P. ; Vainikainen , P. Helical antennas for multi-mode mobile phones. 26th European Microwave Conference, 1996.

von Walter, Sven-Uwe, "International Search Report for PCT/EP2008/053526" as mailed Aug. 22, 2008 (5 pages).

Boyle , K., A dual-fed. self-diplexing PIFa and RF front-end. IEEE Transactions on Antennas and Propagation, vol. 55, Feb. 2007.

Cabedo , M., Modal analysis of a radiating slotted PCB for mobile handsets. EuCAP, Nov. 2006.

Karmakar, N. C., Shorting strap tunable stacked patch PIFA. IEEE Transactions on Antennas and Propagation, vol. 52. Nov. 2004.

Diallo , A. Study and reduction of the mutual coupling between two mobile mobile phone PIFAs operating in the DCS1800 and UMTS bands. IEEE Transactions on Antennas and Propagation, vol. 54. Nov. 2006.

Du , Z., A novel compact wide-band planar antenna for mobile handsets.

Field , V. HF antennas 101. QST, 2004.

Hong, S. et al., Design of an internal multiresonant monopole antenna for GSM900/DCS1800/US-PCS/S-DMB operation. IEEE Transactions on Antennas and Propagation, vol. 56, May 2008.

Huynh, M.C., A numerical and experimental investigation of planar inverted-F antennas for wireless communication applications. Virginia Polytechnic Institute and State University. Oct. 2000.

Kuo , J.S., Dual-frequency operation of a planar inverted-L antenna with tapered patch width. Microwave and Optcal Technology Letters, vol. 28, Jan. 2001.

Lau, K. L.; A monopolar patch antenna with very wide impedance bandwidth. IEEE Transactions on Antennas and Propagation, vol. 53, Feb. 2005.

Li, R., A novel low-profile broadband dual-frequency planar antenna for wireless handsets. IEEE Transactions on Antennas and Propagation, vol. 56, Apr. 2008.

Lin, S. Y., Multiband folded planar monopole antenna for mobile handset. IEEE Transactions on Antennas and Propagation, vol. 52, Jul. 2004.

Lindberg , P. A bandwidth enhancement technique for mobile handset antennas using wavetraps. IEEE Transactions on Antennas and Propagation, vol. 54, Aug. 2006.

N5ESE's 87 ft inverted "L" portable antenna. N5ESE's Ham Radio Page. Jun. 2007.

Ollikainen, J. et al. Internal multiband handset antenna realized with an integrated matching circuit.IEE The Institute of Electrical Engineers. 2003.

Poutanen, J. Interaction between mobile terminal antenna and user. (Master's Thesis) Helsinki University of Technology, Set. 2007.

(56) References Cited

OTHER PUBLICATIONS

Jung, A. Text messaging capabilities of APRS. Relay. Apr. 2005.
Vainikainen, P. Resonator-based analysis of the combination of mobile handset antenna and chassis. IEEE Transactions on Antennas and Propagation, vol. 50. Oct. 2002.
Villanen, J. Coupling element based mobile terminal antenna structures. IEEE Transactions on Antennas and Propagation, vol. 54. Jul. 2006.
Villanen, J. Mobile broadband antennas. XX Simposium Nacional de la Unión Cientifica Internacional de la Radio (URSI) : Gandia , 2005.
Villanen, J. Compact antenna structures for mobile handsets. 58th Vehicular Technology Conference, 2003. VTC 2003-Fall. 2003.
Villanen, J. Design and characterization of antennas for mobile terminals. Helsinki University of Technology. Aug. 2004.
Wong, K. L. Planar antennas for wireless communications. John Wiley & Sons, cop. 2003.

* cited by examiner

WIRELESS DEVICE INCLUDING A MULTIBAND ANTENNA SYSTEM

This international patent application claims priority to prior U.S. application No. 60/910,113 filed on 4 Apr. 2007 and to prior EP-application No. 07105364 filed on 30 Mar. 2007. The entire disclosures of the aforesaid application numbers U.S. 60/910,113 and EP 07105364 are hereby incorporated by reference.

OBJECT OF THE INVENTION

The present invention relates to the field of internal antennas for a wireless handheld device, and generally for any wireless portable device, to enable the transmission and reception of electromagnetic wave signals.

It is an object of the present invention to provide an antenna system for a wireless handheld or portable device (such as for instance but not limited to a mobile phone, a smartphone, a PDA, an MP3 player, a headset, a USB dongle, a laptop computer, a gaming device, a digital camera, a PCMCIA or Cardbus 32 card), which occupies a reduced volume within the wireless device and is capable of operation in a plurality of frequency regions of the electromagnetic spectrum with enhanced radioelectric performance, increased robustness to external effects and neighboring components of the wireless device, and/or reduced interaction with the user.

Another object of the invention relates to a method to enable the operation of a wireless handheld or portable device in a plurality of frequency regions of the electromagnetic spectrum by providing an antenna system which occupies a reduced volume within the wireless device and operates with enhanced radioelectric performance, increased robustness to external effects and neighboring components of the wireless device, and/or reduced interaction with the user.

BACKGROUND OF THE INVENTION

Wireless handheld or portable devices typically operate one or more cellular communication standards and/or wireless connectivity standards, each standard being allocated in one or more frequency bands, and said frequency bands being contained within one or more regions of the electromagnetic spectrum.

For that purpose, a space within the wireless handheld or portable device is dedicated to the integration of an antenna system. However, the antenna system is usually expected to be small in order to occupy as little space as possible within the device, which then allows for smaller devices, or for the addition of more specific equipment and functionality into the device. At the same time, it is sometimes required for the antenna system to be flat since this allows for slim devices or in particular, for devices which have two parts that can be shifted or twisted against each other.

Many of the demands for wireless handheld or portable devices also translate to specific demands for the antenna systems thereof.

A wireless handheld device must include an antenna system capable of operating in multiple frequency regions with a proper radioelectric performance (such as for example in terms of input impedance level, impedance bandwidth, gain, efficiency, or radiation pattern). Moreover, the integration of the antenna system within the wireless handheld device must be correct to ensure that the wireless device itself attains a proper radioelectric performance (such as for example in terms of radiated power, received power, or sensitivity).

For a proper wireless connection, high gain and efficiency are further required. Other more common design demands for antenna systems are the voltage standing wave ratio (VSWR) and the impedance which is supposed to be about 50 ohms. Also, a substantially omnidirectional radiation pattern is desired since a mobile user needs to operate the wireless handheld device regardless of the particular location and direction of the nearest base transceiver station.

Other demands for antenna systems for wireless handheld or portable devices are low cost and a low specific absorption rate (SAR).

Furthermore, an antenna system has to be integrated into a device or in other words a wireless handheld or portable device has to be constructed such that an appropriate antenna system may be integrated therein which puts constraints by consideration of the mechanical fit, the electrical fit and the assembly fit.

Of further importance, usually, is the robustness of the antenna system which means that the antenna system does not change its properties upon smaller shocks to the device.

Usually, antenna systems with a substantially planar conducting radiating element placed at some distance over a ground plane layer are known as microstrip or patch antennas. Usually such microstrip and patch antennas include at least a feeding connection and a grounding connection, forming a so-called Planar Inverted F Antenna (PIFA). It is well known that the performance of such antennas is limited, in terms of impedance bandwidth, efficiency and related parameters (gain, VSWR and so on) by the spacing between said radiating element and the ground plane layer: the shorter the distance between both, the smaller the impedance bandwidth and efficiency.

Typically, a multiband antenna system includes a radiating element whose geometry is able to support different radiation modes so that said antenna system can operate with a determined radioelectric performance in multiple frequency regions of the electromagnetic spectrum. Such a multiband behavior is achieved by appropriately shaping the geometry of the radiating element, creating several radiating geometric elements, such as arms, polygons, or straight or curved line segments, and/or introducing slots, apertures or openings within the radiating element, to provide different paths to the electric currents flowing on the conductive parts of the radiating element and/or to the equivalent magnetic currents on slots, apertures or openings within said radiating element, exciting different radiation modes for the multiple frequency regions of operation.

In such multiband antenna systems, the different radiation modes supported by the radiating element are usually associated to different geometrical portions of said radiating element. Said portions need to share a same volume dedicated to the integration of the radiating element inside the wireless handheld device, and in fact, in most cases, they have to compete for space within said volume.

Therefore, these antenna systems typically exhibit a limited radioelectric performance in the frequency regions of operation.

Moreover, the presence of multiple arms, slots, apertures and/or openings within the radiating element of these antenna systems makes them much more sensitive to external effects (such as for instance the presence of plastic or dielectric covers that surround the wireless device), to components of the wireless device (such as for instance, but not limited to, a speaker, a microphone, a connector, a display, a shield can, a vibrating module, a battery, or an electronic module or subsystem) placed either in the vicinity of, or even underneath, the radiating element, and/or to the presence of the user of the wireless device.

A multiband antenna system is sensitive to any of the above mentioned aspects because they may alter the electromagnetic coupling between the different geometrical portions of the radiating element, which usually translates into detuning effects, degradation of the radioelectric performance of the antenna system and/or the radioelectric performance wireless device, and/or greater interaction with the user (such as an increased level of SAR).

On the other hand, antenna systems having a radiating element with a geometrically simple shape (such as for example those composed by one polygon) provide a single path for the currents, exciting just one radiation mode.

In these antenna systems, the radiating element comprises a single geometrical portion that uses all the available volume within the wireless handheld device dedicated to the antenna system. Therefore these antenna systems may provide an improved radioelectric performance and be less sensitive to external effects and/or to the presence of components of the device in a neighborhood of the radiating element, and possibly be less affected by the presence of the user.

However, such antenna systems typically provide only one frequency region of operation, in which the antenna system exhibits a good radioelectric performance. This aspect constitutes a major limitation to the use of said antenna systems in wireless handheld or portable devices, because these devices usually operate one or more communication standards requiring multiple frequency regions of the electromagnetic spectrum.

Moreover, different communication standards being operated by a wireless handheld or portable device are usually allocated in distantly spaced frequency regions. For example, frequencies within a frequency region being two times higher than frequencies in another frequency region are typical in wireless devices operating GSM 900 (880-960 MHz) and GSM 1800 (1710-1880 MHz), or operating IEEE 802.11b/g (2.4-2.5 GHz) and IEEE 802.11a (5.15–5.875 GHz).

Therefore, an antenna system having a radiating element with a geometrically simple shape and featuring good radioelectric performance over a broad or wide frequency region (i.e., a broadband or wideband solution) able to encompass the plurality of frequency regions of operation of a wireless handheld or portable device is impractical.

Some attempts have been made to obtain an antenna system capable of operating in two frequency regions, in which said antenna system comprises a radiating element of a geometrically simple shape.

For example, U.S. Pat. No. 6,674,411 discloses a planar inverted-L antenna (i.e., a patch antenna) having a radiating element composed by a rectangular plate. Said radiating element is placed above, and substantially parallel to, a ground plane. The antenna is connected to a matching network that provides a match in two frequency regions of the electromagnetic spectrum.

As a further example, US 2005/0225484 describes a planar inverted-F antenna (PIFA) having a radiating element composed by a rectangular plate. Said radiating element is placed above, and substantially parallel to, a ground plane. The antenna is connected to a matching circuit that performs adjustment of the reflection characteristics of the antenna in two frequency regions.

Moreover, the PIFA comprises a feeding connection and a grounding connection. In order to achieve the desired operation in multiple frequency regions, the feeding connection and the grounding connection must be disposed at a distance not smaller than one sixth of the circumference length of the radiating element.

These prior-art antenna systems are however very sensitive to the height of the radiating element with respect to the ground plane. For the typical 5-15% impedance bandwidths of cellular/mobile standards (GSM, UMTS, PCS, WCDMA), the minimum distance is about 2% of the longest operating wavelength (typically 7-9 mm). As the height of the radiating element is reduced, the impedance bandwidth and the efficiency of the antenna system decrease. Consequently, the capability of the antenna system to operate in more than one frequency region, or with a broadband behavior, is severely diminished.

Such a severe limitation makes these antenna systems not suitable for many wireless handheld or portable devices, in particular for those devices in which the volume dedicated to the integration of the antenna system has a limited height, or in those thin, slim devices in which the overall height of the device itself has to be small.

SUMMARY OF THE INVENTION

A wireless handheld or portable device according to the present invention operates one, two, three or more cellular communication standards (for example 2G systems such as GSM 850, GSM 900, GSM 1800, GSM 1900, PCS, or CDMA; 3G systems such as UMTS, W-CDMA, cdmaOne, cdma2000, TD-SCDMA; etc.), wireless connectivity standards (such as for instance WiFi, IEEE802.11 standards, Bluetooth, ZigBee, UWB, WiMAX, HSDPA, WiBro, or other high-speed standards), and/or broadcasts standards (such as for instance FM, DAB, XDARS, SDARS, DVB-H, DMB, T-DMB, or other related digital or analog video and/or audio standards), each standard being allocated in one or more frequency bands, and said frequency bands being contained within two, three or more frequency regions of the electromagnetic spectrum.

The wireless handheld or portable device including an antenna system according to the present invention may have a candy-bar shape, which means that its configuration is given by a single body. It may also have a two-body configuration such as a clamshell, flip-type, swivel-type or slider structure. In some other cases, the device may have a configuration comprising three or more bodies. It may further or additionally have a twist configuration in which a body portion (e.g. with a screen) can be twisted (i.e., rotated with two or more axes of rotation which are preferably not parallel), or even combine sliding and rotating mechanisms between said two or more bodies.

For a wireless handheld or portable device which is slim and/or whose configuration comprises two or more bodies, the requirements on maximum height of the antenna structure are very stringent, as the maximum thickness of each of the two or more bodies of the device may be limited to 5, 6, 7, 8 or 9 mm. With the technology disclosed herein, it is possible to design low profile antenna structures having an enhanced radioelectric performance even for such devices.

In the context of the present document a wireless handheld or portable device is considered to be slim if it has a thickness of less than 14 mm, 13 mm, 12 mm, 11 mm, 10 mm, 9 mm or 8 mm.

According to an aspect of the present invention, a wireless handheld or portable device includes an antenna system capable of operating in at least two frequency regions of the electromagnetic spectrum: a first frequency region and a second frequency region, wherein preferably the highest frequency of the first frequency region is lower than the lowest frequency of the second frequency region. Said antenna system comprises an antenna structure having at least one radiating element including a connection point, a ground plane layer including at least one connection point, and at least one internal input/output (I/O) port, said at least one internal I/O port being defined by the connection point of the at least one radiating element and one of the at least one connection points of the ground plane layer, or in other words the internal I/O-port is positioned from an electrical point of view between the connection point of the at least one radiating element and one of the at least one connection points of the ground plane layer. The antenna system further comprises a matching and tuning system, and an external input/output (I/O) port.

In this text, an I/O port of the antenna structure is referred to as an internal I/O port, while an I/O port of the antenna system is referred to as an external I/O port. In this context, the terms "internal" and "external" when referring to an I/O port are used simply to distinguish the I/O ports of the antenna structure from those of the antenna system, and carry no implication as to whether an I/O port is accessible from the outside or not.

The antenna structure features at any, or every, of its at least one internal I/O ports, when disconnected from the matching and tuning system, an input return loss curve having a minimum at a frequency (hereinafter referred to as the intrinsic frequency at a given internal I/O port of the antenna structure) outside the first frequency region of operation of the antenna system.

The matching and tuning system comprises an I/O port connected to each of the at least one internal I/O ports of the antenna structure (i.e., as many I/O ports as there are internal I/O ports in the antenna structure), and an I/O port connected to an external I/O port of the antenna system. Said matching and tuning system modifies the impedance of the antenna structure, providing impedance matching to the antenna system in the at least two frequency regions of operation of the antenna system.

According to an aspect of the present invention, at least one radiating element of the antenna structure protrudes beyond the ground plane layer, so that at least a portion of the orthogonal projection of said radiating element onto the plane containing the ground plane layer does not overlap the ground plane layer.

Protruding a radiating element beyond the ground plane layer adjusts the levels of impedance of the antenna structure and enhances its impedance bandwidth. Such an effect advantageously counterbalances the degradation that these parameters suffer when the height of said radiating element with respect to the ground plane layer is small, as it is the case in particular for wireless handheld or portable devices with low profile, thus solving the limitations of the prior-art solutions.

In this text, the expression impedance bandwidth is to be interpreted as referring to a frequency region over which a wireless handheld or portable device and an antenna system comply with certain specifications, depending on the service for which the wireless device is adapted. For example, for a device adapted to transmit and receive signals of cellular communication standards, an antenna system having a relative impedance bandwidth of at least 10% (preferably not less than 15% or 20%) together with an antenna efficiency of not less than 30% (preferably not less than 40%, more preferably not less than 50%) can be preferred. Also, an input return-loss of −3 dB, or −6 dB, or better within the corresponding frequency region can be preferred.

In some examples, the antenna system is capable of operating in at least three, four, five or more regions of the electromagnetic spectrum.

In some embodiments, the antenna structure comprises two, three, four or more radiating elements, each of said radiating elements including a connection point, and each of said connection points defining, together with one of the at least one connection points of the ground plane layer, an internal I/O port of the antenna structure. Therefore, in some embodiments the antenna structure comprises two, three, four or more radiating elements, and correspondingly two, three, four or more internal I/O ports.

In some examples, a same connection point of the ground plane layer is used to define at least two, or even all, internal I/O ports of the antenna structure.

In some examples, the antenna system comprises a second external I/O port and the matching and tuning system comprises an additional I/O port, said additional I/O port being connected to said second external I/O port. That is, the antenna system features two external I/O ports.

According to the present invention, the antenna structure features at any, or every, of its internal I/O ports, when disconnected from the matching and tuning system, an input return loss curve having an intrinsic frequency outside the first frequency region of operation of the antenna system.

In some cases, the intrinsic frequency at any, or every, of the internal I/O ports of the antenna structure is also outside the second frequency region of operation of the antenna system.

In some examples, the intrinsic frequency at a given internal I/O port of the antenna structure corresponds preferably to a frequency at which the radiating element connected to said internal I/O port has a characteristic dimension substantially close to a quarter of the wavelength. In some other examples, the intrinsic frequency at said internal I/O port of the antenna structure corresponds to a frequency at which said radiating element has a dimension substantially close to an integral multiple of the quarter of the wavelength. In some examples, the intrinsic frequency at a given internal I/O port of the antenna structure is a resonance frequency of the antenna structure.

In the context of this document, two linear dimensions are substantially close to each other if they differ in less than 5% (preferably less than 3%, 1.5%, 0.6% or 0.3%) of the free-space wavelength corresponding to the lowest frequency of operation of the antenna system. In the same way, two points are substantially close to each other if the distance between them is less than 5% (preferably less than 3%, 1.5%, 0.6% or 0.3%) of the free-space wavelength corresponding to said lowest frequency of operation.

The realized gain of an antenna structure depends on factors such as its directivity, its radiation pattern, its radiating efficiency and its input return loss. Both the radiating efficiency and the input return loss of the antenna structure are frequency dependent (even directivity is strictly frequency dependent). An antenna structure is usually very efficient at any, or every, of its intrinsic frequencies and maintains a similar (or at least suitable) radioelectric performance within the frequency range defined by its impedance bandwidth around its intrinsic frequency or frequencies.

In some examples, the intrinsic frequency at any, or every, of the internal I/O ports of the antenna structure is advantageously located above (i.e., at a frequency higher than) the frequency region of lowest frequency of the two or more frequency regions of operation of the antenna system (such as for example, above said first frequency region).

In some examples, the intrinsic frequency at any, or every, of said internal I/O ports is at the same time located below (i.e., at a frequency lower than) the frequency region of highest frequency of the two or more frequency regions of operation of the antenna system (such as for example, below said second frequency region). Hence, the intrinsic frequency at any, or every, of said internal I/O ports is located above the first frequency region but below the second frequency region.

In some other examples, the intrinsic frequency at least some of, or even all, the internal I/O ports of the antenna structure is located above the second frequency region, whereas in yet some other examples the intrinsic frequency at least some of, or even all, the internal I/O ports can be located below the first frequency region.

In some further examples, the intrinsic frequency at an internal I/O port of the antenna structure is located above a third frequency region of operation of the antenna system, said third frequency region having a lowest frequency higher than the highest frequency of the second frequency region of operation of said antenna system.

In some cases, the ratio between the intrinsic frequency at an internal I/O port of the antenna structure and the highest frequency of said frequency region of lowest frequency is preferably larger than a certain minimum ratio. Some possible minimum ratios are 1.0, 1.2, 1.4, 1.6, 1.8, 2.0, 2.2, 2.4, 2.6, 2.8 or 3.0. Setting the ratio high is advantageous because it reduces the size of the radiating element of the antenna structure, facilitating the integration of the antenna structure within the wireless handheld or portable device.

However, if said ratio is too high it may become difficult to modify the impedance of the antenna structure with the matching and tuning system to obtain an antenna system properly matched in all its frequency regions of operation. Therefore, it is preferred in some cases the ratio between the intrinsic frequency at an internal I/O port of the antenna structure and the highest frequency of the lowest frequency region be less than a certain maximum ratio. Some possible maximum ratios are 4.8, 4.4, 4.0, 3.8, 3.6, 3.4, 3.2, 3.0, 2.8, 2.6, 2.4, 2.2 or 2.0.

Furthermore, in some cases it is advantageous to set said ratio between a certain minimum value and a certain maximum value.

In some embodiments of the present invention, the antenna structure when disconnected from the matching and tuning system features at any, or every, of its internal I/O ports an input return loss curve having a frequency (hereinafter referred to as secondary frequency at a given internal I/O port), the secondary frequency at a given internal I/O port being lower than the intrinsic frequency at said given internal I/O port of the antenna structure, at which the absolute value of the slope of the curve at said secondary frequency is smaller than the absolute value of the slope of the curve at any other frequency within a non-empty neighborhood centered at said secondary frequency. Said non-empty neighborhood preferably refers to a frequency interval of a 2%, or a 1°/0, or a 0.5% of the secondary frequency at said given internal I/O port of the antenna structure, and centered at said secondary frequency.

In some examples, the secondary frequency at an internal I/O port of the antenna structure can be associated to a dimension of its ground plane layer.

In some embodiments, the ratio between the intrinsic frequency at an internal I/O port of the antenna structure and the secondary frequency at the same internal I/O port is preferably smaller than a certain maximum. Setting a low ratio between said intrinsic and secondary frequencies can be advantageous when the antenna system needs to operate in a broad frequency region. Such a choice of frequency ratio simplifies the design of the matching and tuning system.

In some other embodiments, it may be advantageous to set the ratio between the intrinsic frequency at an internal I/O port of the antenna structure and the secondary frequency at the same internal I/O port above a certain minimum. Setting a high ratio between said intrinsic and secondary frequencies can be advantageous when the antenna system needs to operate in two disjoint frequency regions. Such a choice of frequency ratio simplifies the design of the matching and tuning system.

In some other embodiments the ratio between the intrinsic frequency at an internal I/O port of the antenna structure and the secondary frequency at the same internal I/O port is preferably larger than a certain minimum but smaller than a certain maximum. Some possible minimum and maximum values for said ratio between the intrinsic and secondary frequencies are 1.0, 1.2, 1.4, 1.6, 1.8, 2.0, 2.2, 2.4, 2.6, 2.8 and 3.0.

In some examples, by adjusting a dimension of a radiating element connected to a given internal I/O port and/or a dimension of the ground plane layer, the ratio between the intrinsic and the secondary frequencies at said internal I/O port can be advantageously controlled to obtain an antenna system featuring a desired radioelectric performance in the frequency regions of operation.

In some examples a radiating element of the antenna structure comprises a single radiating arm, said arm defining a path for the currents flowing on the radiating element that excite a radiation mode of the antenna structure. Said radiation mode is associated to the intrinsic frequency at an internal I/O port of the antenna structure. In particular, the intrinsic frequency at the internal I/O port to which said radiating element is connected.

In an example, the connection point of a radiating element is located at one end of said radiating arm. Such an election of the position of the connection point is advantageous to provide a longer path to the electrical currents flowing on said radiating arm, lowering the intrinsic frequency at an internal I/O port of the antenna structure.

In another example a connection point of the ground plane layer is located substantially close to a corner of the ground plane layer. Such an election of the position of a connection point is advantageous to provide a longer path to the electrical currents flowing on the ground plane layer, lowering the secondary frequency at least one internal I/O port of the antenna structure.

A wireless handheld or portable device generally comprises one, two, three or more multilayer printed circuit boards (PCBs) on which to carry the electronics. In a preferred embodiment, the ground plane layer of the antenna structure is at least partially, or completely, contained in at least one of the layers of a multilayer PCB.

In a preferred example of the present invention, a major portion of a radiating element (such as at least a 50%, or a 60%, or a 70%, or an 80% of the surface of said radiating element) is placed on one or more planes substantially parallel to the ground plane layer. In the context of this document, two surfaces are considered to be substantially parallel if the smallest angle between a first line normal to one of the two surfaces and a second line normal to the other of the two surfaces is not larger than 45°, and preferably not larger than 30°, or 20°, or even more preferably not larger than 10°.

In some examples, said one or more planes substantially parallel to the ground plane layer and containing a major portion of a radiating element of the antenna structure are preferably at a height with respect to said ground plane layer not larger than a 2% of the wavelength corresponding to the lowest frequency of operation of the antenna system. In some cases, said height is smaller than 7 mm, preferably smaller than 5 mm, and more preferably smaller than 3 mm.

In some embodiments, at least one, two, three, or even all, radiating elements are substantially coplanar to the ground plane layer. Furthermore, in some cases at least one, two, three, or even all, radiating elements are advantageously embedded in the same PCB as the one containing the ground plane layer, which results in an antenna structure having a very low profile.

In a preferred example the antenna structure is arranged within the wireless handheld or portable device in such a manner that there is no ground plane in the orthogonal projection of a radiating element onto the plane containing the ground plane layer. In some examples there is some overlapping between the projection of a radiating element and the ground plane layer. In some embodiments less than a 10%, a 20%, a 30%, a 40%, a 50%, a 60% or even a 70% of the area of the projection of a radiating element overlaps the ground plane layer.

In some cases it is advantageous to remove ground plane from at least a portion of the projection of at least one radiating element in order to adjust the levels of impedance and to enhance the impedance bandwidth of the antenna structure. This aspect is especially important when the volume for the integration of the antenna structure has a small height, as it is the case in particular for slim wireless handheld or portable devices.

In some examples a majority of the area of the projection of a radiating element that is outside the ground plane layer is placed at a distance to an edge of the ground plane layer ranging between a minimum distance and a maximum distance. Some possible values of said minimum and maximum distances are a 0.2%, 0.4%, 0.6%, 0.8%, 1%, 2%, 3%, 4%, 5%, 6%, 7%, 8%, 10%, 12%, 14%, and 16% of the wavelength corresponding to the highest frequency of the lowest frequency region of operation of the antenna system. In this context, the term majority preferably refers to at least a 50%, or at least a 60%, or at least a 70%, or even at least an 80% of said area.

It is advantageous to separate a major portion of a radiating element from the ground plane layer in order to adjust the levels of impedance and to enhance the impedance bandwidth of the antenna structure to allow the antenna system to operate properly in all its frequency regions. As it can be seen in FIG. 6*b*, as a radiating element is moved away from an edge of the ground plane layer, the locus of the input impedance at an internal I/O port of the antenna structure becomes smaller, increasing the impedance bandwidth of the antenna structure.

The separation of the radiating element to the ground plane layer can be along a direction parallel to the plane containing the ground plane layer, or along a direction perpendicular to said plane, or along a direction resulting from a combination of a parallel direction and a perpendicular direction.

On the other hand to make the integration of the antenna structure compatible with the size of a typical wireless handheld or portable device, it is also preferred to set a maximum separation of a radiating element with respect to an edge of the ground plane layer.

In a preferred example, the majority of the area of the projection of a radiating element that is outside the ground plane layer is placed at a distance to an edge of the ground plane layer ranging between a 0.5% and a 6.5% of the wavelength corresponding to the highest frequency of the lowest frequency region of operation of the antenna system, and more preferably between a 0.5% and a 3% of said wavelength.

In some embodiments said edge is preferably a short edge of a substantially rectangular or elongated ground plane layer.

A volume within the wireless handheld or portable device is dedicated to the integration of each one of the one or several radiating elements of the antenna structure. A radiator box for a wireless handheld or portable device is defined as being the minimum-sized parallelepiped of square or rectangular faces that completely encloses said volume and wherein each one of the faces of the minimum-sized parallelepiped is tangent to at least a point of said volume. Moreover, each possible pair of faces of said minimum-size parallelepiped sharing an edge form an inner angle of 90°.

A radiator box delimits the volume within the wireless handheld or portable device dedicated to a single radiating element in the sense that, although other elements of the device (such as for instance an electronic module or subsystem) can be within said radiator box, no portion of said radiating element can extend outside said radiator box.

In those cases in which the antenna structure comprises more than one radiating element, a different radiator box is defined for each of them.

Therefore, although the volume within the wireless handheld or portable device dedicated to the integration of each radiating element will generally be irregularly shaped, a radiator box will have the shape of a right prism (i.e., a parallelepiped with square or rectangular faces and with the inner angles between two faces sharing an edge being 90°).

For the purpose of the design of a radiating element, a radiator rectangle is defined as being the orthogonal projection of a radiator box along the normal to the face with largest area of said radiator box.

In some examples, one of the dimensions of a radiator box can be substantially smaller than any of the other two dimensions, or even be close to zero. In such cases, said radiator box collapses to a practically two-dimensional entity (i.e., said radiator box becomes approximately its radiator rectangle).

A radiator rectangle has a long side and a short side. The length of said long side is referred to as the width of said radiator rectangle (W), and the length of said short side is referred to as the height of said radiator rectangle (H). The aspect ratio of a radiator rectangle is defined as the ratio between the width and the height of said radiator rectangle.

In accordance to the present invention, setting the intrinsic frequency at any, or every, of the internal I/O ports of the antenna structure outside the regions of operation of the antenna system, and preferably above the frequency region of lowest frequency of the antenna system, is advantageous to reduce the size of the radiating element or radiating elements, thus facilitating the integration of the antenna system within the wireless handheld or portable device.

In some examples, a radiating element has a radiator rectangle of reduced dimensions relative to the wavelength of the lowest frequency of operation of the antenna system. In particular, the ratio between the area of a radiator rectangle and the square of the wavelength corresponding to the lowest frequency of operation of the antenna system can advantageously be smaller than at least one of the following percentages 0.1%, 0.15%, 0.2%, 0.25%, 0.3%, 0.35%, 0.4%, 0.45%, 0.5%, 0.55% or 0.6%.

In some examples, the connection point of a radiating element is located substantially close to a corner of its radiator rectangle.

In some other examples, the smallest of the dimensions of a radiator box is at least a 0.5%, 1.0%, 1.5%, 2.0% or 2.5% of the wavelength corresponding to the lowest frequency of operation of the antenna system. A radiator box in which its smallest dimension has a size substantially different from zero may be preferred, as it allows for a radiating element having a volumetric geometry (such as for example an extruded geometry). Radiating elements having a volumetric geometric may be advantageous to enhance the radioelectric performance of the antenna structure, particularly in those cases in which the area of a radiator rectangle is too small relative to the square of the wavelength corresponding to the lowest frequency of operation of the antenna system (i.e., a too low ratio between the area of a radiator rectangle and the square of said wavelength).

Providing a radiating element with a volumetric geometry can be advantageous to reduce the other two dimensions of its radiator box, leading to a very compact solution. Therefore, in some examples in which a radiating element has a volumetric geometry, it is preferred to set a ratio between the intrinsic frequency at an internal I/O port connected to said radiating element and the highest frequency of the frequency region of lowest frequency above 1.4, or even above 1.6.

In addition to a radiator rectangle defined for each one of the one or several radiating elements of the antenna structure, a ground plane rectangle is defined as being the minimum-sized rectangle that encompasses the ground plane layer of the antenna structure. That is, the ground plane rectangle is a rectangle whose edges are tangent to at least one point of said ground plane layer.

In some examples, the connection point of the ground plane layer is located substantially close to an edge of the ground plane layer encompassed by the ground plane rectangle, preferably said edge being common with a side of the ground plane rectangle, and preferably said side being a short side of the ground plane rectangle.

An area ratio is defined as the ratio between the area of a radiator rectangle and the area of the ground plane rectangle. In some embodiments, at least some of the area ratios are smaller than 15%, preferably smaller than 10%, and more preferably smaller than 5%. In some other embodiments, particularly in which the antenna structure comprises at least two radiating elements, at least one of the area ratios is smaller than 8%, preferably smaller than 4%, and more preferably smaller than 2%.

An aspect of the invention relates to the simplicity of the geometry of the at least one radiating element of the antenna structure, which while making efficient use of the volume within the wireless handheld or portable device dedicated to said at least one radiating element, leads to enhanced radioelectric performance, increased robustness to external effects and neighboring components of the wireless device, and/or reduced interaction with the user.

According to the present invention, the geometry of a radiating element is fully described by its radiator contour.

In general, the radiator contour of a radiating element is a set of joint and/or disjoint segments comprising:

- the perimeter of one or more radiating arms placed in the radiator rectangle,
- the perimeter of closed slots and/or closed apertures defined within said radiating element,
- and/or the orthogonal projection onto the radiator rectangle of perimeters of radiating arms, or parts of radiating arms, placed in the radiator box but not in the radiator rectangle.

The radiator contour can comprise straight segments, curved segments or a combination thereof. Not all the segments that form the radiator contour need to be connected (i.e., to be joint). In some cases, the radiator contour comprises two, three, four or more disjoint subsets of segments. A subset of segments is defined by one single segment or by a plurality of connected segments. In other cases, the entire set of segments that form the radiator contour are connected together defining a single set of joint segments (i.e., the radiator contour has only one subset of segments).

Along the contour different segments can be identified e.g. by a corner between two segments, wherein the corner is given by a point on the contour where no unique tangent can be identified. At the corners the contour has an angle. The segments next to a corner may be straight or curved or one straight and the other curved. Further, segments may be separated by a point where the curvature changes from left to right or from right to left. For example, in a "sine" curve such points are given where the curve intersects the horizontal axis (i.e., x-axis, abscissa, sin(x)=0).

In particular, according to the present invention, the radiator contour of a radiating element comes into contact with each of the four (4) sides of the radiator rectangle in at least one point of each side of said radiator rectangle.

In some embodiments, the radiator contour of at least one radiating element includes not more than ten segments in order to provide enhanced radioelectric performance to the resulting antenna system.

In some examples the integration of a radiating element into the wireless handheld or portable device may be complicated by the presence of elements of the wireless device within the radiator box of said radiating element (such as for example a connector, a speaker, or a microphone). In some other examples, such integration may be complicated by the need to adjust the intrinsic frequency associated to a radiating element to a particular value. Therefore, in some embodiments the radiator contour of at least one radiating element may have more than ten segments, but preferably not more than 15, 20, or 25, to keep the geometrical complexity of the radiating elements low.

In general, the smaller the number of segments of a radiator contour and the wider the angles between connected segments, the less convoluted the geometry of a radiating element.

About Complexity Factors

The level of complexity of a radiator contour can be advantageously parameterized by means of two complexity factors, hereinafter referred to as F21 and F32, which capture the geometrical details of the radiator contour (such as for instance its edge-richness, angle-richness and/or discontinuity-richness) when looked at different levels of scale.

For the computation of F21 and F32, a first, a second, and a third grid (hereinafter called grid G1, grid G2 and grid G3 respectively) of substantially square or rectangular cells are placed on the radiator rectangle. Said three grids are adaptive to the radiator rectangle. That is, the size and aspect ratio of the cells of each one of said three grids is determined by the size and aspect ratio of the radiator rectangle. The use of adaptive grids is advantageous because it provides sufficient number of cells within the radiator rectangle to fully capture the geometrical features of the radiator contour.

Moreover, said three grids are selected to span a range of levels of scale corresponding to two octaves: A side of a cell of grid G2 is half the size of a side of a cell of grid G1 (i.e., a ½ scaling factor or an octave of scale); a side of a cell of grid G3 is half the size of a side of a cell of grid G2, or one fourth the size of a side of a cell of grid G1 (i.e., a ¼ scaling factor or two octaves of scale). A range of scales of two octaves provides a sufficient variation in the size of the cells across the three grids as to capture gradually from the coarser features of the radiator contour to the finer ones.

Grids G1 and G3 are constructed from grid G2, which needs to be defined in the first place.

As far as the second grid (or grid G2) is concerned, the size of a cell and its aspect ratio (i.e., the ratio between the width and the height of the cell) are chosen so that the radiator rectangle is perfectly tessellated with an odd number of columns and an odd number of rows.

In the present document, columns of cells are associated to the long side of a radiator rectangle, while rows of cells are associated to a short side of said radiator rectangle. In other words, a long side of the radiator rectangle spans a number of columns, being said columns parallel to the short side of the radiator rectangle. In the same way a short side of the radiator rectangle spans a number of rows, being said rows parallel to the long side of the radiator rectangle.

If the radiator rectangle is tessellated with an excessive number of columns, then the size of the resulting cells is much smaller than the range of typical sizes of the features necessary to shape the radiator contour. However, if the radiator rectangle is tessellated with an insufficient number of columns, then the size of the resulting cells is much larger than the range of typical sizes of the features necessary to shape said radiator contour. It has been found that setting to nine (9) the number of columns that tessellate the radiator rectangle provides an advantageous compromise, for the preferred sizes of a wireless handheld or portable device, and the corresponding available volumes for the antenna structure, according to the present invention. Therefore, a cell width (W2) is selected to be equal to a ninth (1/9) of the length of the long side of the radiator rectangle (W).

Moreover, it is also advantageous to use cells that have an aspect ratio closest to one. In other words, the number of columns and rows of cells of the second grid that tessellate the radiator rectangle are selected to produce a cell as square as possible. A grid formed by cells having an aspect ratio close to one is preferred in order to perceive features of the radiator contour using approximately a same level of scale along two orthogonal directions defined by the long side and the short side of the radiator rectangle. Therefore, preferably, the cell height (H2) is obtained by dividing the length of the short side of the radiator rectangle (H) by the odd integer number larger than one (1) and smaller than, or equal to, nine (9), that results in an aspect ratio W2/H2 closest to one.

In the particular case that two different combinations of a number of columns and rows of cells of the second grid produce a cell as square as possible, a second grid is selected such that the aspect ratio is larger than 1.

In some examples, a radiator contour may comprise a portion (such as for instance a part of an arm) in which the separation between two non-adjacent edges is smaller than the cell width W2. In those examples, said portion of the radiator contour does not substantially distinguish from a zero-width line, and the segments of the radiator contour associated to said portion should be replaced by a line placed at the middle distance from the two non-adjacent edges (i.e., each point of said line is placed at equal distance from a point of each of the two non-adjacent edges). As a consequence of this modification, the radiator contour may, in some cases, require the resizing of the radiator rectangle and/or the recalculation of the grids.

Thus, the radiator rectangle is tessellated perfectly with 9 by (2n+1) cells of grid G2, wherein n is an integer larger than zero (0) and smaller than five (5). A first grid (or grid G1) is obtained by combining four (4) cells of the grid G2. Each cell of the grid G1 consists of a 2-by-2 arrangement of cells of grid G2. Therefore, a cell of the grid G1 has a cell width equal to twice (2) the width of a cell of the second grid (W2) (i.e., W1=2×W2); and a cell height (H1) equal to twice (2) the height of a cell of the second grid (H2) (i.e., H1=2×H2).

Since grid G2 tessellates perfectly the radiator rectangle with an odd number of columns and an odd number of rows, an additional row and an additional column of cells of said grid G2 are necessary to have enough cells of the grid G1 as to completely cover the radiator rectangle.

In order to define uniquely the tessellation of the radiator rectangle with grid G1 a corner of said radiator rectangle is selected to start placing the cells of said grid G1.

A feeding point corner is defined as being the corner of the radiator rectangle closest to a connection point of the radiating element used for feeding purposes and responsible for the operation of the radiating element in its lowest frequency region. In case that said connection point is placed at an equal distance from more than one corner of the radiator box, then the corner closest to a perimeter of the ground plane layer of the antenna structure is selected, preferably the corner closest to a shorter edge of the ground plane rectangle. In case both corners are placed at the same distance from said connection point and from the shorter edge of the ground plane rectangle, the feeding point corner will be chosen, then owing to ergonomics reasons and taking into account the absorption of radiation in the hand of the user of a wireless handheld or portable device, and considering that there is a predominance on right-handed users, it has been observed that in some embodiments it is convenient to place a connection point for feeding purposes and/or to designate the feeding point corner on the corner of the radiator rectangle which is closer to a left corner of the ground plane rectangle, being the left side of said ground plane rectangle the closest to the left side of the wireless handheld or portable device as seen by a right-handed user holding typically said device with her right hand to originate a phone call, while facing a display of said device. Also, the selection of the feeding point corner on the top or bottom corner on the left side of the wireless handheld or portable device depends on the position of the radiating element with respect to a body of the wireless handheld or portable device: An upper-left corner of the radiator rectangle is preferred in those cases in which said radiating element is placed substantially near the top part of said body of the wireless handheld or portable device (usually, above and/or behind a display); and a lower-left corner of the radiator rectangle is preferred in those cases in which said radiating element is placed substantially near the bottom part of said body of the wireless handheld or portable device (usually, below and/or behind a keypad). Again, due to ergonomics reasons, a top and a bottom part of a body of a wireless handheld or portable device are defined as seen by a right-handed user holding typically said device with her right hand to originate a phone call, while facing a display 901 as seen in FIGS. 9*a* and 9*b*.

A first cell of the grid G1 is then created by grouping four (4) cells of grid G2 in such a manner that:

- a corner of said first cell is the feeding point corner,
- and said first cell is positioned completely inside the antenna rectangle.

Once the first cell of the grid G1 is placed, other cells of said grid G1 can be placed defining uniquely the relative position of said grid G1 with respect to the radiator rectangle. The radiator rectangle spans 5 by (n+1) cells of the grid G1, (when G2 includes 9 columns) requiring the additional row and the additional column of cells of the grid G2 that meet at the corner of the radiator rectangle that is opposite to the feeding point corner, and that are not included in the radiator rectangle.

The complexity factor F21 is computed by counting the number of cells N1 of the grid G1 that are at least partially inside the radiator rectangle and include at least a point of the radiator contour (in the present invention the boundary of the cell is also part of the cell), and the number of cells N2 of the grid G2 that are completely inside the radiator rectangle and include at least a point of the radiator contour, and applying then the following formula:

$$F_{21} = -\frac{\log(N_2) - \log(N_1)}{\log(1/2)}$$

Figure 12A:
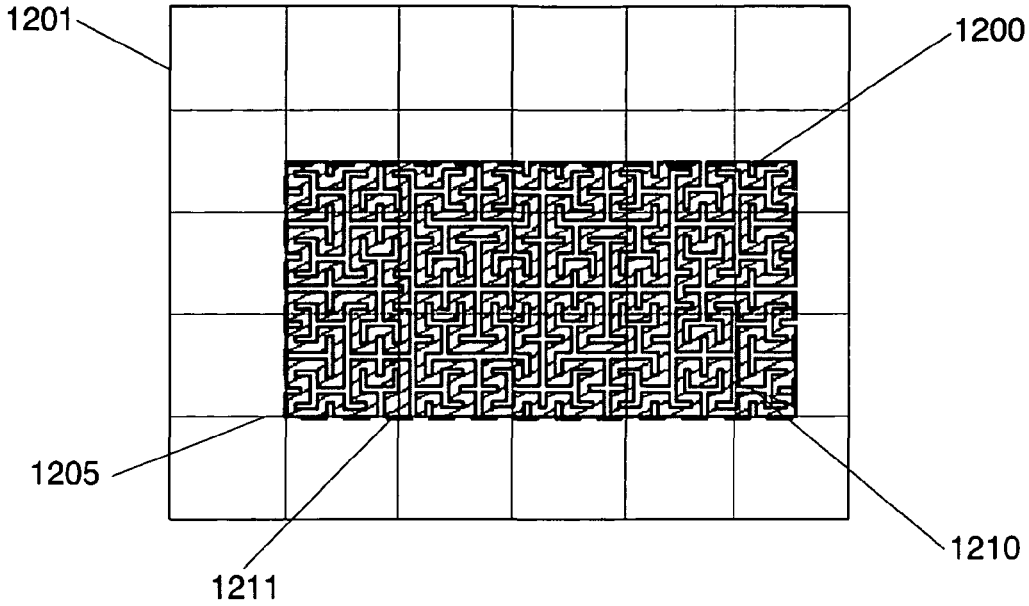

Complexity factor F21 is predominantly aimed at capturing the complexity and degree of convolution of features of the radiator contour that appear when said contour is looked at coarser levels of scale. As it is illustrated in the example of FIG. 12, the election of grid G1 and grid G2, and the fact that with grid G2 the radiator rectangle is perfectly tessellated by an odd number of columns and an odd number of rows, results in a value of the factor F21 equal to one for a radiator contour shaped as the radiator rectangle. On the other hand, a radiator contour whose shape is inspired in a Hilbert curve that fills the radiator rectangle features a value of the factor F21 smaller than two. Therefore the factor F21 is geared more towards assessing an overall complexity of a radiator contour (i.e., whether the degree of convolution of a radiator contour distinguishes sufficiently from a simple rectangular shape when looked at from a zoomed-out view), rather than estimating if the full complexity of a radiator contour (i.e., the complexity of the radiator contour when looked at from a zoomed-in view) approaches that of a highly-convoluted curve such as the Hilbert curve.

Moreover, in some embodiments the factor F21 is related to the number of paths that the geometry of the radiating element provides to electric currents and/or the equivalent magnetic currents to excite radiation modes (i.e., factor F21 tends to increase with the number of geometrical portions within the radiating element). In general, the more frequency regions and/or radiation modes that need to be supported by a radiating element of an antenna structure, the higher the value of the factor F21 that needs to be attained by the radiator contour of said radiating element.

A third grid (or grid G3) is readily obtained by subdividing each cell of grid G2 into four cells, having each of said cells a cell width (W3) equal to one half (½) of the width of a cell of the second grid (W2) (i.e., W3=½×W2); and a cell height (H3) equal to one half (½) of the height of a cell of the second grid (H2) (i.e., H3=½×H2).

Therefore, since each cell of the grid G2 is replaced with 2-by-2 cells of the grid G3, then 18 by (4n+2) cells of grid G3 are thus required to tessellate completely the radiator rectangle.

The complexity factor F32 is computed by counting the number of cells N2 of grid G2 that are completely inside the radiator rectangle and include at least a point of the radiator contour, and the number of cells N3 of the grid G3 that are completely inside the radiator rectangle and include at least a point of the radiator contour, and applying then the following formula:

$$F_{32} = -\frac{\log(N_3) - \log(N_2)}{\log(1/2)}$$

Complexity factor F32 is predominantly directed at capturing the complexity and degree of convolution of features of the radiator contour that appear when said contour is looked at finer levels of scale. As it is illustrated in the example of FIG. 12, the election of grid G2 and grid G3 is such that a radiator contour whose shape is inspired in a Hilbert curve that fills the radiator rectangle features a value of the factor F32 equal to two. On the other hand, a radiator contour shaped as the radiator rectangle features a value of the factor F32 larger than one. Therefore the factor F32 is geared more towards evaluating the full complexity of a radiator contour (i.e., whether the degree of convolution of a radiator contour tends to approach that of a highly-convoluted curve such as the Hilbert curve), rather than discerning if said radiator contour is substantially different from a rectangular shape.

Moreover, the factor F32 is in some embodiments related to the degree of miniaturization achieved by a radiating element.

The complexity factors F21 and F32 span a two-dimensional space on which the radiator contour of a radiating element of a wireless handheld or portable device is mapped as a single point with coordinates (F21, F32). Such a mapping can be advantageously used to guide the design of said radiating element by tailoring the degree of convolution of its radiator contour until some preferred values of the factors F21 and F32 are attained, so that the resulting radiating element: provides the required number of frequency regions in which a wireless handheld or portable device operates; meets device size and/or integration constraints; and/or enhances the radioelectric performance of the antenna system and/or that of the wireless handheld or portable device in at least one of the frequency regions of operation.

In a preferred embodiment, the antenna structure of a wireless handheld or portable device comprises at least one, two, three radiating elements, or even all its radiating elements featuring each a radiator contour with a complexity factor F21 smaller than or equal to 1.2 and a complexity factor F32 smaller than or equal to 1.2.

In some examples the radiator contour of at least one, two, three or more radiating elements of an antenna structure features each a complexity factor F32 larger than a certain minimum value in order to achieve some degree of miniaturization.

A radiator contour with a complexity factor F32 high, despite achieving substantial size reduction, may not be preferred for a wireless handheld or portable device of the present invention as the radiating element defining said radiator contour is likely to have reduced capability to operate in multiple frequency regions and/or limited radioelectric performance when connected to a matching and tuning circuit. Therefore in some examples of embodiments of the present invention the radiator contour of at least one, two, three or more radiating elements of an antenna structure features each a complexity factor F32 smaller than a certain maximum value in order to achieve enhanced radioelectric performance.

In some cases of embodiments of the present invention the radiator contour of at least one, two, three or more radiating elements of an antenna structure features each a complexity factor F32 larger than said minimum value but smaller than said maximum value.

Said minimum and maximum values for the complexity factor F32 can be selected from the list of values comprising: 1.00, 1.05, 1.10, 1.15, 1.20, 1.25, 1.30, 1.35, 1.40, 1.45, and 1.50.

Similarly, in some examples a radiator contour of at least one, two, three or more radiating elements advantageously features each a complexity factor F21 larger than a lower bound and/or smaller than an upper bound. Said lower and upper bounds for the complexity factor F21 can be selected from the list comprising: 0.90, 0.95, 1.00, 1.05, 1.10, 1.15, 1.20, 1.25, 1.30, 1.35, 1.40, 1.45, and 1.50.

In some embodiments, a rather large complexity factor F32 combined with a small complexity factor for F21 is desired. This might be convenient, for instance, when operation of the antenna system is desired at high frequencies, such as for instance, frequencies higher than any of the values comprising: 1710 MHz, 1850 MHz, 1920 MHz or 2400 MHz. In those cases, a F21 factor below a number selected from the range: 0.90, 0.95, 1.00, 1.05, 1.10, 1.15, 1.20, 1.25, 1.30, 1.35, 1.40, 1.45, and 1.50 and a F32 factor higher than a number selected from the range: 1.30, 1.45, 1.50, 1.55, 1.60, 1.65, 1.70 might be preferred.

The complexity factors F21 and F32 have turned out to be relevant parameters that allow for an effective antenna structure design. Evaluation of those parameters gives good hints on possible changes of the radiating elements in order to obtain improved antenna systems.

In some cases the parameters F21 and F32 allow for easy identification of unsuitable radiating elements. Further those parameters may be used in numerical optimization algorithms as target values or to define target intervals in order to speed up such algorithms.

In some embodiments, the matching and tuning system comprises a matching network that transforms the input impedance of the antenna structure, providing impedance matching to the antenna system in the first and second frequency regions of operation of the antenna system.

Said matching network can comprise a single stage or a plurality of stages. In some examples, the matching network comprises at least two, at least three, at least four, at least five, at least six, at least seven, at least eight or more stages.

A stage comprises one or more circuit components (such as for example but not limited to inductors, capacitors, resistors, jumpers, short-circuits, switches, or other reactive or resistive components). In some cases, a stage has a substantially inductive behavior in the frequency regions of operation of the antenna system, while another stage has a substantially capacitive behavior in said frequency regions, and yet a third one may have a substantially resistive behavior in said frequency regions.

A stage can be connected in series or in parallel to other stages and/or to at least some of the I/O ports of the matching and tuning system.

In some examples, the matching network alternates stages connected in series with stages connected in parallel (i.e., shunted), forming a ladder structure. In some cases, a matching network comprising two stages forms an L-shaped structure (i.e., series-parallel or parallel-series). In some other cases, a matching network comprising three stages forms either a pi-shaped structure (i.e., parallel-series-parallel) or a T-shaped structure (i.e., series-parallel-series).

In some examples, the matching network alternates stages having a substantially inductive behavior, with stages having a substantially capacitive behavior.

In an example, a stage may substantially behave as a resonant circuit (such as, for instance, a parallel LC resonant circuit or a series LC resonant circuit) in at least one frequency region of operation of the antenna system. The use of stages having a resonant circuit behavior allows one part of the matching network be effectively connected to another part of said matching network in a given frequency region, and be effectively disabled in another frequency region.

In an example, the matching network comprises at least one active circuit component (such as for instance, but not limited to, a transistor, a diode, a MEMS device, a relay, or an amplifier) in at least one stage.

In a preferred example, the matching network comprises a first stage and a second stage forming an L-shaped structure, with said first stage being connected in series and said second stage being connected in parallel. Said first stage is connected to an I/O port of the matching and tuning system, said I/O port being connected to an internal I/O port of the antenna structure of an antenna system. Said first stage has a substantially inductive behavior in the frequency regions of operation of the antenna system. Said second stage is connected to said first stage, and substantially behaves as a resonant circuit (preferably as a parallel LC resonant circuit) in at least one frequency region of operation of the antenna system.

In some examples, at least some circuit components in the stages of the matching network are discrete lumped components (such as for instance SMT components), while in some other examples all the circuit components of the matching network are discrete lumped components. In some examples, at least some circuit components in the stages of the matching network are distributed components (such as for instance a transmission line printed or embedded in a PCB containing the ground plane layer of the antenna structure), while in some other examples all the circuit components of the matching network are distributed components.

In some embodiments, the matching and tuning system comprises a diplexer or a bank of filters to separate the electrical signals of the different frequency regions of operation of the antenna system.

In an example, the matching and tuning system comprises a first diplexer to separate the electrical signals of the first and second frequency regions of operation of the antenna system, a first matching network to provide impedance matching in said first frequency band, a second matching network to provide impedance matching in said second frequency band, and a second diplexer to recombine the electrical signals of said first and second frequency regions.

Alternatively, a diplexer can be replaced by a bank of band-pass filters and a combiner/splitter. Also, a diplexer and a bank of band-pass filters may be used in the matching and tuning system. Preferably, there are as many band-pass filters in the bank of band-pass filters as there are frequency regions of operation of the antenna system, and each one of the band-pass filters is designed to present low insertion loss in a different frequency region and high impedance in the others. The combiner/splitter combines (or splits) the electrical signals of the different frequency regions of operation of the antenna system.

In the context of this document high impedance in a given frequency region preferably refers to impedance having a modulus not smaller than 150 Ohms, 200 Ohms, 300 Ohms, 500 Ohms or even 1000 Ohms for any frequency within said frequency region, and more preferably being substantially reactive (i.e., having a real part substantially close to zero) within said given frequency region.

In some embodiments the antenna structure comprises a plastic or dielectric carrier (such as for instance made of Poly Carbonate, Liquid Crystal Polymer, Poly Oxide Methylene, PC-ABS, or PVC) that provides mechanical support to at least one radiating element of said antenna structure. In other cases, at least one radiating element is affixed to a plastic cover of the wireless handheld or portable device.

In some embodiments, the antenna structure comprises a slab of dielectric material placed in the proximity of a radiating element (such as for example above or below a radiating element). Said dielectric slab loads said radiating element, resulting in a lowering of an intrinsic frequency of the antenna structure.

In some examples the orthogonal projection of the dielectric slab onto the plane containing the ground plane layer overlaps at least partially the orthogonal projection of said radiating element onto said same plane. Such overlapping can be more than 30%, 50%, or 70%, or even equal to approximately 100% of the area of the orthogonal projection of said radiating element.

The dielectric slab can be advantageously used to tune an intrinsic frequency of the antenna structure until a target ratio between said intrinsic frequency and the highest frequency of the lowest frequency region of operation of the antenna system is obtained, without requiring an increase in the dimensions of said radiating element.

The radioelectric performance of the antenna structure, and that of the resulting antenna system, can be adjusted by setting the appropriate degree of overlapping between the projections of said radiating element and the dielectric slab, without having to modify the shape or dimensions of said radiating element.

Thus, the present invention provides a highly-standardized antenna system solution for wireless handheld or portable devices, since a same radiating element can be used across many different devices. To provide the frequency regions of operation, an antenna designer needs only to adjust the matching and tuning system, and/or possibly the placement of a dielectric slab with respect to a given radiating element of the antenna structure.

The present invention can be applied to antenna structures with different antenna topologies, preferably unbalanced antenna topologies. In particular, monopoles, folded and/or loaded monopoles, and their slot or aperture equivalents (slot monopoles, folded and/or loaded slot monopoles) are some of the topologies in which the present invention can be applied. Other antenna topologies include shorted and bent monopoles (L-shaped monopoles, inverted-F antennas or IFA), and again their aperture equivalents. Another possible antenna configuration is a microstrip or patch antenna, including their shorted versions (shorted patches and PIFAs). All of these antenna topologies could be used in the antenna structure for an antenna system according to the present invention.

LIST OF FIGURES

Embodiments of the invention are shown in the enclosed figures. Herein shows:

FIG. 1—Block diagrams of three examples of antenna systems according to the present invention.

FIG. 2—Example of an antenna structure for an antenna system, the antenna structure including a radiating element and a ground plane layer: (a) Perspective view; and (b) top plan view.

FIG. 3—Typical radioelectric performance at the internal I/O port of the antenna structure of FIG. 2 when disconnected from a matching and tuning system: (a) Input return loss, (b) input impedance, and (c) radiating efficiency.

Figure 4:
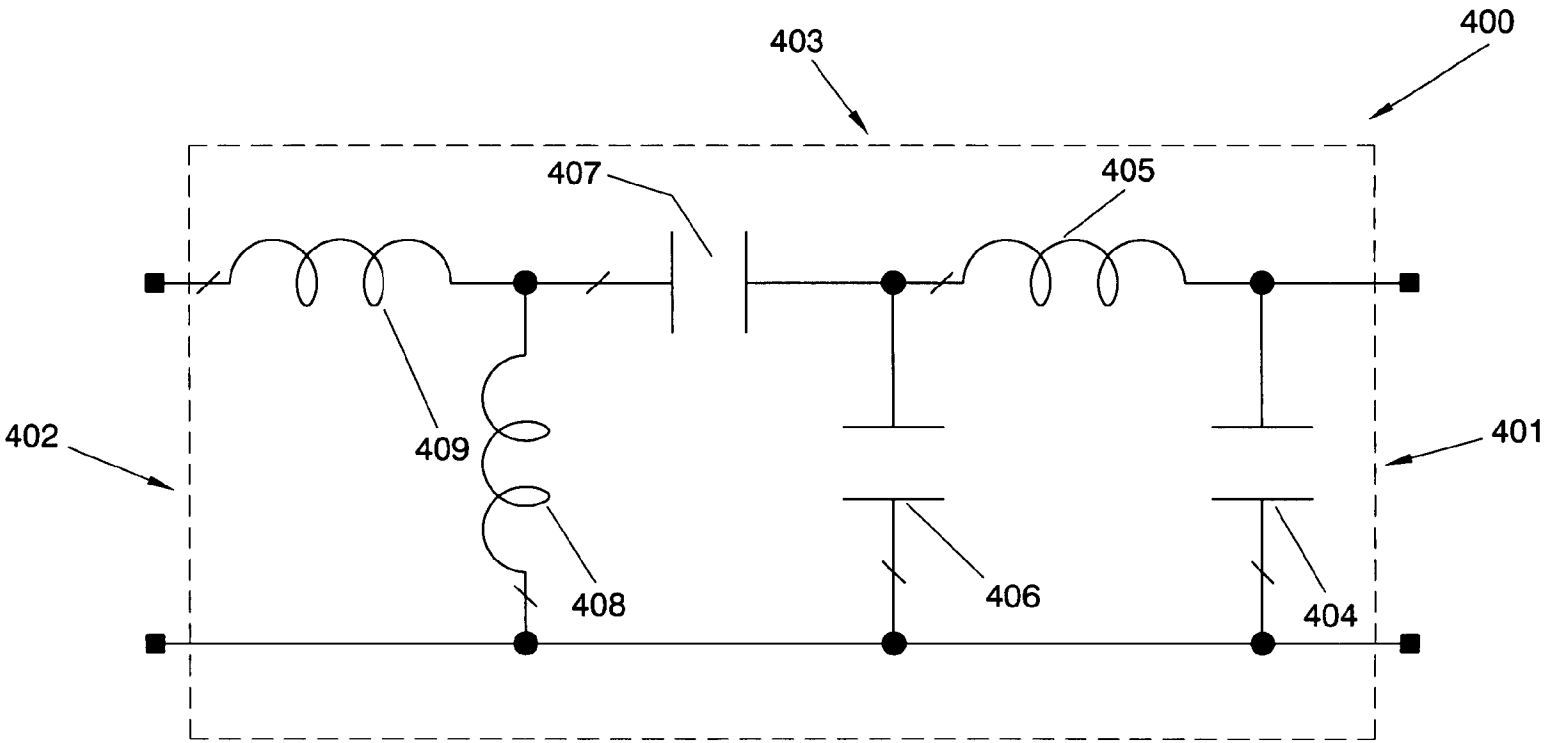

FIG. 4—Schematic of the matching and tuning system of the antenna system whose antenna structure is shown in FIG. 2.

Figure 5:
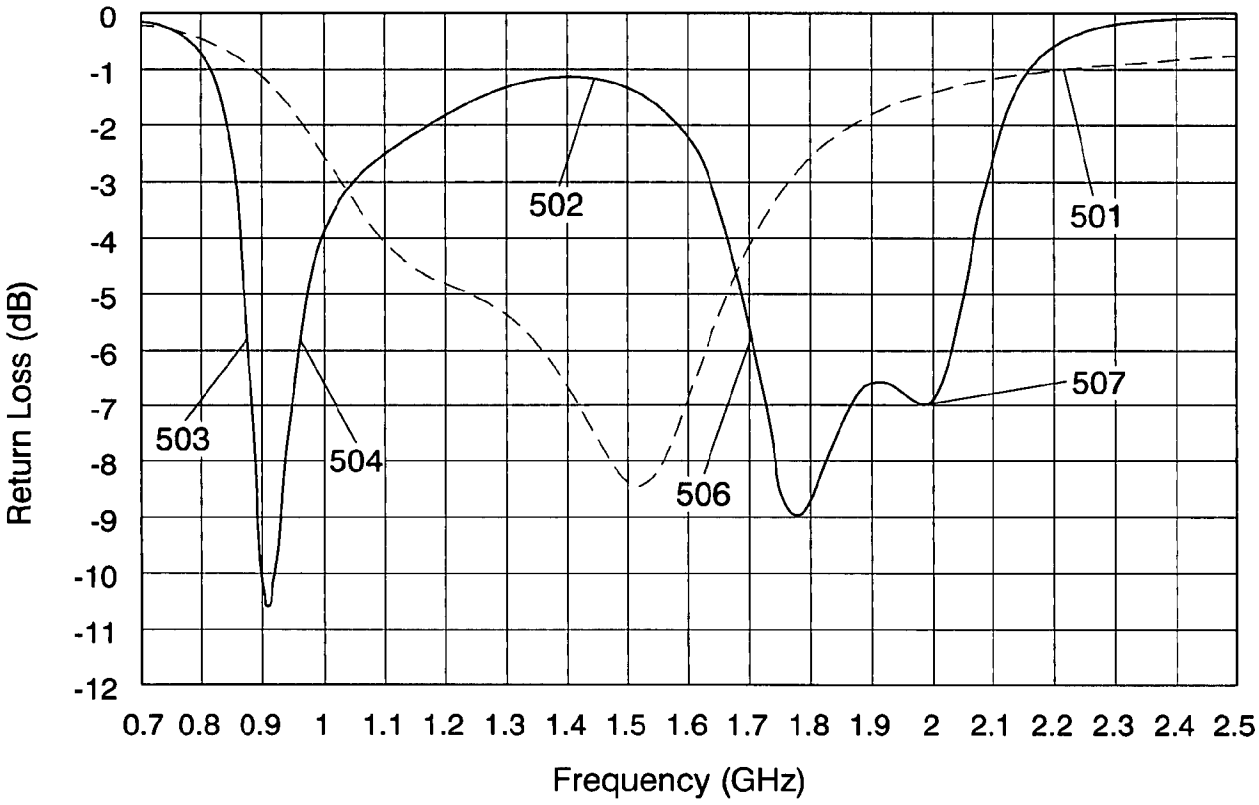

FIG. 5—Comparison of the typical input return loss at the internal I/O port of the antenna structure of FIG. 2, and at the external I/O port of the antenna system after connecting the matching and tuning system of FIG. 4 to the antenna structure of FIG. 2.

FIG. 6—Radioelectric performance at the internal I/O port of the antenna structure when disconnected from a matching and tuning system as the distance of the radiating element to an edge of the ground plane layer is varied: (a) Input return loss, and (b) input impedance.

Figure 7:
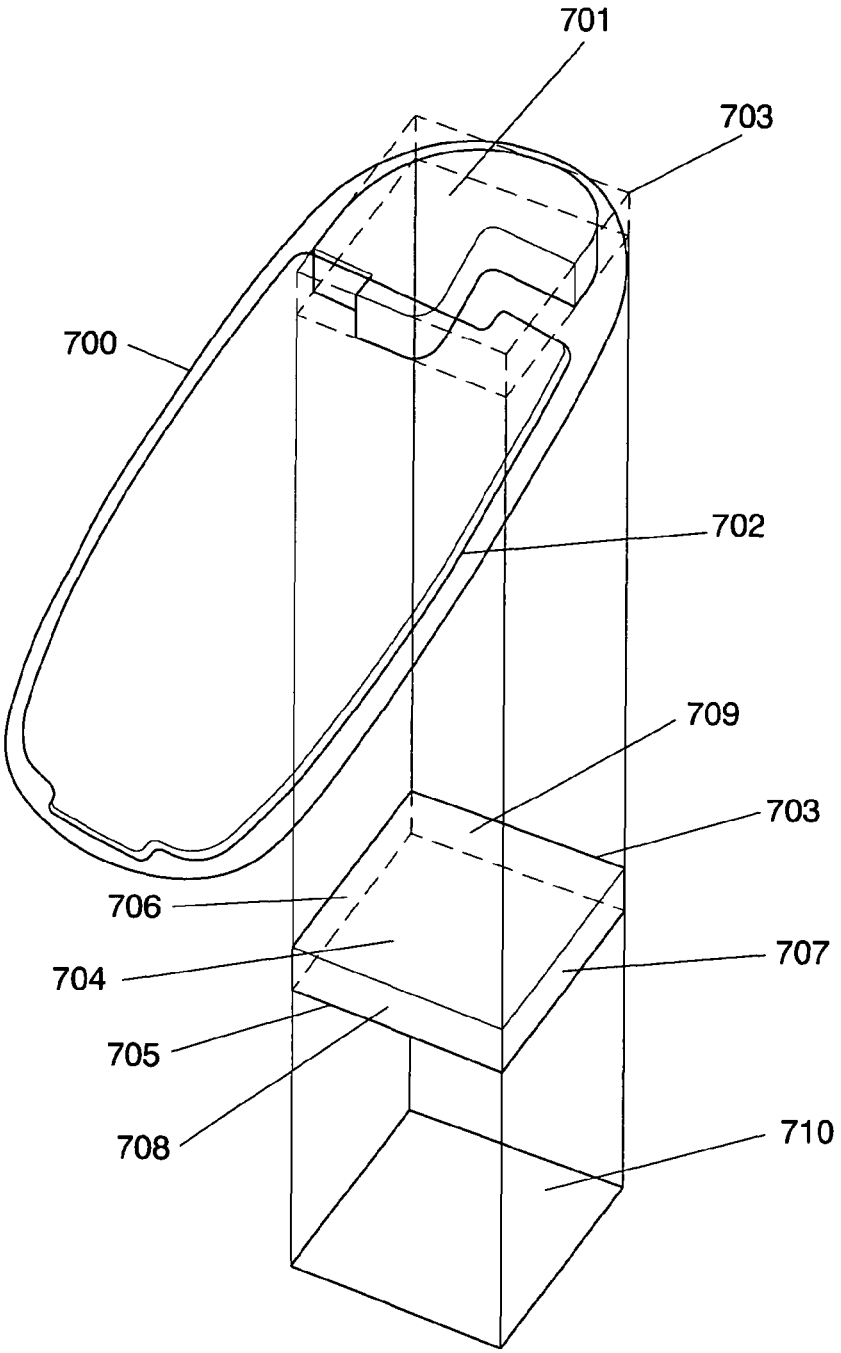

FIG. 7—Perspective view of a wireless handheld or portable device including a space for the integration of a radiating element, and its corresponding radiator box; and radiator rectangle.

Figure 8:
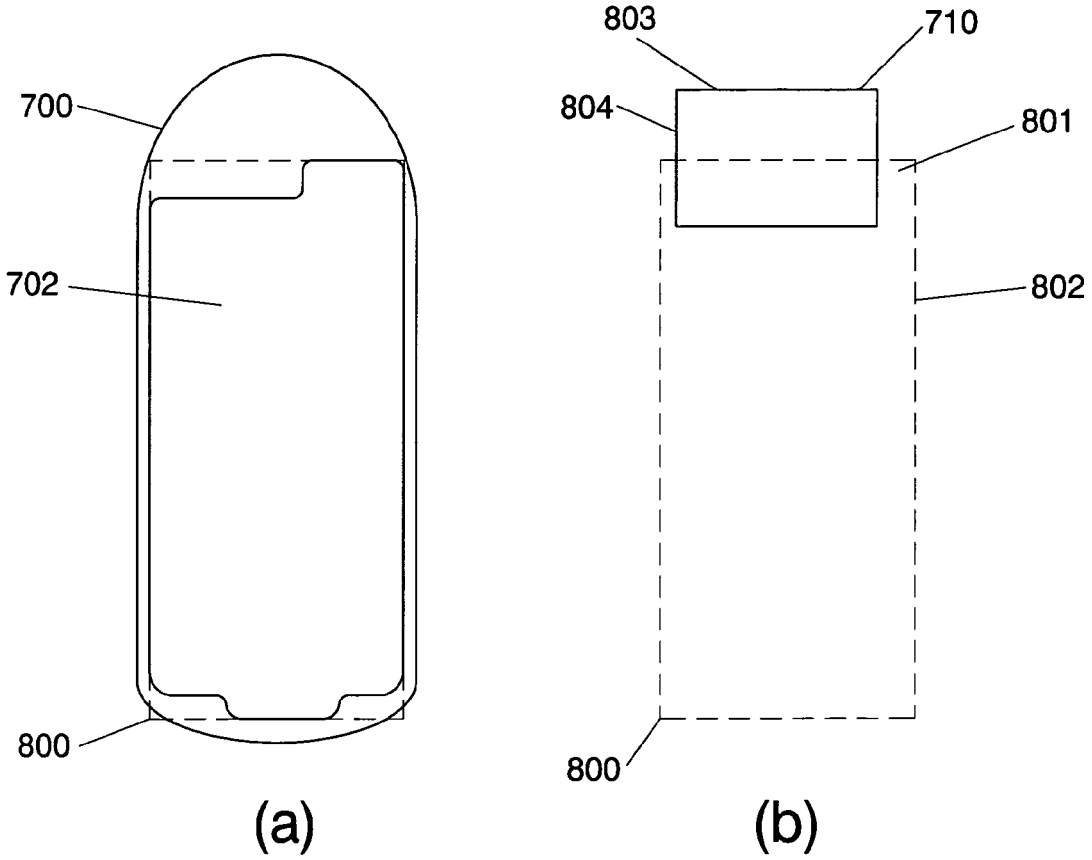

FIG. 8—(a) Example of a wireless handheld or portable device comprising a ground plane layer included in a PCB, and its corresponding ground plane rectangle; (b) ground plane rectangle of said wireless handheld or portable device in combination with a radiator rectangle for a radiating element.

Figure 9:
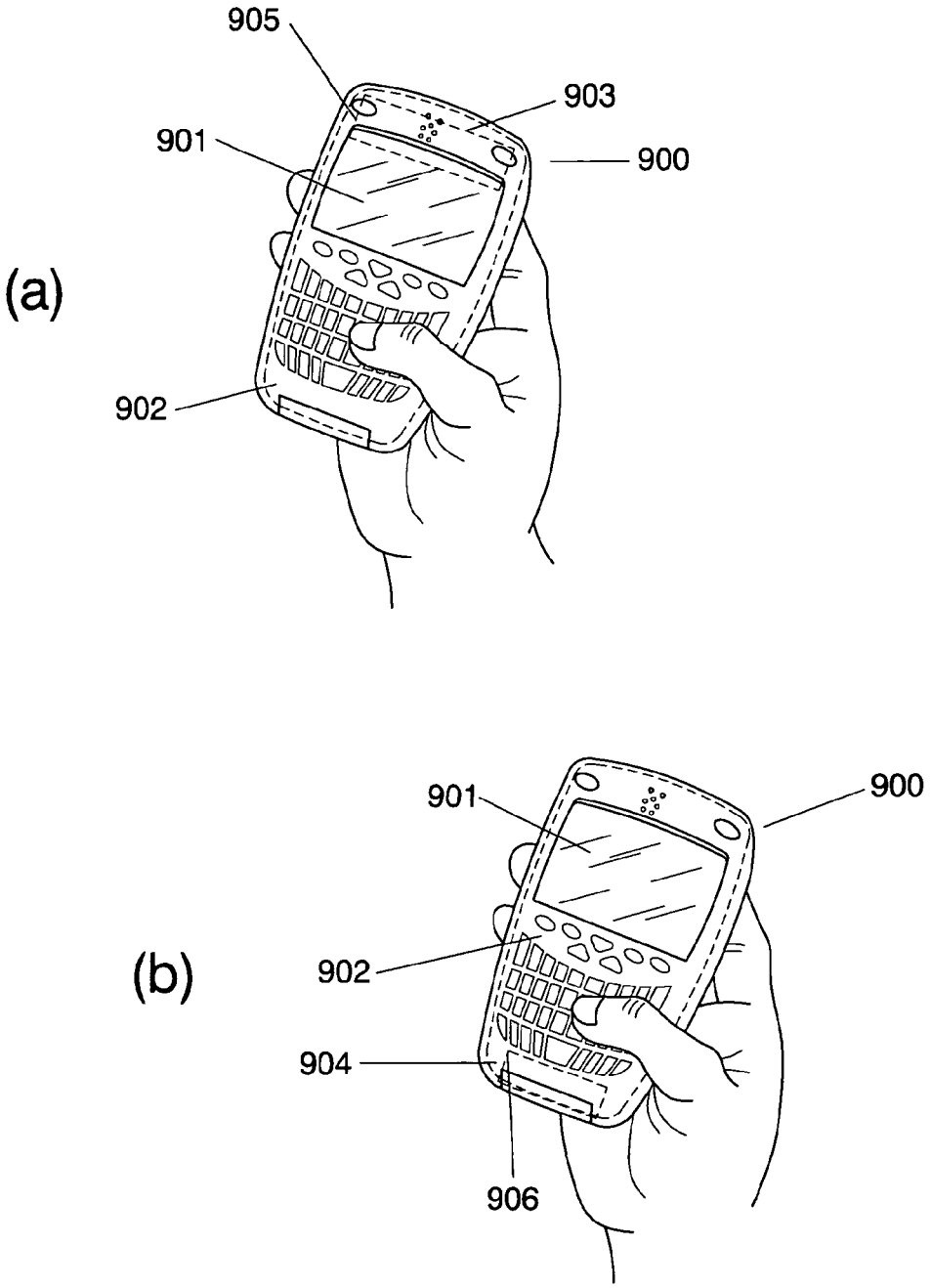

FIG. 9—An example of wireless handheld or portable device being held typically by a right-handed user to originate a phone call, and how the feeding point corner of a radiator rectangle of said device may be selected.

FIG. 10—Example of (a) a first grid, (b) a second grid, and (c) a third grid to compute the complexity factors of a radiator contour.

Figure 11:
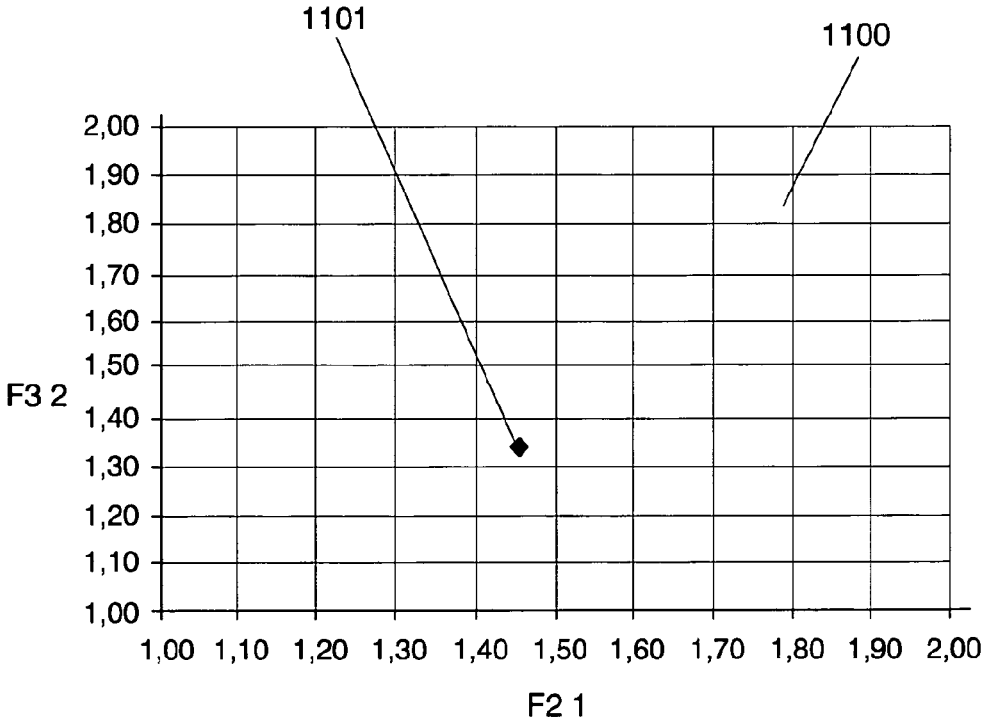

FIG. 11—Two-dimensional representation of the F32 vs. F21 space.

FIG. 12—Example of a radiator contour inspired in a Hilbert curve under (a) a first grid, (b) a second grid, and (c) a third grid to compute the complexity factors of said radiator contour.

FIG. 13—Computation of the complexity factors of the radiator contour of the radiating element of FIG. 2: (a) Original radiator contour under a second grid; and modified radiator contour under (b) a first grid, (c) a second grid, and (d) a third grid.

Figure 14:
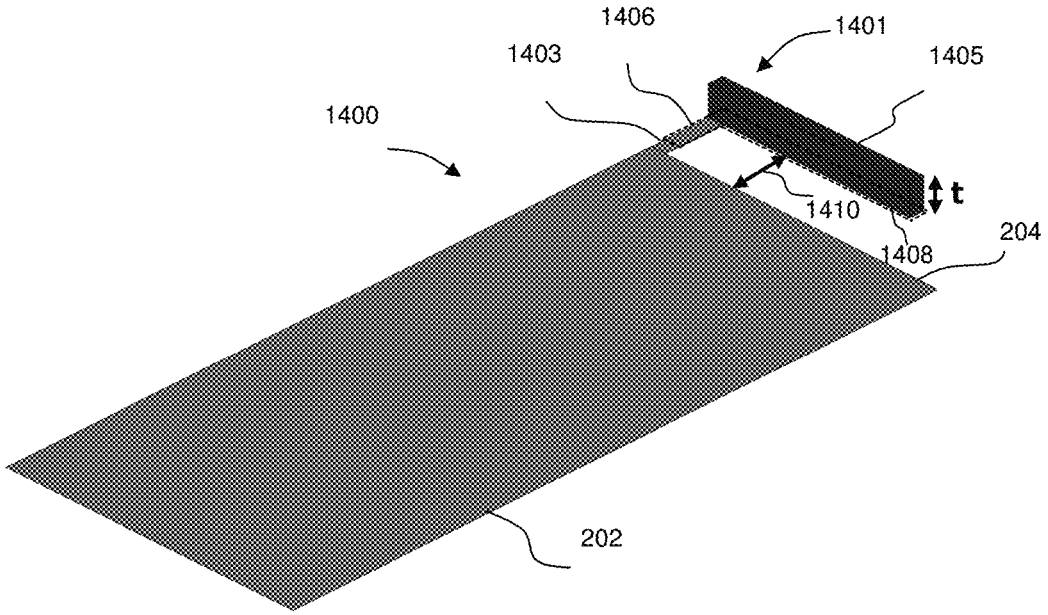

FIG. 14—Perspective view of an example of an antenna structure for an antenna system, the antenna structure including a radiating element having a volumetric geometry.

Figure 15:
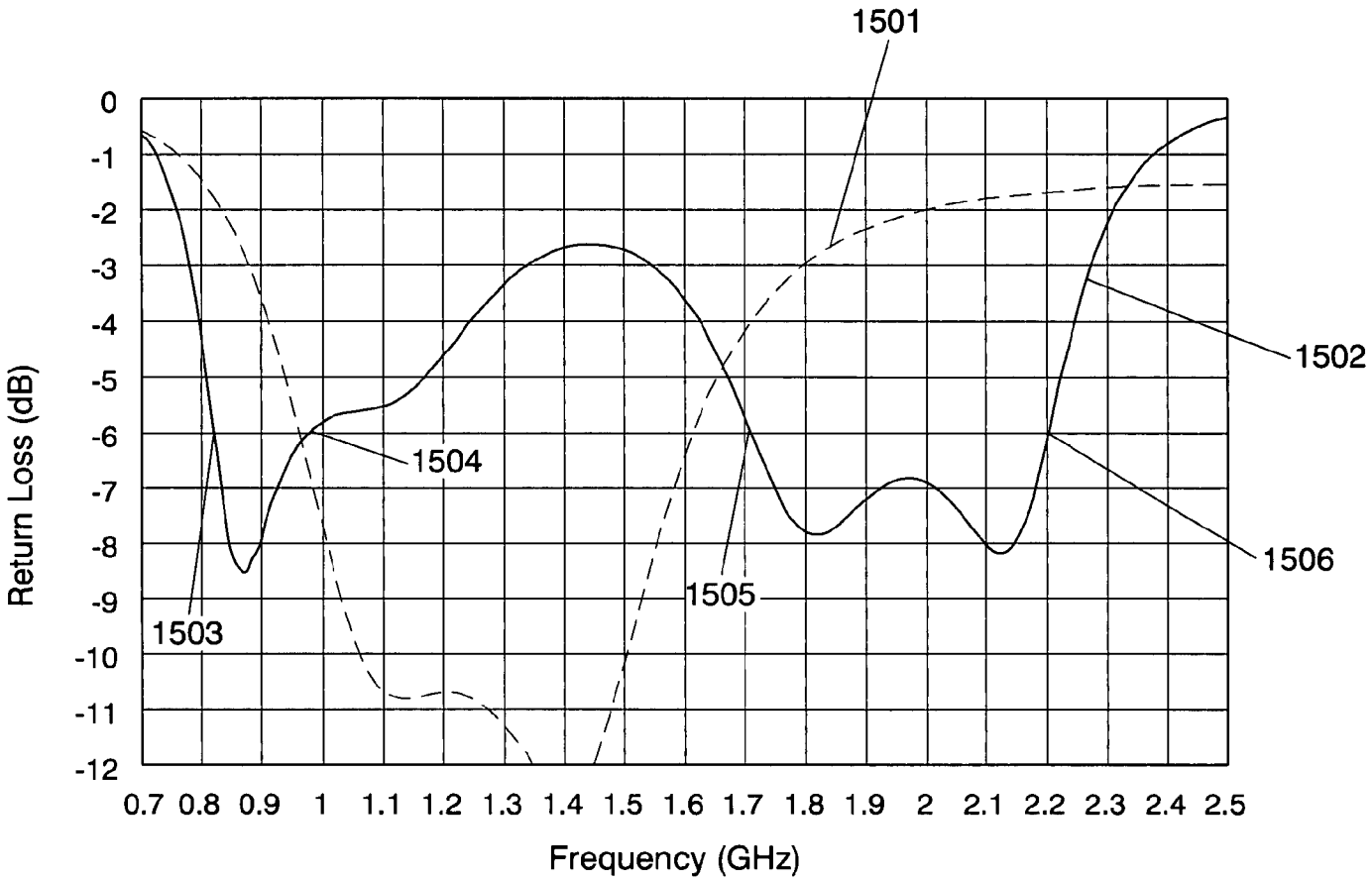

FIG. 15—Comparison of the typical input return loss at the internal I/O port of the antenna structure of FIG. 14, and at the external I/O port of the antenna system after connecting a matching and tuning system to the antenna structure of FIG. 14.

Figure 16:
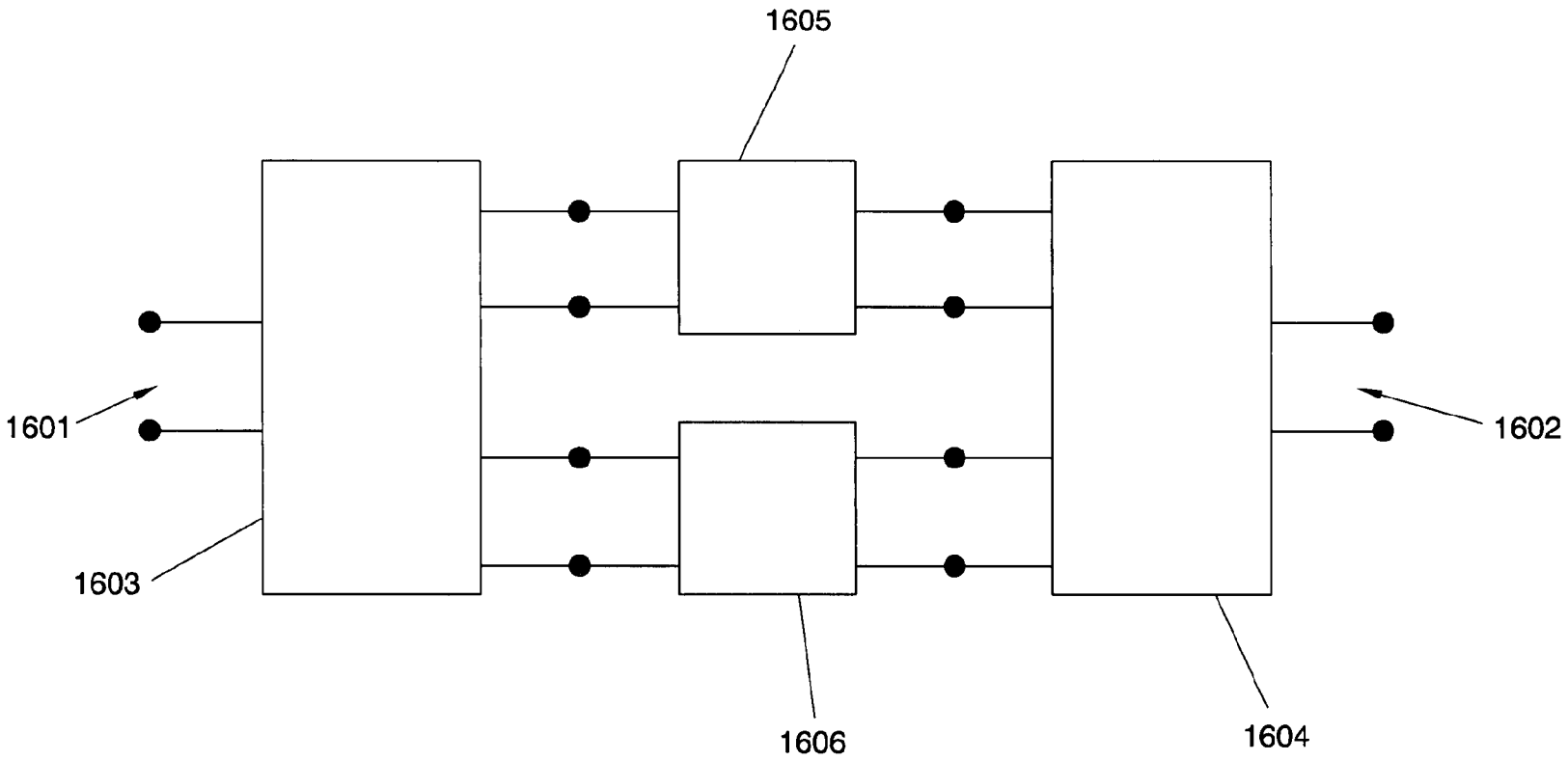

FIG. 16—Schematic of an example matching and tuning system for an antenna system comprising diplexers.

Figure 17A:
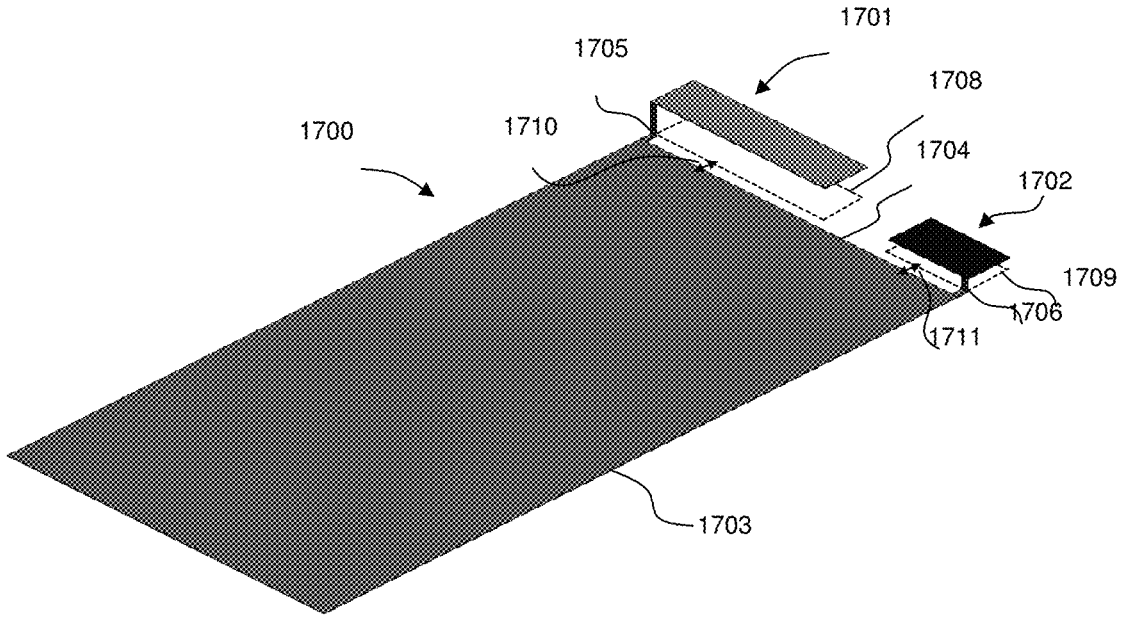
Figure 17B:
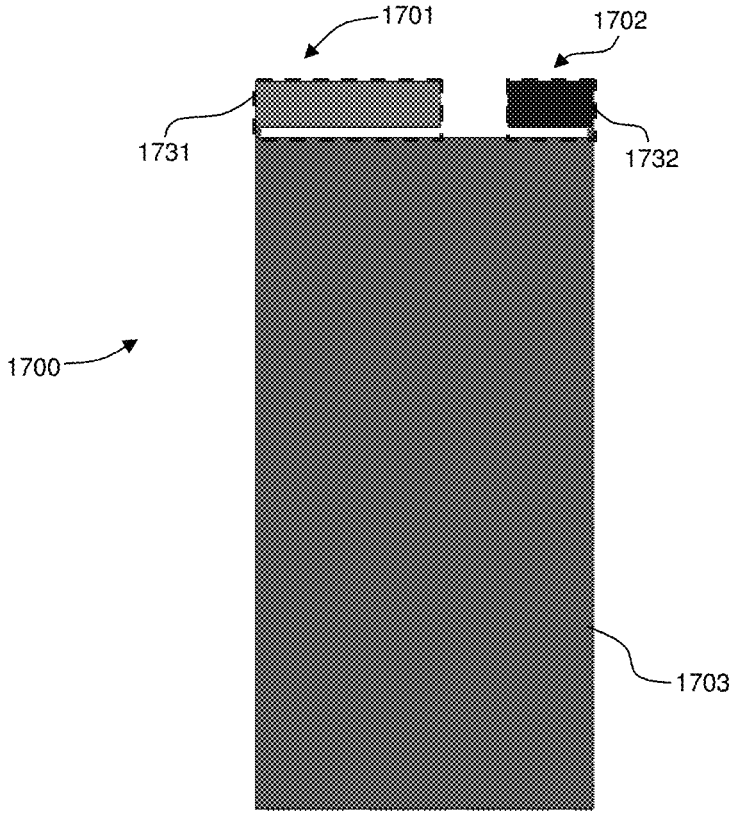

FIG. 17—Example of an antenna structure for an antenna system, the antenna structure including two radiating elements and a ground plane layer: (a) Perspective view; and (b) top plan view.

FIG. 18—(a) Input return losses at each one of the two internal I/O ports of the antenna structure of FIG. 17 when disconnected from a matching and tuning system; (b) Input return losses at the external I/O port of the antenna system having the antenna structure of FIG. 17 and the matching and tuning system of FIG. 19.

Figure 19:
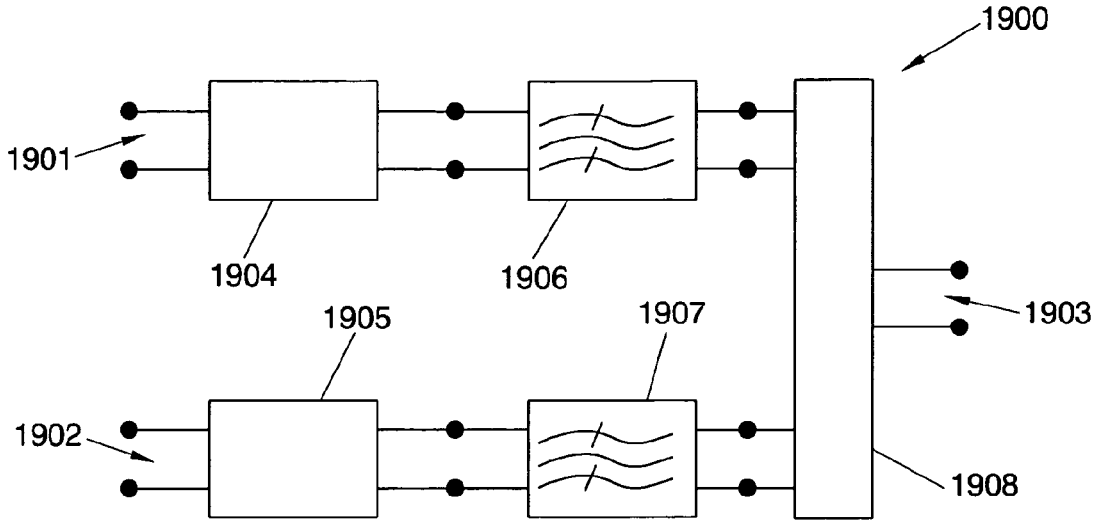

FIG. 19—Schematic of the matching and tuning system of the antenna system whose antenna structure is shown in FIG. 17.

Figure 20:
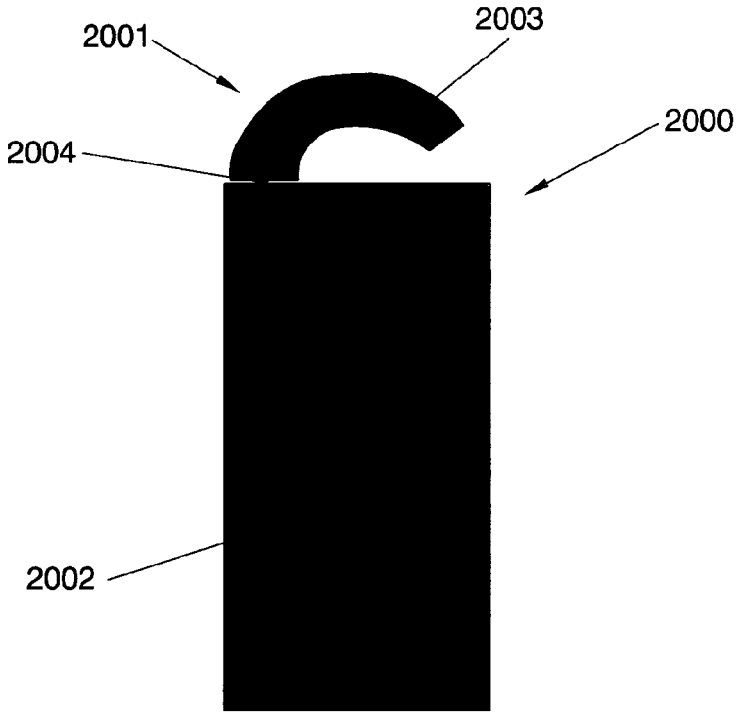

FIG. 20—Top plan view of a further example of an antenna structure for an antenna system, the antenna structure including a radiating element and a ground plane layer.

FIG. 21—Radiator contour of the radiating element in FIG. 20 under (a) a first grid, (b) a second grid, and (c) a third grid to compute the complexity factors of said radiator contour.

FIG. 22—Examples of antenna structures comprising two radiating elements suitable for an antenna system according to the present invention.

DESCRIPTION OF THE PREFERRED EMBODIMENTS

Further characteristics and advantages of the invention will become apparent in view of the detailed description of some preferred embodiments which follows. Said detailed description of some preferred embodiments of the invention is given for purposes of illustration only and in no way is meant as a definition of the limits of the invention, made with reference to the accompanying figures.

FIG. 1 shows the block diagram of three examples of an antenna system for a wireless handheld or portable device according to the present invention.

In particular FIG. 1*a* shows an antenna system 100 comprising an antenna structure 105, a matching and tuning system 130 and an external I/O port of the antenna system 140. The antenna structure 105 comprises a radiating element 110, which includes a connection point 112, and a ground plane layer 120, said ground plane layer including also a connection point 121. The antenna structure 105 further comprises an internal I/O port 150 defined between the connection point of the radiating element 112 and the connection point of the ground plane layer 121. The matching and tuning system comprises two I/O ports: a first I/O port 160 is connected to the internal I/O port of the antenna structure 150, and a second I/O port 161 is connected to the external I/O port of the antenna system 140.

Figure 1B:
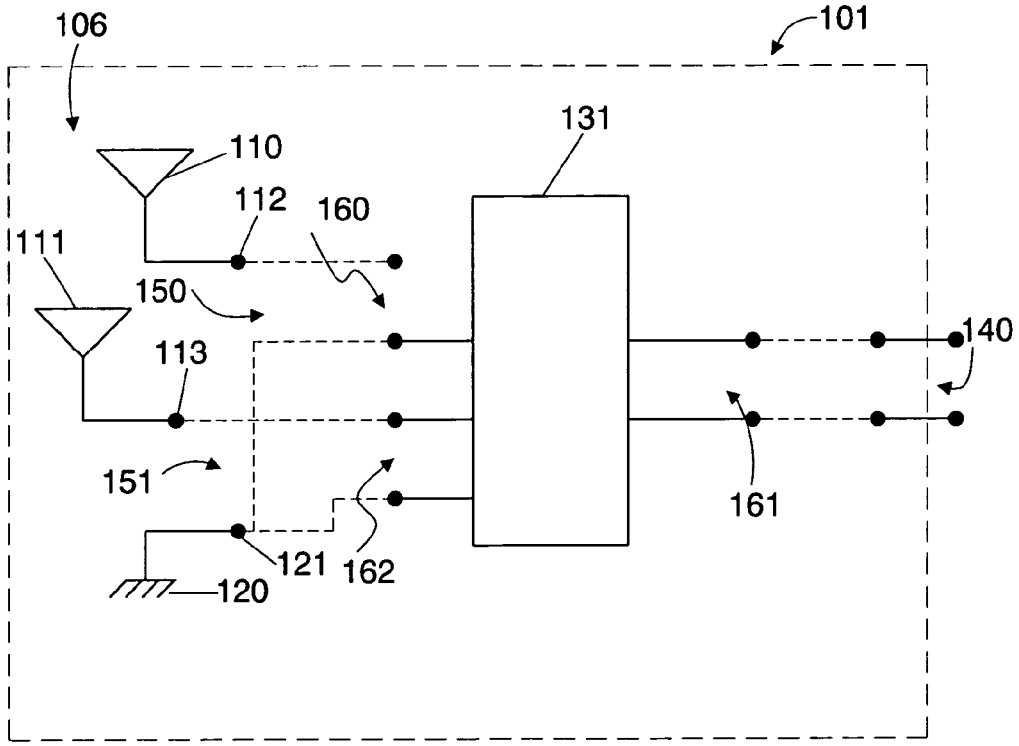

Referring now to FIG. 1*b*, an antenna system 101 comprises an antenna structure 106, which, in addition to a first radiating element 110 and a ground plane layer 120, also includes a second radiating element 111. The antenna structure 106 comprises two internal I/O ports: The first internal I/O port 150 is defined between a connection point of the first radiating element 112 and a connection point of the ground plane layer 121; while the second internal I/O port 151 is defined between a connection point of the second radiating element 113 and the same connection point of the ground plane layer 121.

The antenna system 101 comprises a matching and tuning system 131 including three I/O ports: A first I/O port 160 is connected to the first internal I/O port 150; a second I/O port 162 is connected to the second internal I/O port 151; and a third I/O port 161 is connected to the external I/O port of the antenna system 140.

Figure 1C:
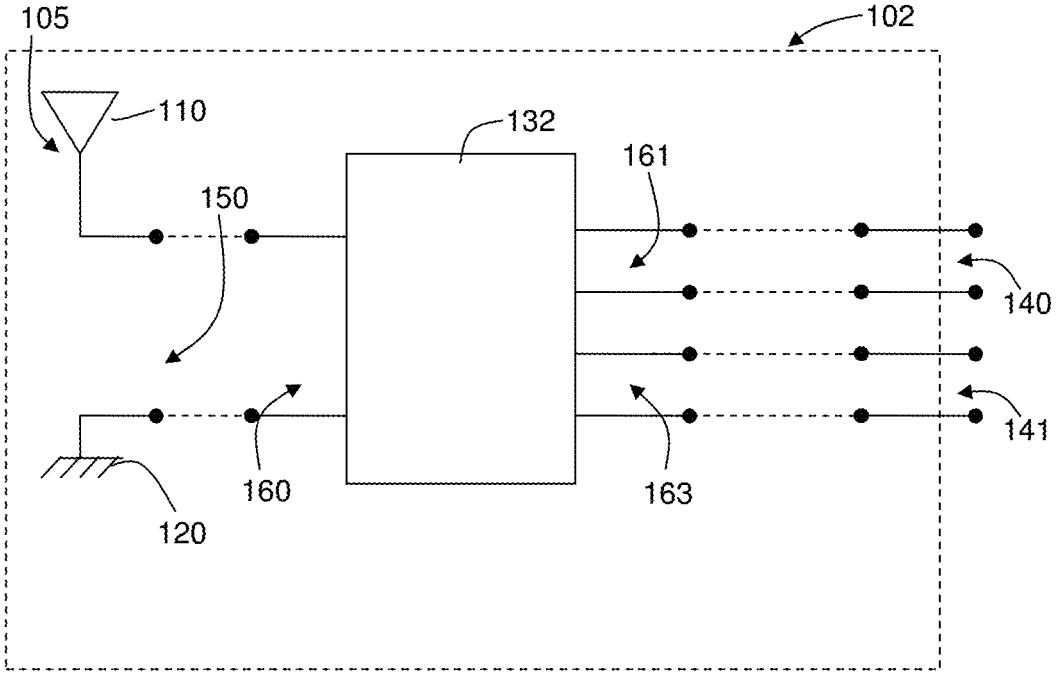

FIG. 1*c* depicts a further example of an antenna system 102 having the same antenna structure 105 as in the example of FIG. 1*a*. However, differently from the example of FIG. 1*a*, the antenna system 102 comprises an additional external I/O port 141.

The antenna system 102 includes a matching and tuning system 132 having a first I/O port 160 connected to the internal I/O port of the antenna structure 150, a second I/O port 161 connected to the external I/O port 140, and a third I/O port 163 connected to the additional external I/O port 141.

Such an antenna system 102 may be preferred when said antenna system 102 is to provide operation in at least one cellular communication standard and at least one wireless connectivity standard. In one example, the external I/O port 140 may provide the GSM 900 and GSM 1800 standards, while the external I/O port 141 may provide an IEEE802.11 standard.

Figure 2A:
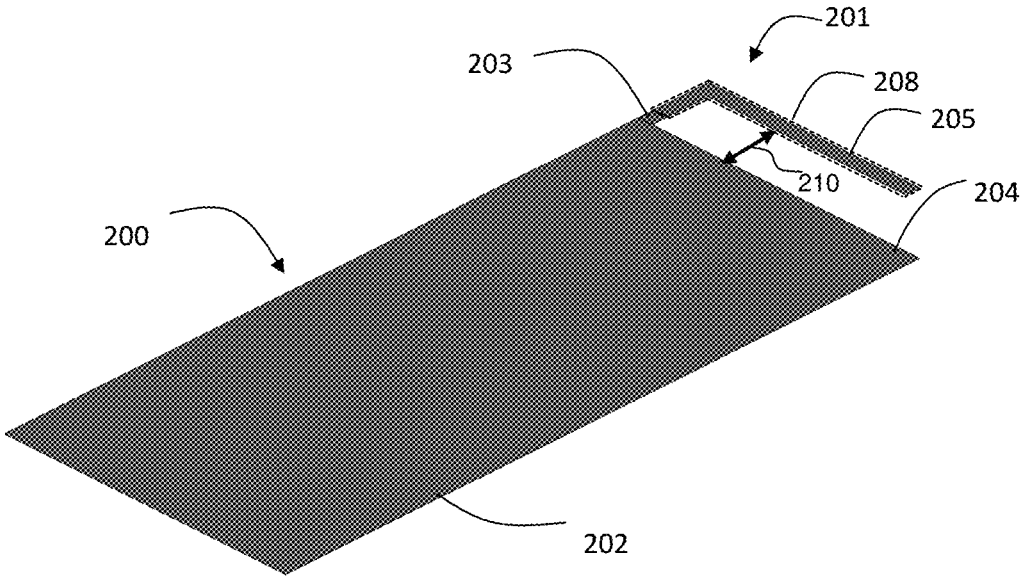

FIG. 2*a* shows the antenna structure 200 of an antenna system capable of operating in two separated frequency regions of the electromagnetic spectrum: a first frequency region between 880 and 960 MHz, and a second frequency region between 1710 and 1990 MHz.

The antenna structure 200 comprises a radiating element 201, and a rectangular ground plane layer 202. In this example, the radiating element 201 is substantially planar, said element 201 being placed on the same plane as the one including the ground plane layer 202 (i.e., the radiating element 201 and the ground plane layer 202 are substantially coplanar). Since the radiating element 201 and the ground plane layer 202 are substantially coplanar, they may be embedded in a same PCB of a wireless handheld or portable device.

In accordance to the present invention, the radiating element 201 protrudes beyond the ground plane layer 202. In fact, the projection 208 of the radiating element 201 on the plane of the ground plane layer 202 does not overlap the ground plane layer 202. Moreover, a majority of the area of said projection of the radiating element 201 (in particular more than 80% of said area) is placed at a distance 210 to an edge of the ground plane layer 204 between a 0.6% and a 6% of the wavelength corresponding to the highest frequency of the lowest frequency region of operation (i.e., the first region), obtaining a good compromise between radioelectric performance of the antenna system and integration of the antenna structure 200 within the wireless handheld or portable device.

The radiating element 201 comprises a single radiating arm 205, said arm 205 including a connection point 203 located at one end of the radiating arm 205. The connection point of the radiating element 203 defines together with a connection point of the ground plane layer 202 (not shown) an internal I/O port of the antenna structure.

Figure 3A:
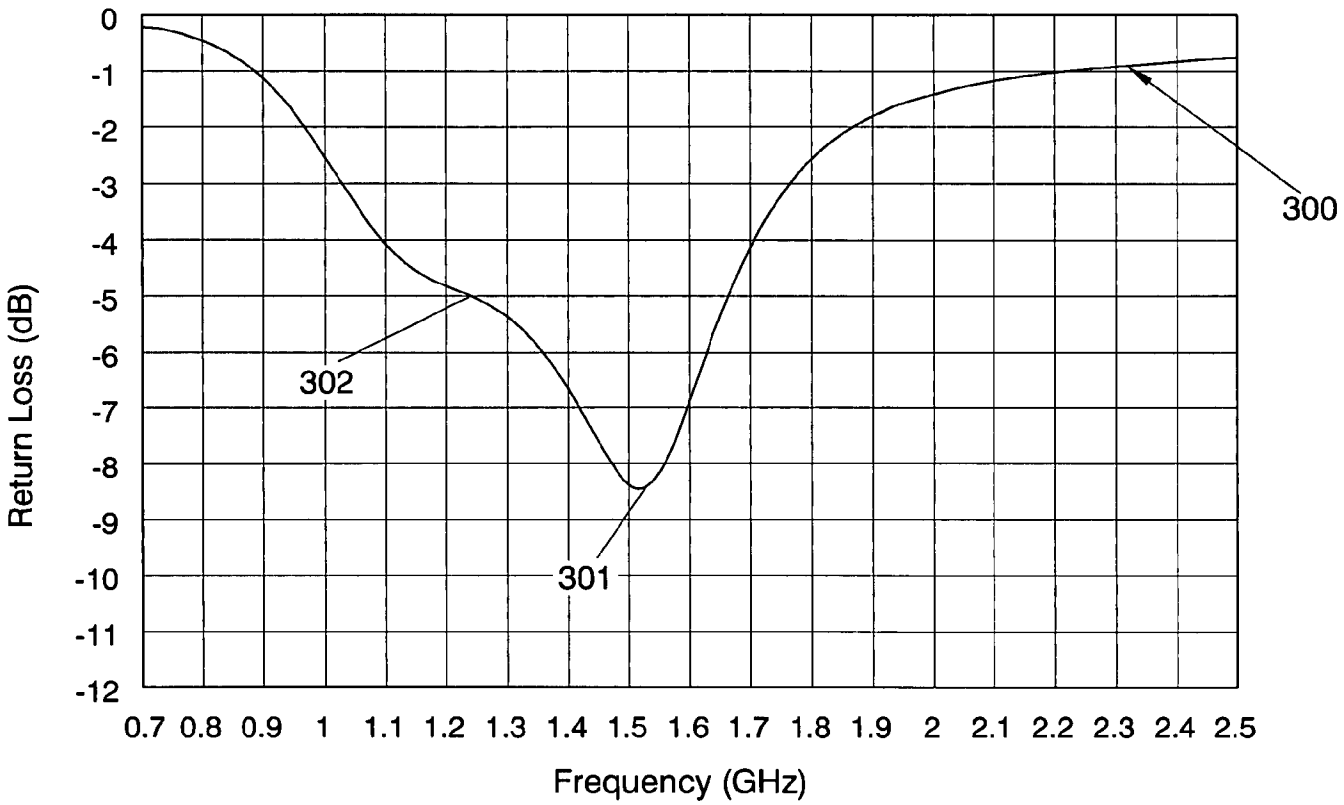
Figure 3B:
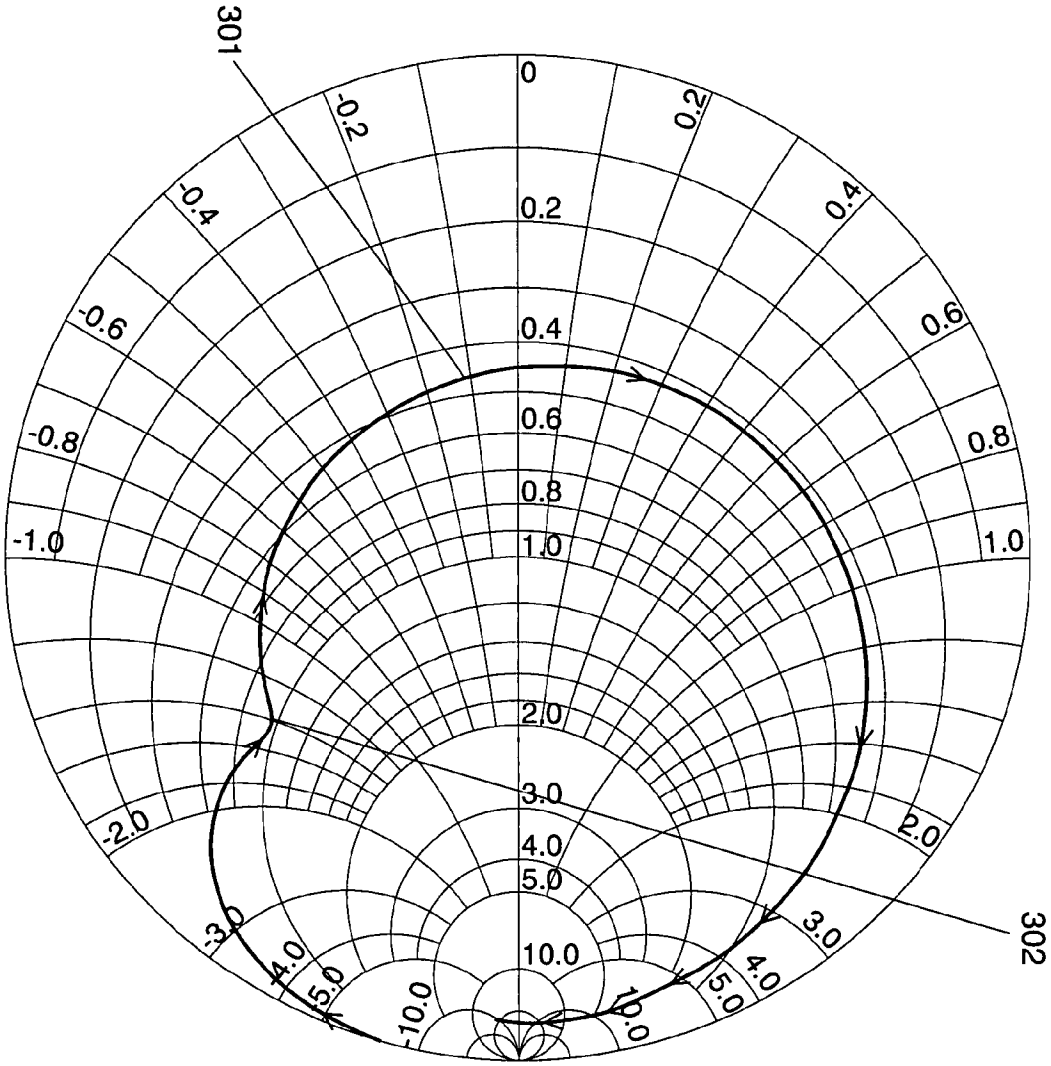

FIG. 3 presents typical radioelectric performance of the antenna structure 200 at its internal I/O port as a function of the frequency, when the antenna structure 200 is not connected to the matching and tuning system of an antenna system. FIG. 3*a* shows the input return losses, while FIG. 3*b* represents the locus of the input impedance on a Smith chart.

In FIG. 3*a*, the input return loss curve 300 has a minimum at a frequency 301 (around 1.52 GHz), said frequency 301 being the intrinsic frequency of the antenna structure. The intrinsic frequency 301 is advantageously outside the first and second regions of operation of the antenna system, and in particular above said first frequency region. The ratio between the intrinsic frequency 301 and the highest frequency of the lowest frequency region of operation is advantageously larger than 1.4 but smaller than 2.0.

On a Smith chart, in FIG. 3*b*, frequency 301 corresponds to a point located close to the horizontal axis (i.e., real input impedance), which indicates that the antenna structure 200 is close to resonance at the intrinsic frequency 301.

The input return loss curve 300 of FIG. 3*a* features also a frequency 302 (around 1.26 GHz), said frequency 302 being lower than the intrinsic frequency 301, at which the absolute value of slope of the curve 300 at said frequency 302 is smaller than the absolute value of the slope of the curve 300 at any other frequency within a non-empty neighborhood centered at said frequency 302. The frequency 302 is therefore the secondary frequency of the antenna structure 200.

Said secondary frequency 302 shows in FIG. 3*b* as a "bump" in the locus of the input impedance of the antenna structure 200, which is an indication of the coupling of the ground plane layer 202.

In this embodiment, the ratio between the intrinsic frequency 301 and the secondary frequency 302 is larger than 1.0 but smaller than 1.4, which is advantageous to provide adequate radioelectric performance to the antenna system in the two regions of operation once the matching and tuning system is connected to the antenna structure 200.

Figure 3C:
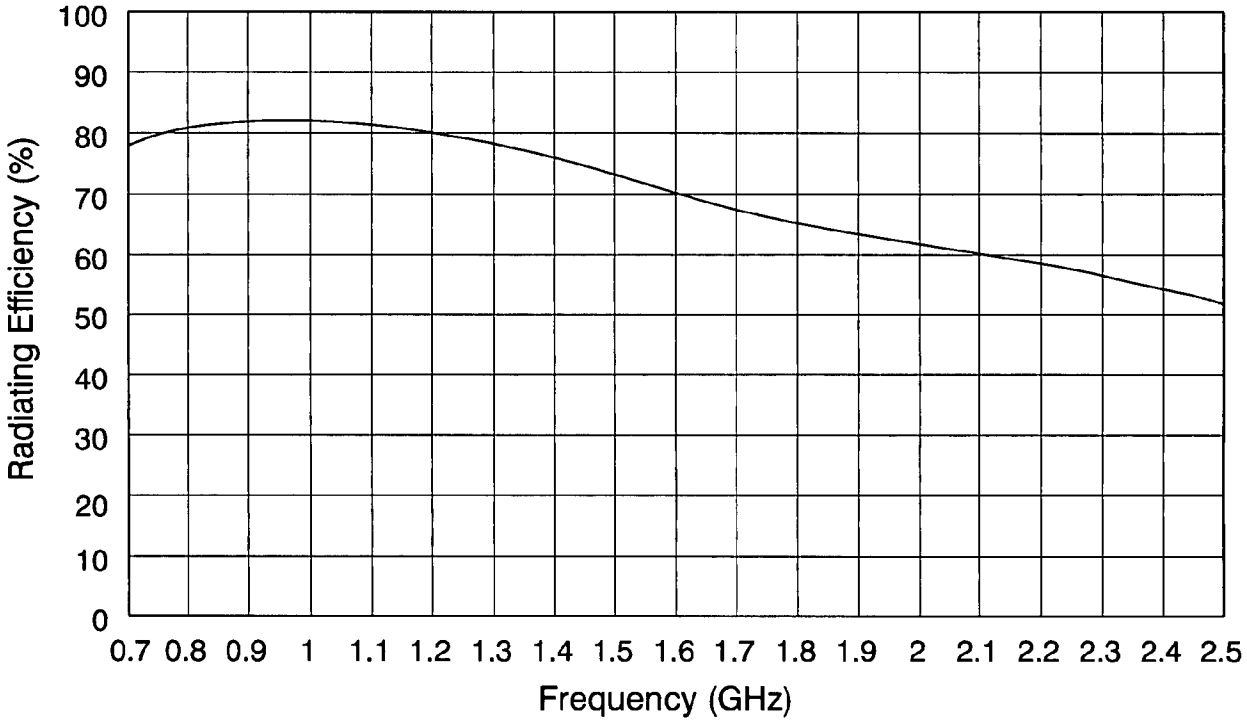

FIG. 3*c* shows the radiating efficiency of the antenna structure 200 at its internal I/O port when the matching and tuning system is not connected to it. The antenna structure 200 is efficient around the intrinsic frequency 301, reaching efficiency levels in excess of 50%, and fairly similar throughout its impedance bandwidth.

FIG. 4 depicts a typical matching and tuning system 400 to be used in combination with the antenna structure 200 in FIG. 2 in order to transform the input impedance of the antenna structure 200 and provide impedance matching in the first and second regions of operation of the antenna system.

The matching and tuning system 400 comprises a first I/O port 401 for connection with the internal I/O port of the antenna structure 200, and a second I/O port 402 for connection with the external I/O port of the antenna system. The matching and tuning system 400 further comprises a matching network 403, connected to said first and second I/O ports 401, 402.

In this example, the matching network 403 comprises six (6) stages 404-409, although in other examples a matching network 403 could comprise fewer or more stages. The stages 404-409 are arranged forming a ladder structure (i.e., a first stage 404 is laid out in parallel with the first I/O port 401, while a second stage 405 is laid out in series, and so on alternating stages in parallel with stages in series). The last stage 409 is connected to the second I/O port 402.

Moreover, in this example each stage 404-409 comprises each one circuit component. Three stages 404, 406, 407 feature a substantially capacitive behavior in the frequency regions of operation, while three stages 405, 408, 409 feature a substantially inductive behavior.

In FIG. 5 it is shown a comparison between the input return loss at the internal I/O port of the antenna structure 200 (before connecting the matching and tuning system 400), and the input return loss at the external I/O port of the antenna system after connecting said matching and tuning system 400 to the internal I/O port of the antenna structure 200.

Curve 501 (in dashed line in FIG. 5) corresponds to the input return losses at the internal I/O port of the antenna structure 200 when the matching and tuning system 400 is not connected to said internal I/O port, and is the same as the curve 300 in FIG. 3*a*. Curve 502 (in solid line in FIG. 5) corresponds to the input return losses at the external I/O port of the antenna system, and shows two frequency regions in which the return losses are better than −6 dB: a first frequency region between frequency 503 and frequency 504, which may provide operability for the GSM900 standard; and a second frequency region between frequency 506 and frequency 507, which may provide operability for the GSM 1800 and GSM 1900 standards.

Protruding a radiating element of the antenna structure beyond the ground plane layer is advantageous to adjust the levels of impedance of the antenna structure and enhance its impedance bandwidth. In the embodiment of FIG. 2 a major portion of the radiating element 201 is at a distance from an edge of the ground plane layer 204. Varying said distance has an impact on the input impedance of the antenna structure. In FIG. 6, it is represented how the input impedance of an antenna structure such as the one in FIG. 2 changes as the distance of the radiating element 201 to said edge 204 is varied.

Figure 6A:
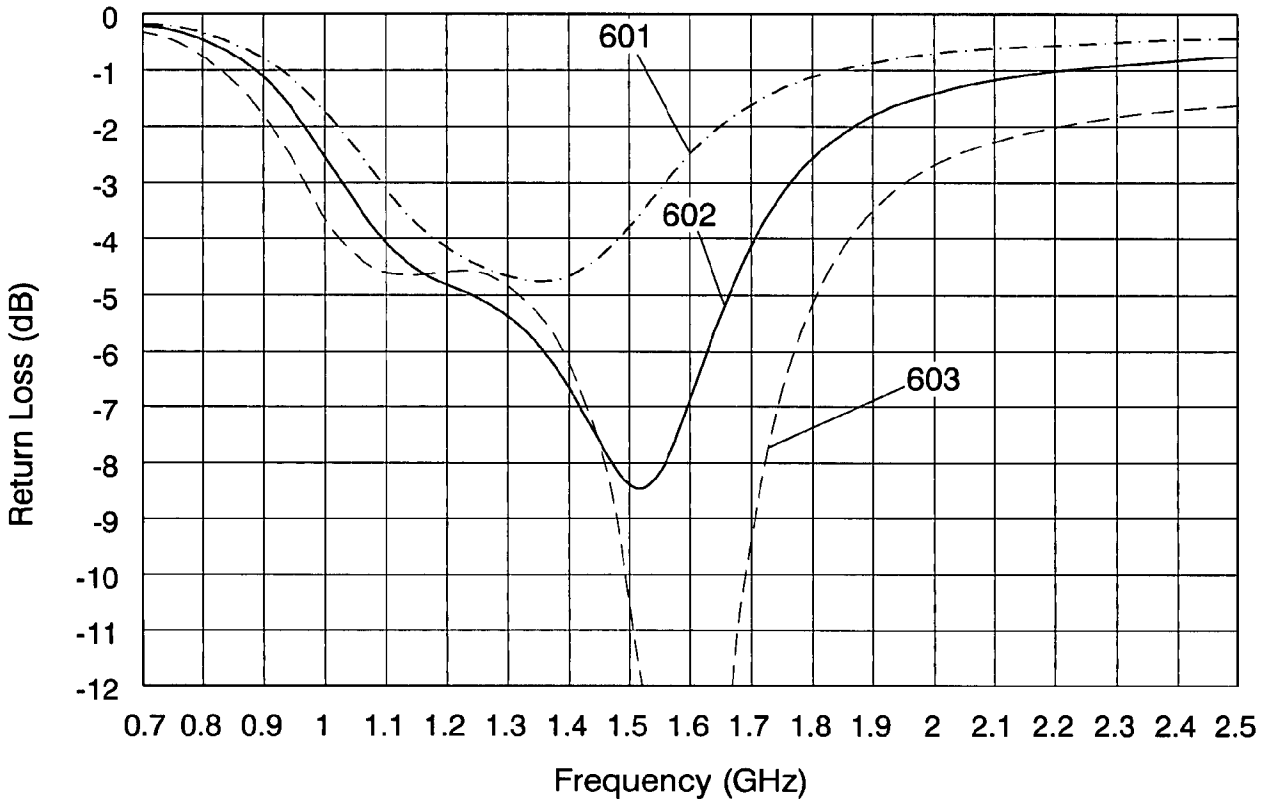
Figure 6B:
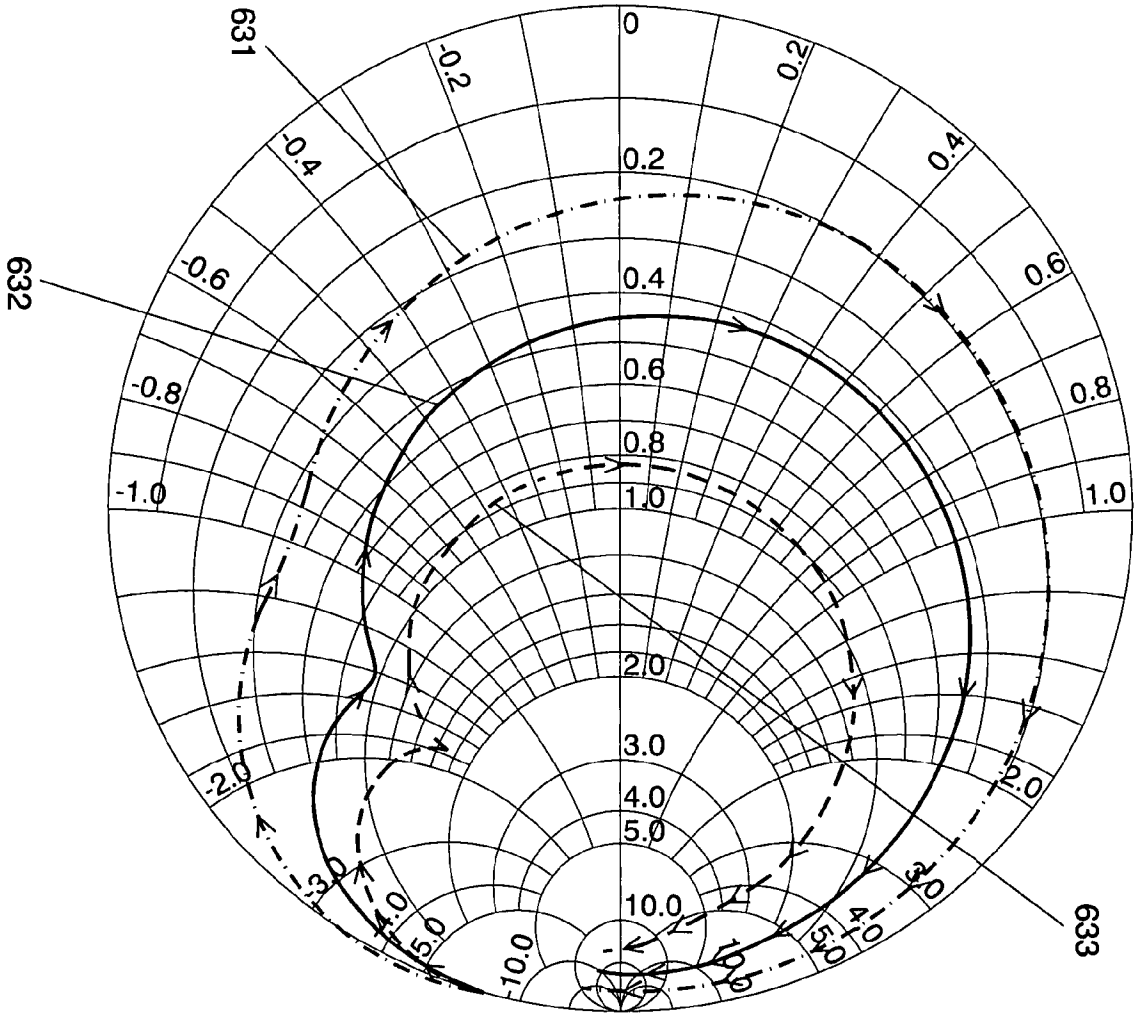

In particular, FIG. 6*a* shows the input return loss curves and FIG. 6*b* the input impedance loci. Curves 602 and 632 (solid lines in FIG. 6) correspond to the case already presented in FIGS. 3*a* and 3*b* respectively.

If the distance of the radiating element 201 to the edge 204 is halved with respect to the case depicted in FIG. 2, the input impedance locus 631 becomes larger, which translates into a degradation of the input return loss at the internal I/O port of the antenna structure 601 (dash-dotted lines in FIG. 6). On the other hand, an increase in said distance results in an input impedance locus 633 smaller, which in turn leads to an input return loss curve 603 with a larger impedance bandwidth, and enhanced radioelectric performance of the antenna system and/or the wireless handheld or portable device including such (dashed lines in FIG. 6).

FIG. 7 shows a perspective view of a wireless handheld or portable device 700 comprising in this particular example only one body. A volume 701 within said device 700 is made available for the integration of the radiating element of an antenna structure. The wireless handheld or portable device 700 also comprises a multilayer PCB. A layer 702 of said PCB serves as a ground plane layer of the antenna structure.

A radiator box 703 is obtained as a minimum-sized parallelepiped that completely encloses the volume 701. In this example, the radiator box 703 has rectangular faces 704-709. According to the present invention, the geometry of the radiating element comes into contact with each of the six (6) faces of the antenna box 704-709 in at least one point of each face. Moreover, the radiating element in the antenna structure of said device 700 has no portion that extends outside the radiator box 703.

A radiator rectangle 710 is obtained as the orthogonal projection of the radiator box 703 along the normal to the face with largest area, which in this case is the direction normal to faces 704 and 705.

FIG. 8*a* represents a top plan view of the wireless handheld or portable device 700. For the sake of clarity, the volume 701 has been omitted in the figure. A ground plane rectangle 800 is adjusted around the layer 702 that serves as a ground plane layer to the antenna structure of said device 700. The ground plane rectangle 800 is a minimum-sized rectangle in which each of its edges is tangent to at least one point of the perimeter of layer 702.

FIG. 8*b* depicts the relative position of the ground plane rectangle 800 and the radiator rectangle 710 for the wireless handheld or portable device 700 of FIG. 7. The radiator rectangle has a long side 803 and a short side 804. The ground plane rectangle has a long edge 802 and a short edge 801.

In this particular example, the radiator rectangle 710 and the ground plane rectangle 800 lie substantially on a same plane (i.e., the radiator rectangle 710 and the ground plane rectangle 800 are substantially coplanar). Furthermore, a long side of the radiator rectangle 803 is substantially parallel to a short edge of the ground plane rectangle 801, while in some other embodiments it will be substantially parallel to a long edge of the ground plane rectangle.

In this example, the radiator rectangle 710 is partially overlapping the ground plane rectangle 800. Although in other cases, they can be completely non-overlapping. Moreover, in this example the placement of the radiator rectangle 710 is not symmetrical with respect to a symmetry axis that is parallel to the long edge of the ground plane rectangle 802 and that passes by the middle point of the short edge of said ground plane rectangle 801.

Figure 2B:
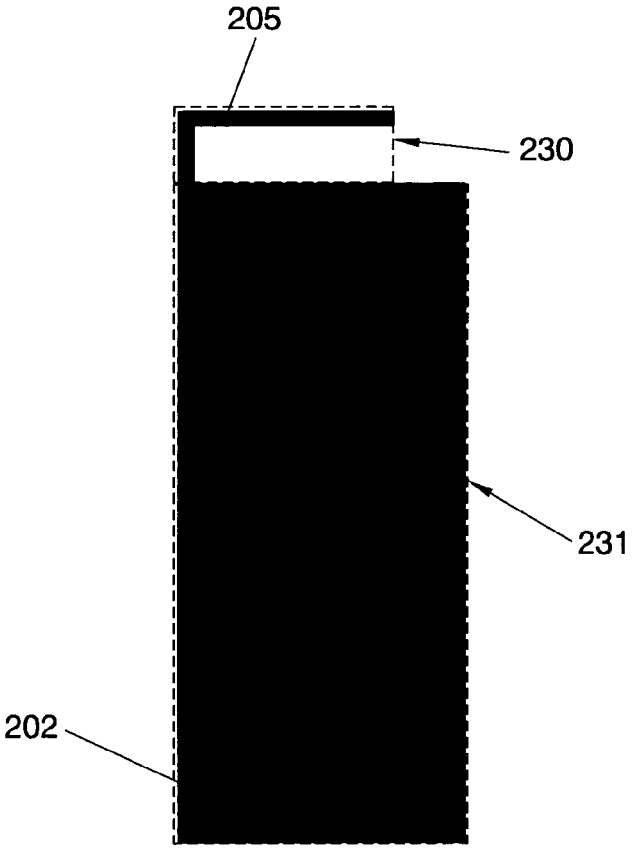

FIG. 2*b* shows a radiator rectangle 230 fitted around the radiating element 201, and a ground plane rectangle 231 fitted around the ground plane layer of the antenna structure 202.

In this particular example area of the radiator rectangle is advantageously smaller than 0.35% of the square of the wavelength corresponding to the lowest frequency of operation of the antenna system comprising the antenna structure 200.

FIG. 9 shows a wireless handheld or portable device 900 consisting of a single body being held typically by a right-handed user to originate a phone call while facing a display of said device 901. The wireless handheld or portable device 900 comprises a radiating element and a PCB that includes a layer that serves as a ground plane layer 902 (depicted in dashed line). The radiating element is to be arranged inside a radiator box, whose radiator rectangle 903, 904 is depicted also in dashed line. The radiator rectangle 903, 904 is partially in the projection of the ground plane layer 902. In the case of FIG. 9*a*, the radiator rectangle 903 is placed substantially in the top part of the body of the device 900 (i.e., above and/or behind a display 901), while in FIG. 9*b* the radiator rectangle 904 is placed substantially in the bottom part of the body of the device 900 (i.e., below and/or behind a keypad).

For ergonomics reasons, it is advantageous in the examples of the FIG. 9 to select a corner of the radiator rectangle close to the left edge of the device 900. The lower left corner of the radiator rectangle 905 is selected as the feeding point corner in the case of FIG. 9*a*, while the upper left corner of the radiator rectangle 906 is selected as the feeding point corner in the case of FIG. 9. In these two examples the corners designated as feeding point corners 905, 906 are also substantially close to a short edge of a ground plane rectangle (not depicted in FIG. 9) that encloses the ground plane layer 902.

FIG. 10 represents an example of a first grid 1001, a second grid 1002 and a third grid 1003 used for the computation of the complexity factors F21 and F32 of a radiator contour that fits in a radiator rectangle 1000. Said radiator rectangle 1000 has a long side 1003 and a short side 1004.

Figure 10A:
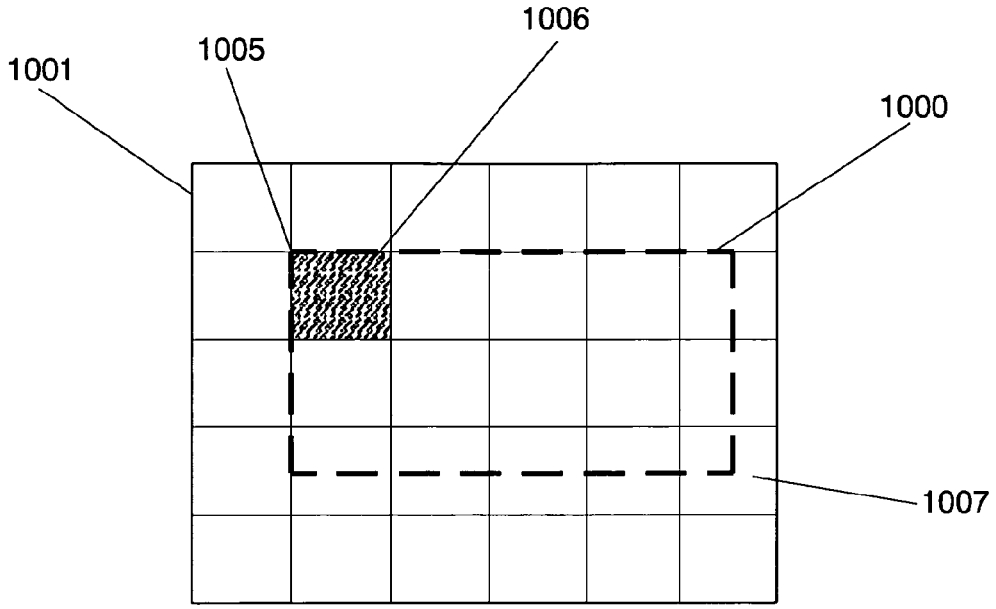
Figure 10B:
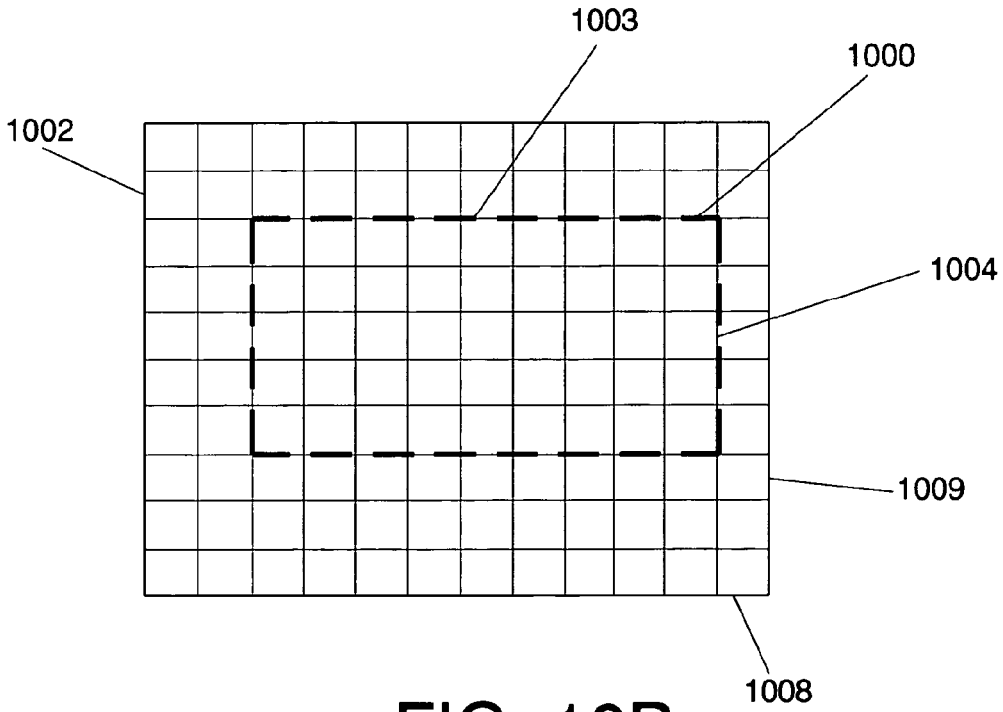

In FIG. 10*b*, the second grid 1002 has been adjusted to the size of the radiator rectangle 1000. The long side of the radiator rectangle 1003 is fitted with nine (9) columns of cells of said second grid 1002. As far as the number of rows is concerned, the aspect ratio of the radiator rectangle 1000 in this particular example is such that a cell aspect ratio closest to one is obtained when the short side of the radiator rectangle 1004 is fitted with five (5) rows of cells of said second grid. Therefore, the radiator rectangle 1000 is perfectly tessellated with 9 by 5 cells of the second grid 1002.

FIG. 10*a* shows a possible first grid 1001 obtained from grouping 2-by-2 cells of the second grid 1002. In this example, the upper left corner of the radiator rectangle 1000 is selected as the feeding point corner 1005. A first cell of the first grid 1006 is placed such that said cell 1006 has a corner being the feeding point corner 1005 and is completely inside the radiator box 1000. In the example of FIG. 10*a*, the radiator rectangle 1000 spans five (5) columns and three (3) rows of cells of the first grid 1001.

Since the radiator rectangle 1000 is tessellated with an odd number of columns and rows of cells of the second grid. An additional column 1008 and an additional row 1009 of cells of the second grid 1002 are necessary to have enough cells of the first grid 1001 to completely cover the radiator rectangle 1000. Said additional column 1008 and additional row 1009 meet at the lower right corner of the radiator rectangle 1007 (i.e., the corner opposite to the feeding point corner 1005).

Figure 10C:
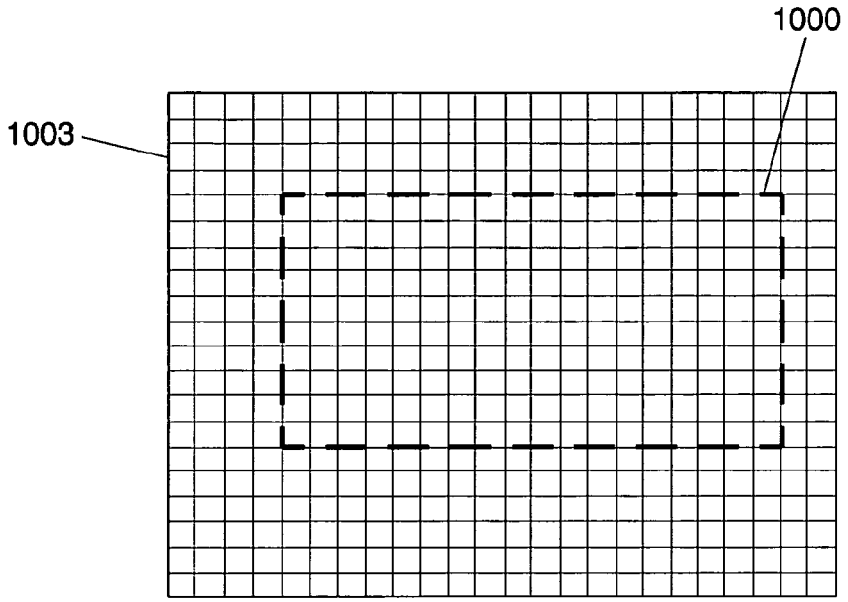

FIG. 10*c* shows the third grid 1003 obtained from dividing each cell of the second grid 1002 into four (4) cells. Each cell of the third grid 1003 has a cell width and cell height equal a half of the cell width and cell height of a cell of the second grid 1002. Thus, in this example the radiator rectangle 1000 is perfectly tessellated with eighteen (18) columns and ten (10) rows of cells of the third grid 1003.

FIG. 11 shows the two-dimensional space 1100 defined by the complexity factors F21 and F32. The radiator contour of a radiating element of a device is represented as a point 1101 of coordinates (F21, F32) in said two-dimensional space 1100.

FIG. 12 provides an example to illustrate the complexity factors that feature two radiating elements radically different: A rectangular radiating element that occupies the area of a radiator rectangle 1200 for a wireless handheld or portable device; and a radiating element whose contour is inspired in a Hilbert curve 1210 that fills the available space within the radiator rectangle 1200. These two radiating element examples help to show the relevance of the two complexity factors.

Figure 12B:
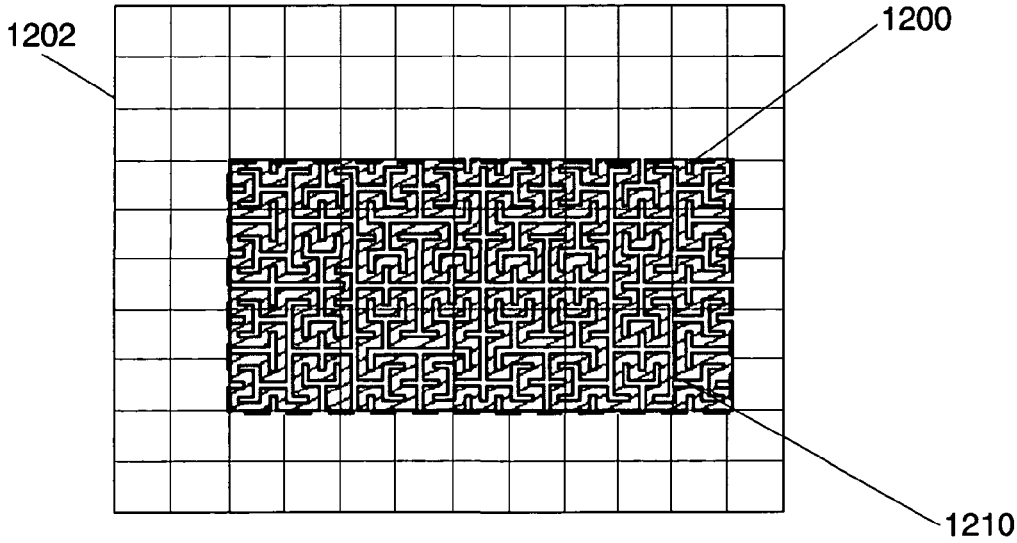
Figure 12C:
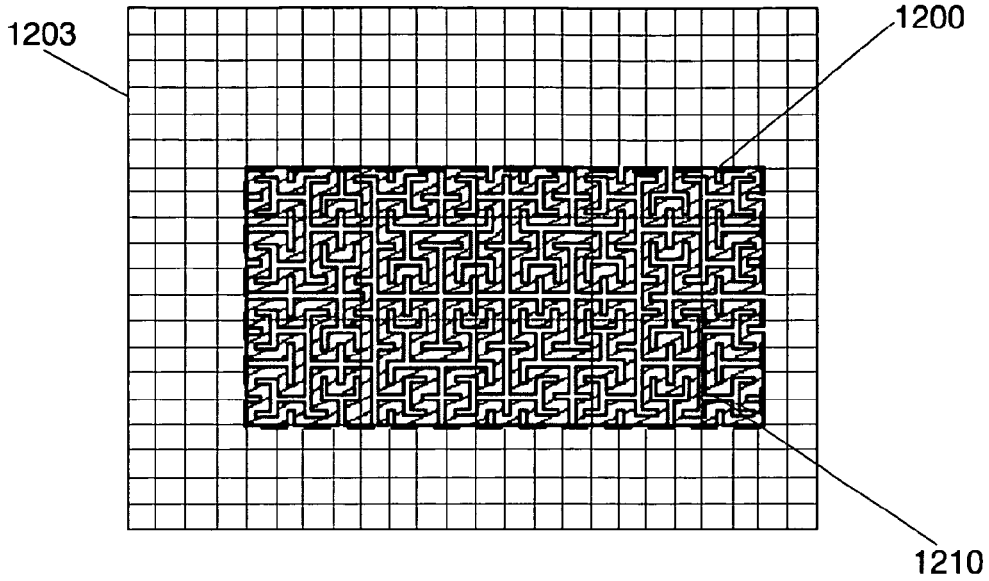

FIG. 12 shows said radiating element 1210 inside the radiator rectangle 1200 under a first grid 1201, a second grid 1202, and a third grid 1203. In this example, the radiator rectangle 1200 is perfectly tessellated with nine (9) columns and five (5) rows of cells of said second grid 1202 (FIG. 12*b*). The radiating element 1210 has a connection point 1211 used for feeding purposes, located substantially close to the lower left corner of the radiator rectangle 1205 (being thus the feeding point corner).

In FIG. 12*a*, there are fifteen (15) cells of the first grid 1201 at least partially inside the radiator rectangle 1200 and that include at least a point of the radiator contour of radiating element 1210 (i.e., N1=15). In FIG. 12*b*, there are forty-five (45) cells of the second grid 1202 completely inside the radiator rectangle 1200 and that include at least a point of the radiator contour of the antenna 1210 (i.e., N2=45). Finally in FIG. 12*c*, there are one hundred eighty (180) cells of the third grid 1203 completely inside the radiator rectangle 1200 and that include at least a point of the radiator contour of the radiating element 1210 (i.e., N3=180). Therefore, in the present example, a radiating element whose contour is inspired in the Hilbert curve 1210 features F21=1.58 (i.e., smaller than 2.00) and F32=2.00.

On the other hand if the process of counting the cells in each of the three grids is repeated for a rectangular radiating element whose contour is the radiator rectangle 1200 then N1=12, N2=24 and N3=52, which results in F21=1.00 and F32=1.12 (i.e., larger than 1.00).

These results illustrate that complexity factor F21 is geared more towards discerning if the radiator contour of a particular radiating element distinguishes sufficiently from a rectangular radiating element rather than capturing the complete intricacy of said radiator contour, while complexity factor F32 is predominantly directed towards capturing if the degree of complexity of said radiator contour approaches to that of a highly-convoluted curve such as a Hilbert curve.

FIG. 13 provides an example to illustrate the complexity factors that feature the radiator contour 1301 of the radiating element 201 of the antenna structure 200 in FIG. 2.

Figure 13A:
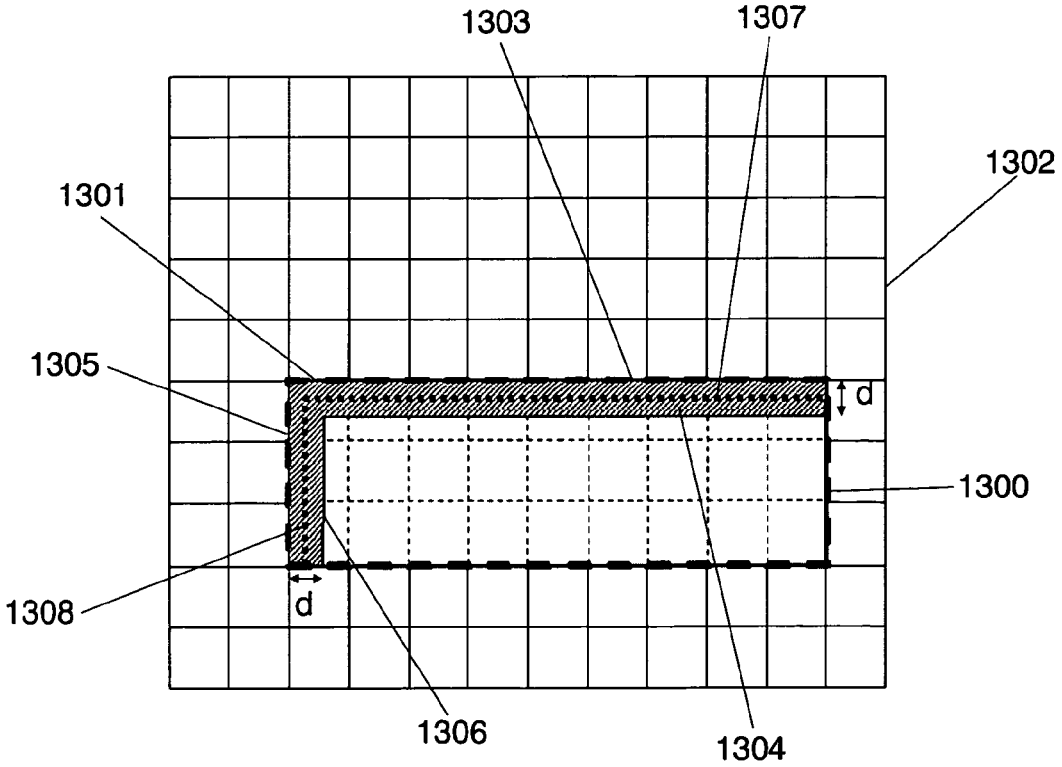

FIG. 13*a* shows said radiator contour 1301 inside the radiator rectangle 1300 under a second grid 1302. In this example, the radiator rectangle 1300 is perfectly tessellated with nine (9) columns and three (3) rows of cells of said second grid 1302. The radiator contour 1301 comprises a portion in which a first edge 1303 and a second edge 1304, said second edge 1304 not being adjacent to said first edge 1303, are placed at a distance d smaller than the cell width of said second grid 1302. Therefore, said portion of the radiator contour 1301 does not substantially distinguish from a zero-width line 1307 placed at the middle distance between said edges 1303 and 1304. Similarly, the radiator contour 1301 comprises another portion in which two non-adjacent edges 1305 and 1306 are also placed at a distance d. Therefore, said other portion of the radiator contour 1301 can also be replaced by a line 1308 at the middle distance between said edges 1305 and 1306.

As a result of the modification of the radiator contour 1301, the radiator rectangle 1300 has to be resized, and a first, a second and a third grid fitted to said radiator contour 1301.

Figure 13B:
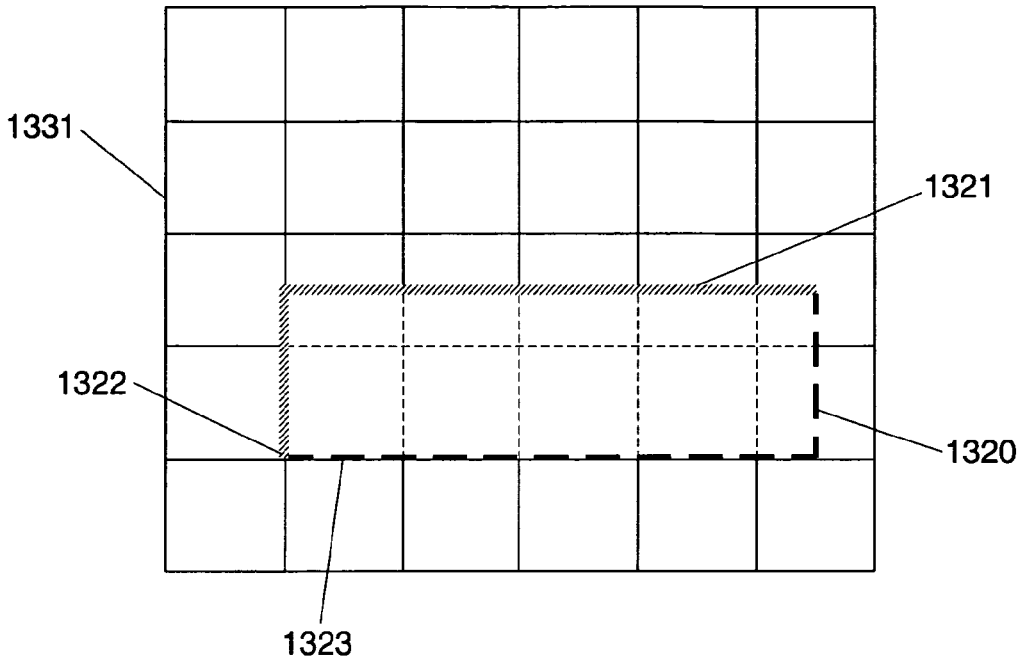
Figure 13C:
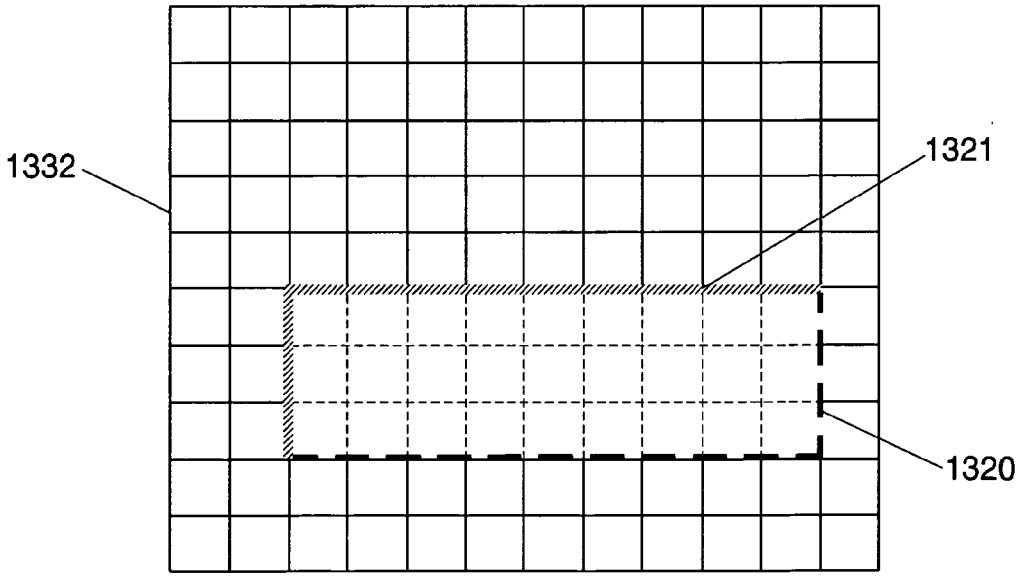
Figure 13D:
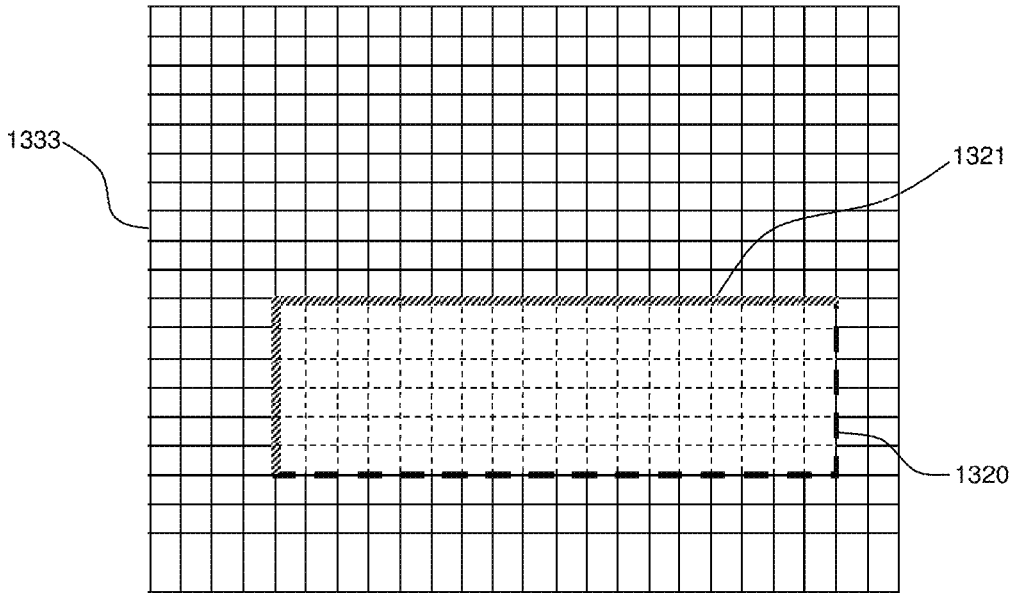

FIGS. 13*b-d* show a modified radiator contour 1321 inside its radiator rectangle 1320 under a first grid 1331, a second grid 1332, and a third grid 1333. In this example, the radiator rectangle 1320 is tessellated with nine (9) columns and three (3) rows of cells of said second grid 1332 (FIG. 13*c*). The radiator contour 1321 has a connection point 1322 used for feeding purposes of the radiating element 201, located substantially close to the bottom left corner of the radiator rectangle 1323 (being thus the feeding point corner).

In FIG. 13*b*, there are six (6) cells of the first grid 1331 at least partially inside the radiator rectangle 1320 and that include at least a point of the radiator contour 1321 (i.e., N1=6). In FIG. 13*c*, there are eleven (11) cells of the second grid 1332 completely inside the radiator rectangle 1320 and that include at least a point of the radiator contour 1321 (i.e., N2=11). Finally in FIG. 13*d*, there are twenty three (23) cells of the third grid 1333 completely inside the radiator rectangle 1320 and that include at least a point of the radiator contour (i.e., N3=23). Therefore, in the present example, the radiator contour 1321, corresponding to the radiating element 201 in FIG. 2, features F21=0.9 (i.e., smaller than 1.2) and F32=1.1 (i.e., smaller than 1.2). Such low complexity factors are an indication of the geometrical simplicity of the radiating element 201, which is advantageous to provide a single path to the electric currents flowing on said radiating element 201 to excite a radiation mode with enhanced radioelectric performance.

FIG. 14 presents another embodiment of an antenna system according to the present invention based on a modification of the antenna structure shown in FIG. 2.

Antenna structure 1400 comprises a radiating element 1401 and a ground plane layer 202. The radiating element 1401 includes a radiating arm formed by a first portion 1406 protruding substantially perpendicularly to an edge of the ground plane layer 204, and a second portion 1405 arranged substantially parallel to said edge 204. The first portion 1406 includes a connection point 1403 on one end, and is connected to the second portion 1405 on the opposite end.

The first portion 1406 is substantially coplanar to the ground plane layer 202, while the second portion 1405 features a volumetric geometry. Said second portion 1405 has the shape of a parallelepiped with a face being coplanar to the ground plane 202 and extending upwards (i.e., substantially perpendicular to the plane containing the ground plane layer 202) a height t. In this particular embodiment, the radiating element can be confined in a radiator box having a height t being at least 2.0% of the wavelength corresponding to the lowest frequency of operation of the antenna system. In addition, in this case, a majority of the area of the orthogonal projection 1408 of the radiating element 1401 onto the plane containing the ground plane layer 202 is placed at a distance 1410 to an edge of said ground plane layer 202 ranging from 0.6% to 6% of the wavelength corresponding to the highest frequency of the lowest frequency region of operation.

FIG. 15 presents the input return losses at the internal I/O port of the antenna structure 1400 (before connecting a matching and tuning system) compared with the input return losses at the external I/O port of the antenna system after connecting said matching and tuning system to the internal I/O port of the antenna structure 1400.

Curve 1501 (in dashed line in FIG. 15) corresponds to the input return losses at the internal I/O port of the antenna structure 1400. When a matching and tuning system comprising a six-stage matching network is connected to said internal I/O port, curve 1502 (in solid line in FIG. 15) is obtained at the external I/O port of the antenna system. Curve 1502 shows two frequency regions in which the return losses are better than −6 dB: a first frequency region between frequency 1503 and frequency 1504, which may provide operability for the GSM 850 and GSM900 standards; and a second frequency region between frequency 1505 and frequency 1506, which may provide operability for the GSM 1800, GSM 1900 and UMTS standards.

The use of the antenna structure 1400 in which the radiating element 1401 has a volumetric geometry is advantageous in enhancing the radioelectric performance of the antenna system, in particular increasing the impedance bandwidth in both the first and second frequency regions with respect to the example of FIG. 2, making it possible for the wireless handheld or portable device to operate five communication standards.

FIG. 16 shows an example matching and tuning system comprising a first diplexer 1603 to separate the electrical signals of a first and a second frequency regions of operation of an antenna system, a first matching network 1605 to provide impedance matching in said first frequency region, a second matching network 1606 to provide impedance matching in said second frequency region, and a second diplexer 1602 to recombine the electrical signals of said first and second frequency regions.

The first diplexer 1603 is connected to a first I/O port 1601, while the second diplexer 1604 is connected to a second I/O port 1602. In an antenna system, an internal I/O port of an antenna structure may be connected to said first I/O port 1601, while an external I/O port of the antenna system may be connected to said second I/O port 1602.

The use of diplexers in the matching and tuning system is advantageous to separate the electrical signals of different frequency regions and transform the input impedance characteristics in each frequency region independently from the others.

FIG. 17 presents a further example of an antenna structure for an antenna system according to the present invention. The antenna system is to operate in a first frequency region from 824 to 960 MHz and a second frequency region between 1.71 and 2.17 GHz.

In this example, the antenna structure 1700 includes a first radiating element 1701, a second radiating element 1702 and a ground plane layer 1703. A major portion of the radiating elements 1701, 1702 is substantially parallel to the ground plane layer 1703. Moreover, a major portion of said elements 1701, 1702 is placed at a height with respect to the plane containing the ground plane layer 1703 not larger than 2% of the wavelength corresponding to the lowest frequency of operation of the antenna system. In this particular example, the first radiating element 1701 and the second radiating element 1702 are placed at different heights with respect to the ground plane layer 1703, although in other examples said heights can be substantially equal. Setting the height of each radiating element independently allows to modify the input impedance characteristics of the antenna structure (such as for instance to increase the impedance bandwidth) selectively in certain frequency regions.

The first and second radiating elements 1701, 1702 protrude beyond the ground plane layer 1703. In particular, the orthogonal projection 1708, 1709 of the radiating elements 1701, 1702 on the plane containing the ground plane layer 1703 does not overlap said ground plane layer 1703. Moreover, a majority of the area of said projection 1708, 1709 of the radiating elements 1701, 1702 is at a distance 1710, 1711 from an edge of the ground plane layer 1704 between a 0.6% and a 6% of the wavelength corresponding to the highest frequency of the lowest frequency region of operation (i.e., the first region). In other preferred embodiments, the orthogonal projection of radiating elements 1701, 1702 on the plane containing the ground plane layer 1703 might overlap at least partially said ground plane layer 1703.

The first radiating element 1701 comprises a first connection point 1705. Said element 1701 is arranged with respect to the ground plane layer 1703 in a way that its connection point

1705 is substantially close to a first end of edge 1704. The second radiating element 1702 comprises a second connection point 1706. Said element 1702 is arranged with respect to the ground plane layer 1703 in a way that its connection point 1706 is substantially close to a second end of edge 1704, opposite to said first end.

In some embodiments, the space between radiating elements 1701 and 1702 might be advantageously used to integrate one or more components of the wireless device, such as for instance but without limitation: a camera or a CCD sensor, a speaker, an earpeace, a microphone, a vibrating module, an electronic connector, or a shield can.

The first radiating element 1701 can be fitted in a radiator box, whose radiator rectangle 1731 has an area smaller than 0.3% of the square of the wavelength corresponding to the lowest frequency of operation of the antenna system. Analogously, the second radiating element 1702 features a radiator rectangle 1732 having an area smaller than 0.2% of the square of said wavelength.

The first connection point 1705 defines together with a connection point of the ground plane layer 1703 (not depicted in the figure) a first internal I/O port of the antenna structure 1700. Similarly, the second connection point 1706 defines together with said connection point of the ground plane layer 1703 a second internal I/O port of the antenna structure 1700.

Figure 18A:
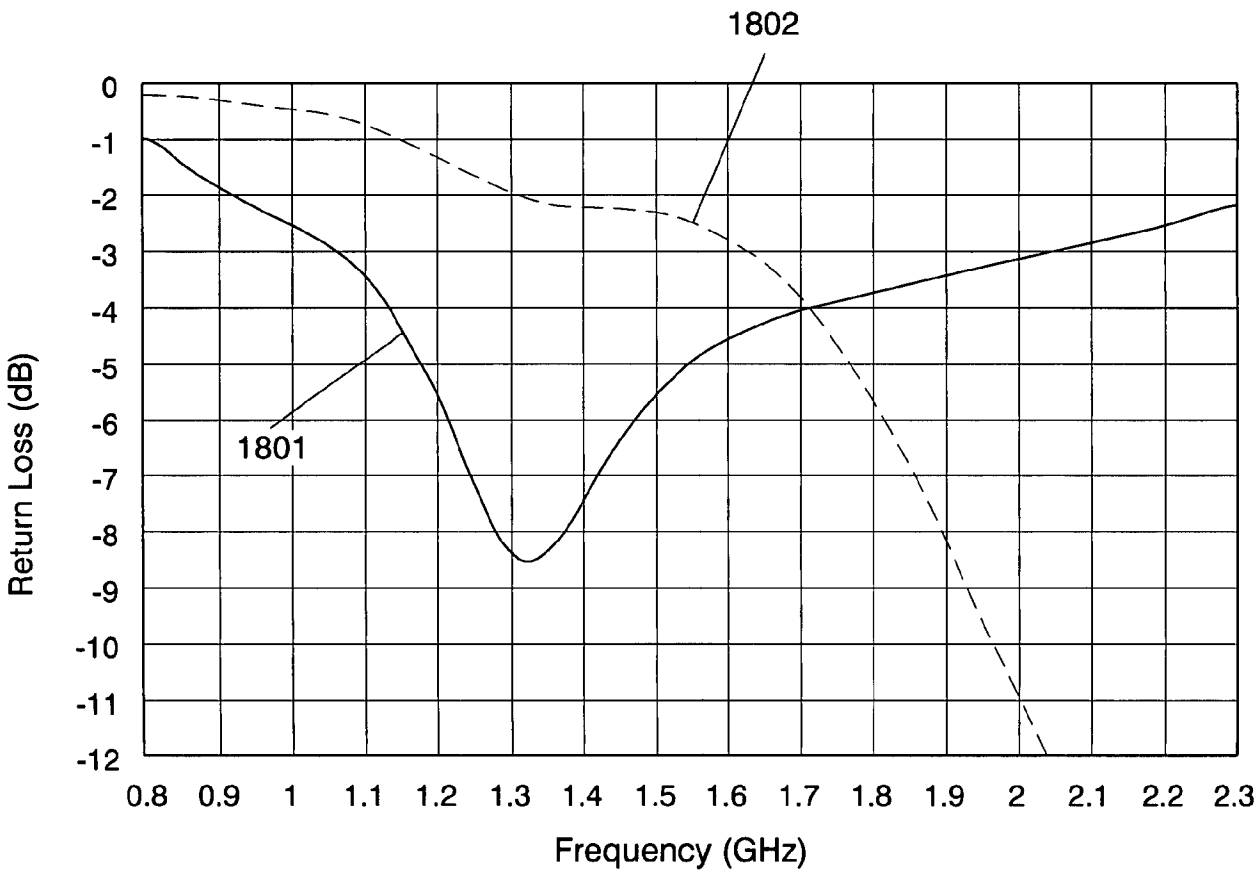

The input return losses at each one of the two internal I/O ports of the antenna structure 1700 when not connected to a matching and tuning system are presented in FIG. 18*a*.

Curve 1801 (in solid line in FIG. 18*a*) corresponds to the input return losses at the first internal I/O port (i.e., the one connected to the first radiating element 1701). Curve 1801 has a minimum at a frequency around 1.3 GHz, said frequency being the intrinsic frequency of the first internal I/O port of the antenna structure 1700. Said intrinsic frequency is advantageously outside the first and second regions of operation of the antenna system, and in particular above said first frequency region. The ratio between the intrinsic frequency of the first internal I/O port of the antenna structure 1700 and the highest frequency of the lowest frequency region of operation is advantageously larger than 1.2 but smaller than 2.0.

Curve 1801 features also a frequency around 1 GHz, said frequency being lower than the intrinsic frequency of the first internal I/O port of the antenna structure 1700, at which the absolute value of slope of the curve 1801 at said frequency is smaller than the absolute value of the slope of the curve 1801 at any other frequency within a non-empty neighborhood centered at said frequency. Therefore, said frequency is the secondary frequency of the first internal I/O port of the antenna structure 1700.

In this embodiment, the ratio between the intrinsic frequency and the secondary frequency of the first internal I/O port of the antenna structure 1700 is advantageously larger than 1.0 but smaller than 1.4.

Curve 1802 (in dashed line in FIG. 18*a*) corresponds to the input return losses at the second internal I/O port (i.e., the one connected to the second radiating element 1702). Curve 1802 has a minimum at a frequency larger than 2.3 GHz, said frequency being the intrinsic frequency of the second internal I/O port of the antenna structure 1700. Said intrinsic frequency is advantageously outside the first and second regions of operation of the antenna system, and in particular above said first and second frequency regions. The ratio between the intrinsic frequency of the second internal I/O port of the antenna structure 1700 and the highest frequency of the lowest frequency region of operation is advantageously larger than 2.2 but smaller than 4.0.

Curve 1802 features also a frequency around 1.4 GHz, said frequency being lower than the intrinsic frequency of the second internal I/O port of the antenna structure 1700, at which the absolute value of slope of the curve 1802 at said frequency is smaller than the absolute value of the slope of the curve 1802 at any other frequency within a non-empty neighborhood centered at said frequency. Therefore, said frequency is the secondary frequency of the second internal I/O port of the antenna structure 1700.

In this embodiment, the ratio between the intrinsic frequency and the secondary frequency of the second internal I/O port of the antenna structure 1700 is advantageously larger than 1.2 but smaller than 2.4.

FIG. 19 presents a schematic of a matching and tuning system 1900 to be connected to the two internal I/O ports of the antenna structure 1700 in order to transform the input impedance of the antenna structure 1700 and provide impedance matching in the first and second regions of operation of the antenna system.

The matching and tuning system 1900 comprises two I/O ports 1901, 1902 to be connected respectively to the first and second internal I/O ports of the antenna structure 1700, and a third I/O port 1903 to be connected to a single external I/O port of the antenna system.

The matching and tuning system 1900 also comprises a first matching network 1904 connected to I/O port 1901, providing impedance matching within the first frequency region; and a second matching network 1905 connected to I/O port 1902, providing impedance matching within the second frequency region.

The matching and tuning system 1900 further comprises a first band-pass filter 1906 connected to said first matching network 1904, and a second band-pass filter 1907 connected to said second matching network 1905. The first band-pass filter 1906 is designed to present low insertion loss in the first frequency region and high impedance in the second frequency region of operation of the antenna system. Analogously, the second band-pass filter 1907 is designed to present low insertion loss in said second frequency region and high impedance in said first frequency region.

Said first and second band-pass filters 1906, 1907 comprise each at least two stages, and preferably at least one of said at least two stages includes an LC-resonant circuit.

The matching and tuning system 1900 additionally includes a combiner/splitter 1908 to combine (or split) the electrical signals of different frequency regions. Said combiner/splitter 1908 is connected to the first and second band-pass filters 1906, 1907, and to I/O port 1903.

In some examples, the combiner/splitter 1908 can be advantageously constructed by directly connecting in parallel the two band-pass filters 1906, 1907 to I/O port 1903.

Figure 18B:
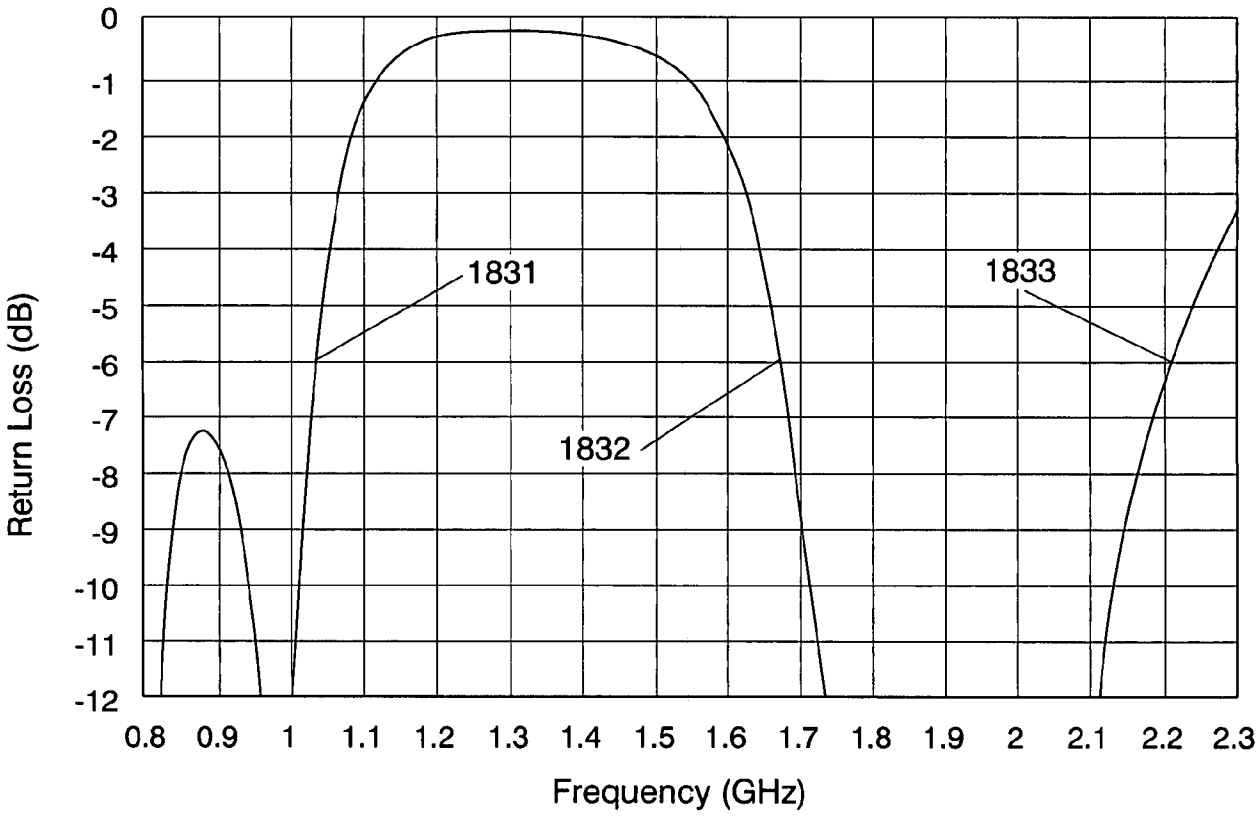

In FIG. 18*b* it is shown the input return loss at the external I/O port of an antenna system comprising the antenna structure 1700 connected to the matching and tuning system 1900.

The curve in FIG. 18*b* shows two frequency regions in which the return losses are better than −6 dB: a first frequency region below frequency 1831, which may provide operability for the GSM 850 and GSM 900 standards; and a second frequency region between frequency 1832 and frequency 1833, which may provide operability for the GSM 1800, GSM 1900 and UMTS standards.

FIG. 20 shows another antenna structure 2000 for an antenna system capable of operating in two separated frequency regions of the electromagnetic spectrum when an appropriate matching and tuning system is connected to said antenna structure 2000.

The antenna structure 2000 includes a radiating element 2001, and a rectangular ground plane layer 2002. The radiating element 2001 comprises a single radiating arm 2003, said arm 2003 including a connection point 2004 located at one end of the radiating arm 2003.

Figure 21A:
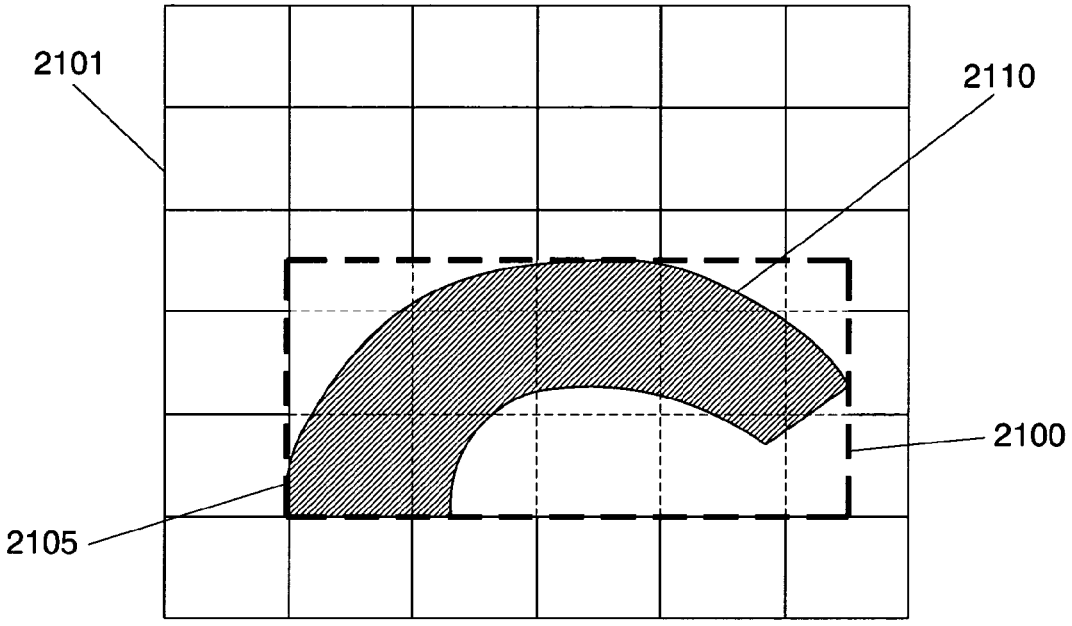
Figure 21B:
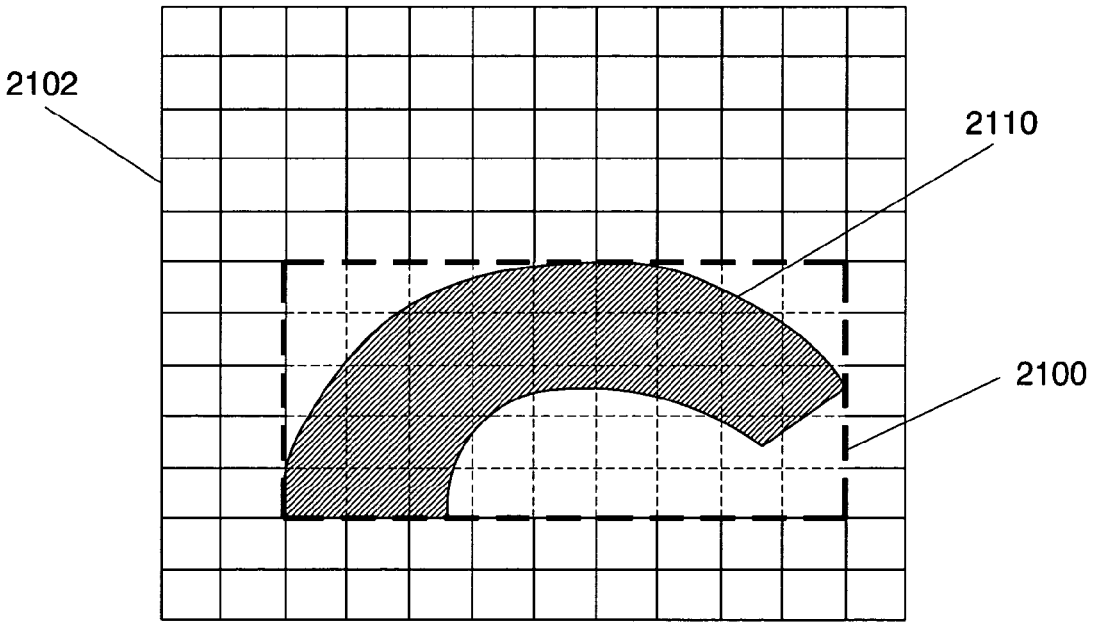

FIG. 21 shows the radiator contour 2110 of the radiating element 2001 inside the antenna rectangle 2100 under a first grid 2101, a second grid 2102, and a third grid 2103. In this case, the radiator rectangle 2100 is perfectly tessellated with nine (9) columns and five (5) rows of cells of said second grid 2102 (FIG. 21*b*). The radiating element 2001 has a connection point 2004 located substantially close to the bottom left corner of the radiator rectangle 2105 (being this the feeding point corner). In this particular example, the radiator contour 2110 comprises curve segments.

Figure 21C:
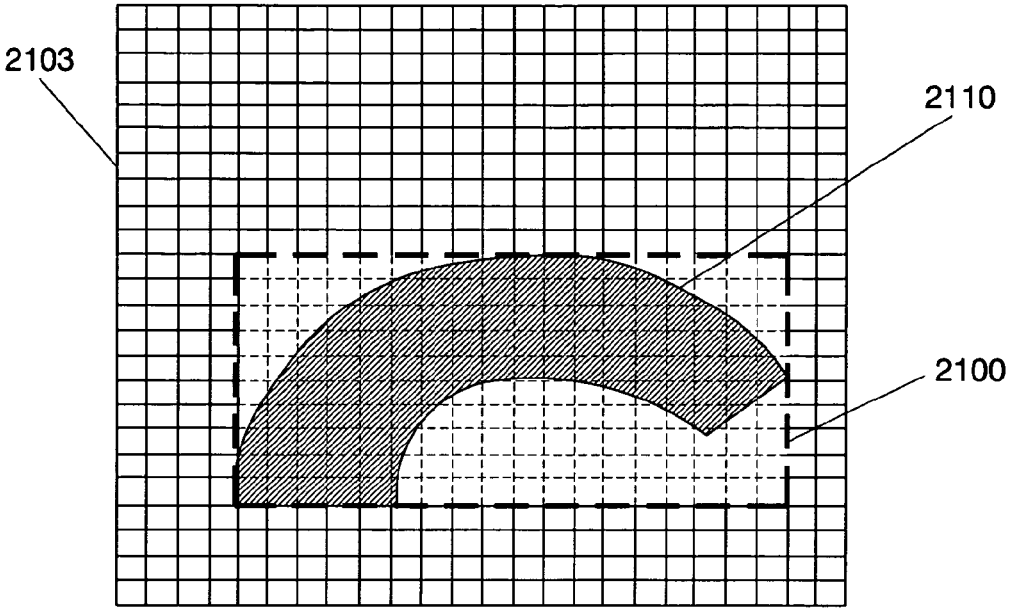

As for the radiator contour 2110 of FIG. 21, in FIG. 21*a*, there are thirteen (13) cells of the first grid 2101 at least partially inside the radiator rectangle 2100 and that include at least a point of the radiator contour 2110 (i.e., N1=13). In FIG. 21*b*, there are twenty-six (26) cells of the second grid 2102 completely inside the radiator rectangle 2100 and that include at least a point of the radiator contour 2110 (i.e., N2=26). Finally in FIG. 21*c*, there are fifty-seven (57) cells of the third grid 2103 completely inside the radiator rectangle 2100 and that include at least a point of the radiator contour 2110 (i.e., N3=57). Therefore, in the present example, the radiating element 2001 features F21=1.0 (i.e., smaller than 1.2) and F32=1.1 (i.e., smaller than 1.2).

FIGS. 22*a-f* present some further examples of antenna structures 2210, 2220, 2230, 2240, 2250, 2260 for an antenna system according to the present invention. As in the example described in connection with FIG. 17, these antenna structures comprise two radiating elements and a ground plane layer 2200.

Figure 22A:
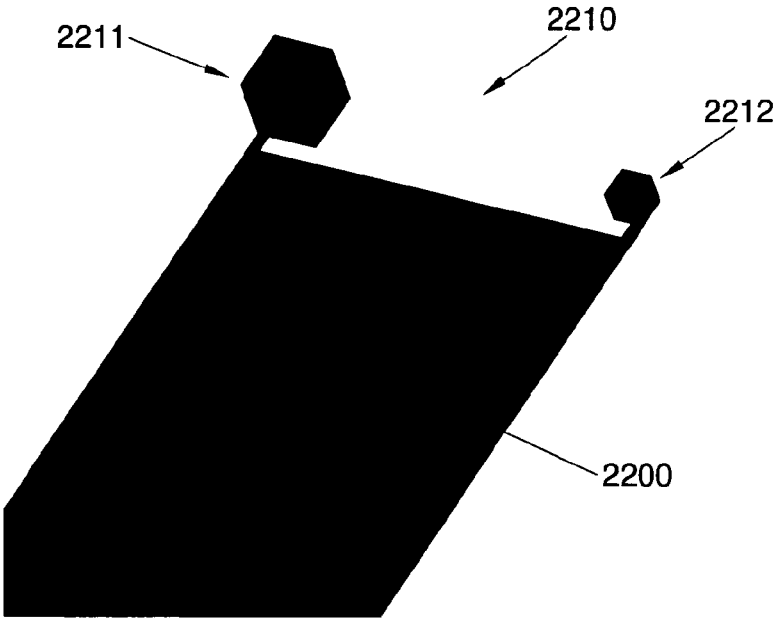
Figure 22B:
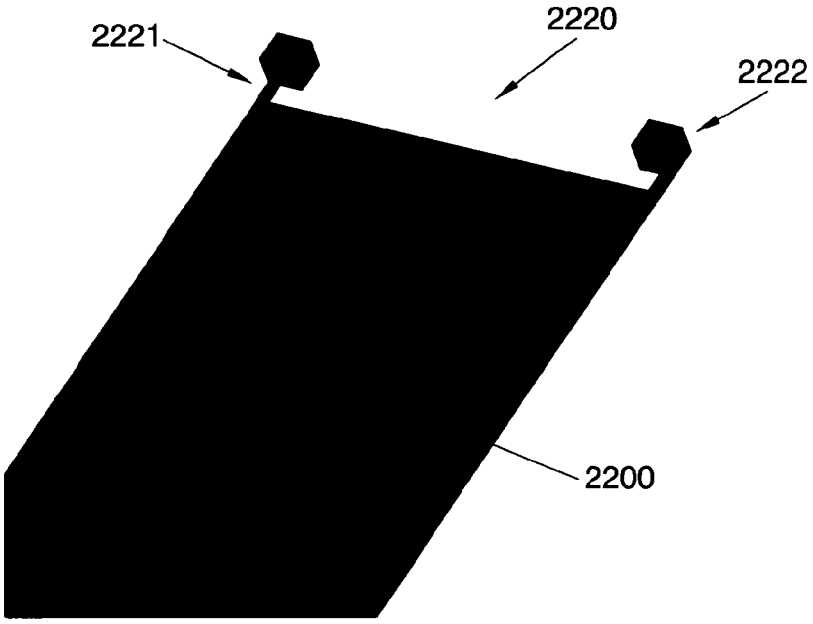

FIGS. 22*a* and 22*b* show two examples in which a first and second radiating elements feature a volumetric geometry. The first radiating element 2211, 2221 and the second radiating element 2212, 2222 comprise a portion having the shape of a parallepiped (and more preferably the shape of a cube) with a face being coplanar with the ground plane layer 2200 and extending upwards (i.e., substantially perpendicular to the plane containing the ground plane layer 2200) a predetermined height. Said height may be the same for both the first and second radiating elements 2211, 2212, 2221, 2222, or may be different.

In FIG. 22*a*, the radiator box of the first radiating element 2211 has a volume larger than the volume of the radiator box of the second radiating element 2212, while in FIG. 22*b* the volume of the radiator box of the first radiating element 2221 is substantially the same as that of the radiator box of the second radiating element 2222.

Figure 22C:
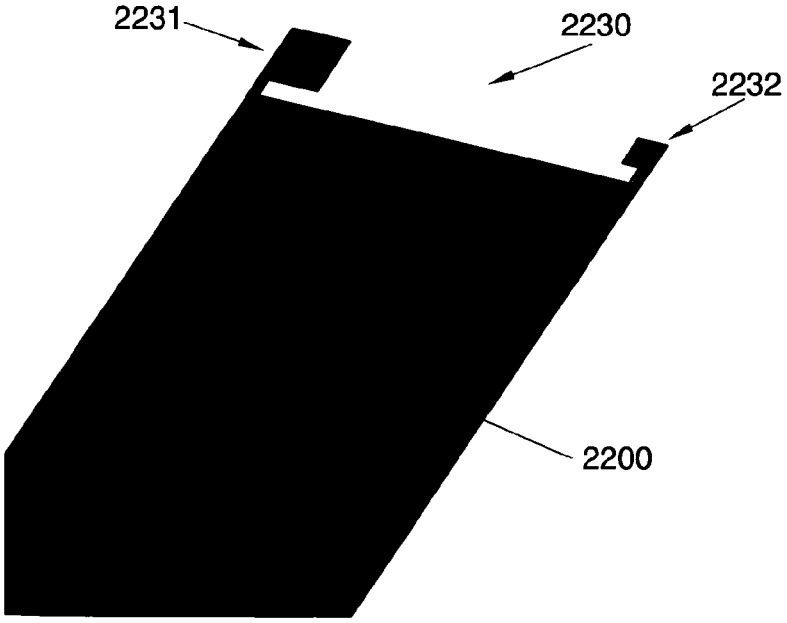
Figure 22D:
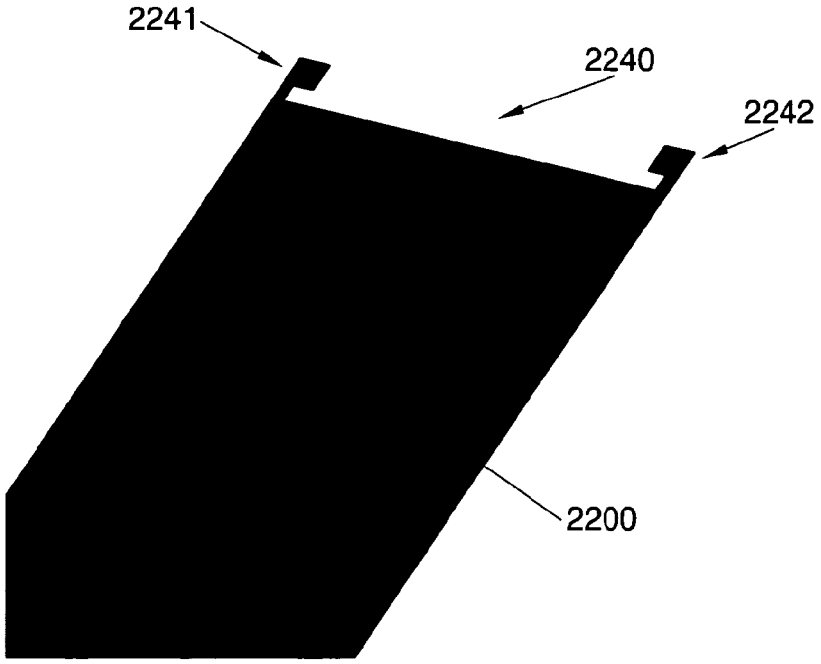

FIGS. 22*c* and 22*d* show two examples in which a first and second radiating element are substantially planar. The first radiating element 2231, 2241 and the second radiating element 2232, 2242 comprise a portion having the shape of a rectangle (and more preferably the shape of a square) and are located on the same plane as the one containing the ground plane layer 2200 (i.e., the first and second radiating elements 2231, 2232, 2241, 2242 and the ground plane layer 2200 are substantially coplanar).

In FIG. 22*c*, the radiator rectangle of the first radiating element 2231 has an area larger than the area of the radiator rectangle of the second radiating element 2232, while in FIG. 22*d* the area of the radiator rectangle of the first radiating element 2241 is substantially the same as that of the radiator rectangle of the second radiating element 2242.

Figure 22E:
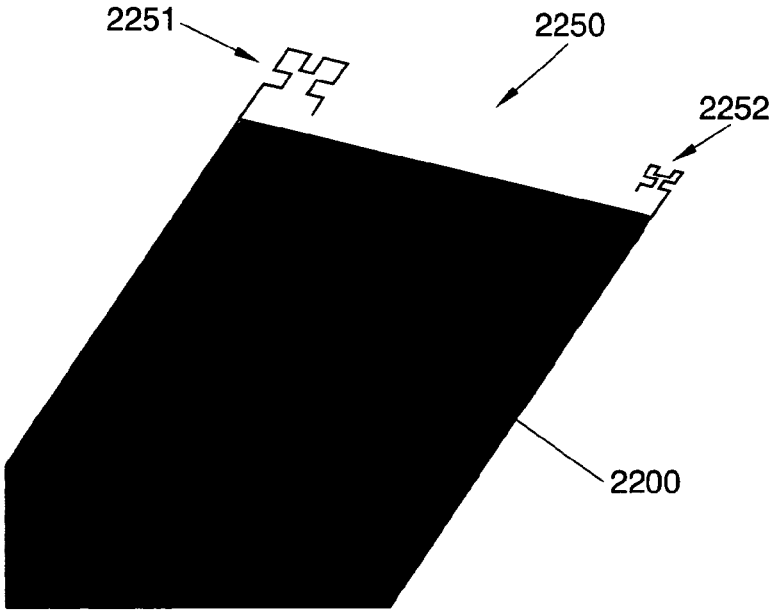
Figure 22F:
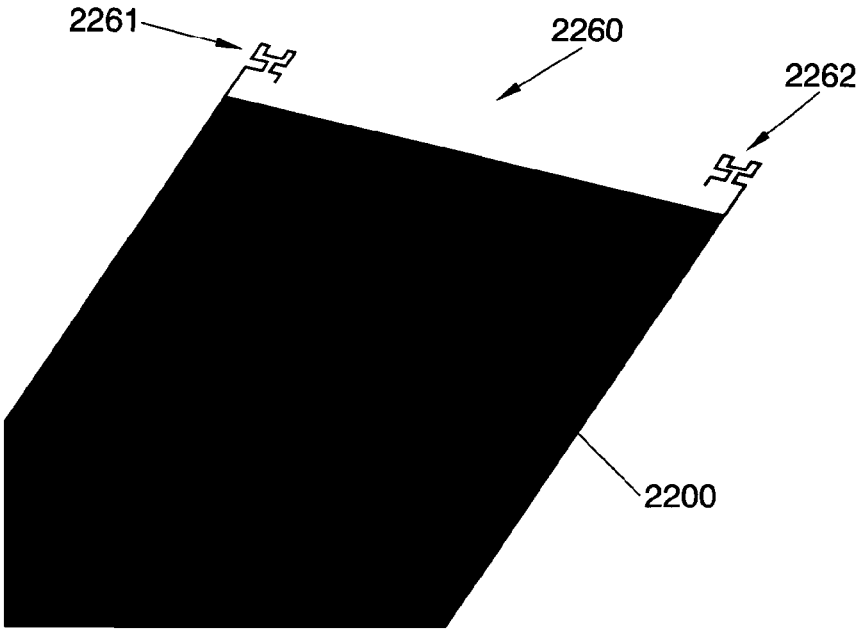

FIGS. 22*e* and 22*f* show two further examples in which a first and second radiating elements are substantially planar. The first radiating element 2251, 2261 and the second radiating element 2252, 2262 comprise a single radiating arm that defines a geometry with a radiating contour having a plurality of segments. In these examples, the radiator contour of the radiating elements 2251, 2252, 2261, 2262 has more than 10 segments but advantageously less than 20 segments in order to keep the geometrical complexity low. Also, although in these examples the number of segments of the radiator contour of the radiating elements 2251, 2252, 2261, 2262 appears to be the same, in other cases they may be different.

In some cases, as in the example in FIG. 22*e*, the sum of the length of the segments of the radiator contour of the first radiating element 2251 and that of the radiator contour of the second radiating element 2252 are different. In other cases, such as in the example of FIG. 22*f*, the sum of the length of the segments of the radiator contour of the first radiating element 2261 and that of the radiator contour of the second radiating element 2262 are substantially equal.

The invention claimed is:

1. A wireless handheld or portable device comprising:

an antenna system configured to operate in a first frequency region comprising a first frequency band, the antenna system comprising an antenna structure, a non-active matching and tuning system, and an external input/output (I/O) port;

the antenna structure comprising:

a radiating element including a connection point;

a ground plane layer including at least one connection point; and an internal I/O port coupled between the connection point of the radiating element and one of the at least one connection point of the ground plane layer;

the radiating element of the antenna structure extending beyond an edge of the ground plane layer, wherein at least a portion of an orthogonal projection of the radiating element on a plane containing the ground plane layer does not overlap the ground plane layer;

the non-active matching and tuning system comprising a first I/O port connected to the internal I/O port of the antenna structure, and a second I/O port connected to the external input/output (I/O) port of the antenna system;

the antenna structure featuring at the internal I/O port, when disconnected from the non-active matching and tuning system, an input return loss curve having a minimum at a frequency above the first frequency region, said frequency being an intrinsic frequency at the internal I/O port of the antenna structure;

the non-active matching and tuning system modifying an impedance of the antenna structure and providing impedance matching to the antenna system to transmit and receive electromagnetic wave signals in the first frequency band;

wherein a longest side of a radiator rectangle of the radiating element has a dimension smaller than one twentieth of a free-space operating wavelength corresponding to a lowest frequency of the first frequency region; and wherein a ratio between the intrinsic frequency at the internal I/O port of the antenna structure and the highest frequency of said first frequency region is greater than 2.2.

2. The wireless handheld or portable device according to claim 1, wherein a ratio between an area of the radiator rectangle of the radiating element and the square of the wavelength corresponding to a lowest frequency of the first frequency region is smaller than 0.6%.

3. The wireless handheld or portable device according to claim 1, wherein the orthogonal projection of the radiating element on the plane containing the ground plane layer does not overlap the ground plane layer.

4. The wireless handheld or portable device according to claim 1, wherein:

the antenna system is configured to operate in a second frequency region, wherein a highest frequency of the first frequency region is lower than a lowest frequency of the second frequency region; and the second frequency region comprises second and third frequency bands, the antenna structure further comprising:

a second radiating element including a connection point; and a second internal I/O port coupled between the connection point of the second radiating element and one of the at least one connection point of the ground plane layer;

the second radiating element of the antenna structure extending beyond an edge of the ground plane layer, wherein at least a portion of an orthogonal projection of the second radiating element on a plane containing the ground plane layer does not overlap the ground plane layer;

the non-active matching and tuning system further comprising a third I/O port connected to the second internal I/O port of the antenna structure;

the antenna structure featuring at the second internal I/O port, when disconnected from the non-active matching and tuning system, an input return loss curve having a minimum at a frequency above the second frequency region, said frequency being an intrinsic frequency at the second internal I/O port of the antenna structure; and the non-active matching and tuning system modifying the impedance of the antenna structure and providing impedance matching to the antenna system to transmit and receive electromagnetic wave signals in the second and third frequency bands.

5. The wireless handheld or portable device according to claim 1, wherein a smallest dimension of the radiating element is at least 0.5% of the free-space operating wavelength corresponding to the lowest frequency of the first frequency region.

6. The wireless handheld or portable device according to claim 1, wherein the radiating element has a characteristic dimension substantially close to a quarter of a wavelength of the intrinsic frequency.

7. The wireless handheld or portable device according to claim 1, wherein:

the first frequency region comprises a second frequency band; and the non-active matching and tuning system modifies the impedance of the antenna structure and provides impedance matching to the antenna system to transmit and receive electromagnetic wave signals in the second frequency band.

8. The wireless handheld or portable device according to claim 1, wherein:

the ground plane layer is encompassed by a ground plane rectangle; and a radiator rectangle of the radiating element has a longest side substantially parallel to a shorter edge of the ground plane rectangle.

9. The wireless handheld or portable device according to claim 1, wherein the ground plane layer is substantially rectangular.

10. The wireless handheld or portable device according to claim 1, wherein the first frequency region comprises a 824-960 MHz frequency range or a 1710-2170 MHz frequency range.

11. The wireless handheld or portable device according to claim 4, wherein:

the antenna system further comprises a second external input/output (I/O) port; and the non-active matching and tuning system comprises a fourth I/O port connected to the second external input/output (I/O) port.

12. The wireless handheld or portable device according to claim 4, wherein a longest side of a radiator rectangle of the second radiating element has a dimension smaller than one tenth of a free-space operating wavelength corresponding to the lowest frequency of the second frequency region.

13. The wireless handheld or portable device according to claim 4, wherein the first frequency region comprises a 824-960 MHz frequency range, and the second frequency region comprises a 1710-2170 MHz frequency range.

14. A wireless handheld or portable device comprising:

an antenna system configured to operate in a first frequency region comprising a first frequency band, and a second frequency region comprising second and third frequency bands, wherein a highest frequency of the first frequency region is lower than a lowest frequency of the second frequency region;

the antenna system comprising an antenna structure, a non-active matching and tuning system, and an external input/output (I/O) port;

the antenna structure comprising:

a first radiating element including a connection point;

a second radiating element including a connection point;

a ground plane layer including at least one connection point; and first and second internal I/O ports, the first internal I/O port being coupled between the connection point of the first radiating element and one of the at least one connection point of the ground plane layer, and the second internal I/O port being coupled between the connection point of the second radiating element and one of the at least one connection point of the ground plane layer;

each of the first and second radiating elements of the antenna structure extending beyond an edge of the ground plane layer, and at least a portion of orthogonal projections of the first and second radiating elements on a plane containing the ground plane layer do not overlap the ground plane layer;

the non-active matching and tuning system comprising a first I/O port connected to the first internal I/O port of the antenna structure, a second I/O port connected to the second internal I/O port of the antenna structure, and a third I/O port connected to the external input/output (I/O) port of the antenna system;

the antenna structure featuring at the first internal I/O port, when disconnected from the non-active matching and tuning system, an input return loss curve having a minimum at a frequency above the first frequency region, said frequency being an intrinsic frequency at the first internal I/O port of the antenna structure;

the antenna structure featuring at the second internal I/O port, when disconnected from the non-active matching and tuning system, an input return loss curve having a minimum at a frequency above the second frequency region, said frequency being an intrinsic frequency at the second internal I/O port of the antenna structure;

the non-active matching and tuning system modifying an impedance of the antenna structure and providing impedance matching to the antenna system to transmit and receive electromagnetic wave signals in the first, second and third frequency bands;

wherein a ratio between the intrinsic frequency at the first internal I/O port of the antenna structure and the highest frequency of the first frequency region is greater than 1.4; and wherein a ratio between the intrinsic frequency at the second internal I/O port of the antenna structure and the highest frequency of the second frequency region is greater than 2.2.

15. The wireless handheld or portable device according to claim 14, wherein the orthogonal projections of the first and second radiating elements on the plane containing the ground plane layer do not overlap the ground plane layer.

16. The wireless handheld or portable device according to claim 14, wherein a longest side of a radiator rectangle of the second radiating element has a dimension smaller than one twentieth of the free-space operating wavelength corresponding to the lowest frequency of the first frequency region.

17. The wireless handheld or portable device according to claim 14, wherein the first radiating element has a characteristic dimension substantially close to a quarter of a wavelength of the intrinsic frequency at the first internal I/O port, and the second radiating element has a characteristic dimension substantially close to a quarter of a wavelength of the intrinsic frequency at the second internal I/O port.

18. The wireless handheld or portable device according to claim 14, wherein the antenna system is configured to operate in a third frequency region comprising a fourth frequency band, wherein a lowest frequency of the third frequency region is higher than a highest frequency of the first frequency region;

the antenna structure further comprising:

a third radiating element including a connection point; and a third internal I/O port coupled between the connection point of the third radiating element and one of the at least one connection point of the ground plane layer;

the antenna structure featuring at the third internal I/O port, when disconnected from the non-active matching and tuning system, an input return loss curve having a minimum at a frequency above the third frequency region of operation of the antenna system, said frequency being an intrinsic frequency at the third internal I/O port of the antenna structure; and the non-active matching and tuning system modifying an impedance of the antenna structure and providing impedance matching to the antenna system to transmit and receive electromagnetic wave signals in the fourth frequency band.

19. The wireless handheld or portable device according to claim 14, wherein:

the ground plane layer is encompassed by a ground plane rectangle;

the connection point of the first radiating element is substantially close to a first end of a short side of the ground plane rectangle; and the connection point of the second radiating element is substantially close to a second end of said short side of the ground plane rectangle.

20. The wireless handheld or portable device according to claim 14, wherein a longest side of a radiator rectangle of the first radiating element has a dimension smaller than one twentieth of a free-space operating wavelength corresponding to a lowest frequency of the first frequency region.

21. The wireless handheld or portable device according to claim 14, wherein:

the antenna system comprises a second external input/output (I/O) port; and the non-active matching and tuning system comprises a fourth I/O port connected to the second external input/output (I/O) port.

22. The wireless handheld or portable device according to claim 14, wherein the first frequency region comprises a 824-960 MHz frequency range, and the second frequency region comprises a 1710-2170 MHz frequency range.

23. The wireless handheld or portable device according to claim 14, wherein:

the ground plane layer is encompassed by a ground plane rectangle; and a radiator rectangle of the first radiating element or a radiator rectangle of the second radiating element has a longest side substantially parallel to a shorter edge of the ground plane rectangle.

24. The wireless handheld or portable device according to claim 14, wherein the ground plane layer is substantially rectangular.

25. The wireless handheld or portable device according to claim 18, wherein a longest side of a radiator rectangle of the third radiating element has a dimension smaller than one twentieth of a free-space operating wavelength corresponding to a lowest frequency of the third frequency region.

26. The wireless handheld or portable device according to claim 18, wherein the second frequency region comprises a 1710-2170 MHz frequency range, and the third frequency region comprises a 824-960 MHz frequency range.

27. The wireless handheld or portable device according to claim 22, wherein each of the first, second and third frequency bands is used by a cellular communication service selected from the following: GSM 850, GSM 900, GSM 1800, GSM 1900, PCS, CDMA, UMTS, W-CDMA, cdmaOne, cdma2000, and TD-SCDMA.

28. The wireless handheld or portable device according to claim 23, wherein each of the radiator rectangle of the first radiating element and the radiator rectangle of the second radiating element has a longest side substantially parallel to a shorter edge of the ground plane rectangle.

29. A wireless handheld or portable device comprising:

an antenna system configured to operate in a first frequency region comprising a first frequency band, and a second frequency region comprising second and third frequency bands, wherein a highest frequency of the first frequency region is lower than a lowest frequency of the second frequency region;

the antenna system comprising an antenna structure, a non-active matching and tuning system, and an external input/output (I/O) port;

the antenna structure comprising:

a radiating element including a connection point;

a ground plane layer including a connection point; and an internal I/O port between the connection point of the radiating element and the connection point of the ground plane layer;

the radiating element of the antenna structure extending beyond an edge of the ground plane layer, and at least a portion of an orthogonal projection of the radiating element on a plane containing the ground plane layer does not overlap the ground plane layer;

the non-active matching and tuning system comprising a first I/O port connected to the internal I/O port of the antenna structure, and a second I/O port connected to the external input/output (I/O) port of the antenna system;

the antenna structure featuring at the internal I/O port, when disconnected from the non-active matching and tuning system, an input return loss curve having a minimum at a frequency above the second frequency region, said frequency being an intrinsic frequency at the internal I/O port of the antenna structure;

the non-active matching and tuning system modifying an impedance of the antenna structure and providing impedance matching to the antenna system to transmit and receive electromagnetic wave signals in the first, second and third frequency bands; and wherein a ratio between the intrinsic frequency at the internal I/O port of the antenna structure and the highest frequency of the first frequency region is greater than 2.2.

30. The wireless handheld or portable device according to claim 29, wherein a smallest dimension of the radiating element is at least a 0.5% of the free-space operating wavelength corresponding to the lowest frequency of the first frequency region.

31. The wireless handheld or portable device according to claim 29, wherein the orthogonal projection of the radiating element on the plane containing the ground plane layer does not overlap the ground plane layer.

32. The wireless handheld or portable device according to claim 29, wherein a height of the radiating element with respect to the ground plane layer is smaller than 2% of a wavelength corresponding to a lowest frequency of the first frequency region.

33. The wireless handheld or portable device according to claim 29, wherein:

the ground plane layer is encompassed by a ground plane rectangle; and a radiator rectangle of the radiating element has a longest side substantially parallel to a shorter edge of the ground plane rectangle.

34. The wireless handheld or portable device according to claim 29, wherein the ground plane layer is substantially rectangular.

* * * * *